US008021817B2

(12) United States Patent
Kikawa et al.

(10) Patent No.: US 8,021,817 B2
(45) Date of Patent: Sep. 20, 2011

(54) AGGREGATE DISPERSANT, METHOD OF MANUFACTURING AGGREGATE OF RESIN-CONTAINING PARTICLES, TONER, DEVELOPER, DEVELOPING APPARATUS, AND IMAGE FORMING APPARATUS

(75) Inventors: Keiichi Kikawa, Osaka (JP); Katsuru Matsumoto, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1074 days.

(21) Appl. No.: 11/882,370

(22) Filed: Aug. 1, 2007

(65) Prior Publication Data

US 2008/0032224 A1 Feb. 7, 2008

(30) Foreign Application Priority Data

Aug. 1, 2006 (JP) ..... P2006-210315
Jul. 31, 2007 (JP) ..... P2007-200196

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 6,153,346 | A | 11/2000 | Machata et al. | |
| 6,500,596 | B2 | 12/2002 | Tanabe et al. | |
| 7,284,716 | B2 | 10/2007 | Nakano et al. | |
| 7,442,245 | B2 * | 10/2008 | Blease et al. | 106/31.58 |
| 2005/0041523 | A1 | 2/2005 | Nakano | |
| 2005/0242218 | A1 | 11/2005 | Nakano et al. | |
| 2005/0271965 | A1 | 12/2005 | Kamiyoshi et al. | |
| 2006/0003274 | A1 * | 1/2006 | Imamura et al. | 430/529 |
| 2006/0046178 | A1 | 3/2006 | Akiyama et al. | |
| 2007/0196756 | A1 | 8/2007 | Shibai et al. | |
| 2008/0014521 | A1 * | 1/2008 | Tsubaki et al. | 430/108.1 |
| 2008/0248415 | A1 | 10/2008 | Maezawa et al. | |

FOREIGN PATENT DOCUMENTS

| | | | |
|---|---|---|---|
| CN | 1707365 | A | 12/2005 |
| JP | 3107062 | B2 | 9/2000 |
| JP | 2000-275907 | A | 10/2000 |
| JP | 2000-321821 | A | 11/2000 |
| JP | 2001-242663 | | 9/2001 |
| JP | 2001-255697 | | 9/2001 |
| JP | 2002-244348 | A | 8/2002 |
| JP | 2004-008898 | | 1/2004 |
| JP | 2004-077693 | | 3/2004 |
| JP | 2004-189765 | A | 7/2004 |
| JP | 2004-204032 | | 7/2004 |
| JP | 2004-295028 | A | 10/2004 |
| JP | 2005-330350 | A | 12/2005 |
| JP | 2005-345734 | A | 12/2005 |
| JP | 2006-65107 | A | 3/2006 |
| JP | 2006-184306 | A | 7/2006 |
| JP | 2007-219452 | A | 8/2007 |
| WO | 03/059497 | A | 7/2003 |

* cited by examiner

*Primary Examiner* — Janis L Dote
(74) *Attorney, Agent, or Firm* — Nixon & Vanderhye P.C.

(57) ABSTRACT

A toner in form of aggregate of resin-containing particles is manufactured by aggregating the resin-containing particles which contain binder resin and the colorant, with the aid of an aggregate dispersant containing a polymer in which anionic polar groups are bonded to a main chain. To be specific, salt of divalent or higher valent metal is added to a slurry of the resin-containing particles so that a metal ion and the anionic polar group are bonded to each other, and a temperature of the slurry is increased so that a bond between the anionic polar group and a water molecule is broken. This decreases water-solubility of the polymer so that the resin-containing particles are aggregated.

11 Claims, 8 Drawing Sheets

AGGREGATE DISPERSANT, METHOD OF MANUFACTURING AGGREGATE OF RESIN-CONTAINING PARTICLES, TONER, DEVELOPER, DEVELOPING APPARATUS, AND IMAGE FORMING APPARATUS

CROSS-REFERENCE TO RELATED APPLICATION

This application claims priority to Japanese Patent Application No. 2006-210315, which was filed on Aug. 1, 2006 and Japanese Patent Application No. 2007-200196, which was filed on Jul. 31, 2007, the contents of which are incorporated herein by reference in its entirety.

BACKGROUND OF THE INVENTION

1. Field of the Invention

The present invention relates to an aggregate dispersant, a method of manufacturing an aggregate of resin-containing particles, a toner, a developer, a developing apparatus, and an image forming apparatus.

2. Description of the Related Art

A toner which develops a latent image is used for a variety of image forming processes, and as an example of use of the toner is known a use in an electrophotographic image forming process. An image forming apparatus which forms images in an electrophotographic system includes a photoreceptor, a charging section, an exposing section, a developing section, a transfer section, and a fixing section. The charging section charges a surface of the photoreceptor. The exposing section irradiates the charged surface of the photoreceptor with signal light to thereby form an electrostatic latent image corresponding to image information. The developing section supplies a toner contained in a developer to the electrostatic latent image formed on the surface of the photoreceptor so that a toner image is formed. The transfer section transfers the toner image formed on the surface of the photoreceptor to a recording medium. The fixing section fixes the transferred toner image onto the recording medium. The cleaning section cleans the surface of the photoreceptor from which the toner image has been transferred. In the image forming apparatus as described above, the electrostatic latent image is developed by using as the developer a one-component developer containing a toner or a two-component developer containing toner and carrier so that an image is formed. The toner used in the above case is formed of resin particles which are obtained in a manner that, for example, colorant and a release agent such as wax are dispersed and granulated in binder resin serving as a matrix.

Through the electrophotographic image forming apparatus, an image having favorable image quality can be formed at high speed and low cost. This promotes the use of the electrophotographic image forming apparatus in a copier, a printer, a facsimile, or the like machine, resulting in a remarkable spread thereof in recent years. Simultaneously, the image forming apparatus has faced up to more demanding requirements. Among such requirements, particular attentions are directed to enhancement in definition and resolution, stabilization of image quality, and an increase in image forming speed, regarding an image being formed by the image forming apparatus. In order to fulfill these demands, a two-way approach is indispensable in view of both the image forming process and the developer.

Regarding the enhancement in definition and resolution of the image, the reduction in diameter of toner particles is one of problems to be solved from the aspect of the developer.

This is based on the perspective such that it is important to authentically reproduce the electrostatic latent image. As a method of manufacturing the diameter-reduced toner particles, the emulsion aggregation method is known, for example. In the emulsion aggregation method, coloring resin particles containing binder resin, colorant, a release agent, and the like ingredient are generated and then aggregated in water, thus manufacturing toner particles.

As the diameter-reduced toner particles manufactured by the emulsion aggregation method, there is a toner which exhibits an acid number falling in a range of 1.0 mg KOH/g to 20 mg KOH/g and contains 3% by weight or less of a residual surfactant in the toner particles and 10 ppm or more and 1% by weight or less of an aggregating agent composed of salt of divalent or higher valent water-soluble inorganic metal having charges (refer to Japanese Examined Patent Publication JP-B2 3107062, for example).

The toner disclosed in JP-B2 3107062 is manufactured as follows. First of all, resin fine particle dispersion, colorant dispersion, and wax dispersion were mixed with each to obtain an admixture. To a dispersion medium of the admixture is then added the aggregating agent dispersible therein, which contains at least the salt of divalent or higher valent inorganic metal having charges, thereby forming aggregates. The aggregates are then heated up to a temperature equal to or higher than a glass transition temperature of the resin so that the aggregates are fused, thus resulting in toner particles. In a manufacturing method as just described, an amount of the surfactant contained in the toner particles is set at a predetermined level or lower, the content of the salt of divalent or higher valent inorganic metal used for aggregation is set to fall in a specific range, and an ion bridge is introduced into binder resin. The toner disclosed in JP-B2 3107062 is thus obtained.

In the method of manufacturing a toner as stated above, the resin fine particle dispersion composed of an aqueous medium and resin particles formed therein, the colorant dispersion composed of an aqueous medium and colorant particles formed therein, and the wax dispersion composed of an aqueous medium and wax particles formed therein are mixed with each other, thereby aggregating the resin particles, the colorant particles, and the wax particles. This leads to formation of a toner which is an aggregate of respective particles. Such a toner in form of aggregate of particles has pigment particles and wax particles exposed on a surface of the toner. The exposure of the wax particles on the surface of the toner will cause a decrease in preservation stability and further, when the wax particles are detached from the toner, the anti-offset property will deteriorate. In addition, the exposure of the colorant particles will cause the toner to exhibit nonuniform charging performance. Moreover, the variation among ratios of the resin, colorant, and wax contained in the respective aggregates may result in a failure to benefit the charging stability of the toner.

In view of the problem as described above, there has been proposed another method of obtaining a toner formed of aggregates of respective particles (refer to Japanese Unexamined Patent Publication JP-A 2004-295028, for example). In the method, low-molecular-weight resin incorporates 25% by weight to 75% by weight of wax and colorant to thereby form wax masterbatch particles which are then aggregated as well as binder resin particles. According to JP-A 2004-295028, the wax masterbatch is prepared by incorporating the wax and colorant into the low-molecular-weight resin and then treated with a dry or wet pulverization, thereby forming 10 nm to 5 mm-sized wax masterbatch particles. Furthermore, the binder resin particles whose average particle diameter falls in a range from 50 nm to 800 nm are prepared by emulsion polymerization. Subsequently, dispersion in which the formed wax masterbatch particles are dispersed is mixed with dispersion in which the formed binder resin particles are dispersed so that the wax masterbatch particles and the binder resin particles are aggregated. The aggregates of particles are then heated to be fused with each other. A toner is thus formed.

In the toner disclosed in JP-A 2004-295028, the wax masterbatch particles contain the wax and colorant in a dispersed state, which are smaller in particle diameter than the wax masterbatch particles. Amounts of the pigment and wax can be thus decreased which are exposed on the surface of the aggregate composed of aggregated wax masterbatch particles and binder resin particles described above, as compared to those in the toner disclosed in JP-B2 3107062.

The toner disclosed in JP-A 2004-295028 may, however, suffer from the variation in respective contents of colorant, wax, etc. in the toner because the toner is formed of the wax masterbatch particles and the binder resin particles, that is to say, the toner is formed of aggregated particles which are different in component and composition. As a result, the problem of failing to benefit the charging stability is not solved even by the toner disclosed in JP-A 2004-295028. Furthermore, the toner disclosed in JP-A 2004-295028 requires respective fabrications of the wax masterbatch particles and the binder resin particles, which makes the manufacturing process complicated.

SUMMARY OF THE INVENTION

An object of the invention is to provide a toner which can be manufactured in a simple production method and which is formed of aggregate of resin-containing fine particles and nevertheless has no colorant particles or no release agent particles exposed on a surface of the toner with no variation in contents of the colorant and release agent. Another object of the invention is to provide a method of manufacturing the aggregate of the resin-containing particles for use in the toner. Still another object of the invention is to provide an aggregate dispersant for use in the method.

Furthermore, a further object of the invention is to provide a developer comprising the toner mentioned above, a developing apparatus for developing a latent image using the developer, and an image forming apparatus provided with the developing apparatus.

The invention provides an aggregate dispersant comprising a polymer in which an anionic polar group is bonded to a main chain.

According to the invention, an aggregate dispersant contains a polymer in which an anionic polar group is bonded to a main chain. In the presence of the aggregate dispersant as just mentioned, particles are added to an aqueous medium. In the case where a temperature of the aqueous medium is lower than an aggregation onset temperature of the aggregate dispersant, the anionic polar group is hydrogen-bonded to a water molecule in the aqueous medium, so that the particles put in the aqueous medium are dispersed, thus resulting in a slurry of the particles. On the other hand, in the case where the temperature of the aqueous medium is equal to or higher than the aggregation onset temperature of the aggregate dispersant, the hydrogen bond between the anionic polar group and the water molecule is broken, thus resulting in aggregation of the particles dispersed in the aqueous medium. As described above, the aggregate dispersant containing the polymer in which the anionic polar group is bonded to the main chain exhibits dispersing ability for dispersing the particles in the aqueous medium and aggregating ability for aggregating the particles dispersed in the aqueous medium, depending on the temperature of the aqueous medium. It is thus no longer necessary to individually use an aggregating agent and dispersant. This also means that there is no need any more to consider the combination of the dispersant and the aggregating agent. Furthermore, in the case where the temperature of the aqueous medium is lower than the aggregation onset temperature of the aggregate dispersant, the anionic polar group is hydrogen-bonded to the water molecule in the aqueous medium and therefore, in isolating the particles from the aqueous medium, the aggregation dispersant can be removed from the particles by aqueous cleaning, thus resulting in particles which contain no impurities. The aggregation onset temperature of the aggregate dispersant herein means a temperature at which the hydrogen bond between the anionic polar group contained in the aggregate dispersant and the water molecule is broken. It is possible to determine with eyes whether or not the aggregation has started.

Furthermore, in the invention, it is preferable that the polymer is polyacrylic acid.

According to the invention, the polymer is polyacrylic acid. The polyacrylic acid is a polymer which contains a slightly acidic carboxyl group in a main chain. In a polymer having a polar group in a main chain, the number of the polar groups contained in the polymer is large. The aggregation thus proceeds so excessively as to be controlled with difficulty if the respective polar groups have strong impacts such as strong acid. In the case of the polyacrylic acid which is a polymer containing a slightly acidic carboxyl group in a main chain, the impacts of respective polar groups can be as small as possible. Consequently, the dispersing ability for dispersing the particles in the aqueous medium can appear in the case where the temperature of the aqueous medium is lower than the aggregation onset temperature of the aggregate dispersant while the aggregating ability for aggregating the particles dispersed in the aqueous medium can appear in the case where the temperature of the aqueous medium is equal to or higher than the aggregation onset temperature of the aggregate dispersant.

In the invention, it is preferable that the anionic polar group of the polymer is neutralized by an alkali metal base, and a neutralization level of the anionic polar group by the alkali metal base is within a range of from 80 mol % to 100 mol %.

According to the invention, the anionic polar group of the polymer contained in the aggregate dispersant is neutralized by the alkali metal base, and a neutralization level of the anionic polar group by the alkali metal base is within a range of from 80 mol % to 100 mol %. The neutralization level of the anionic polar group by the alkali metal base means a percentage of a number of moles of an added alkali metal base to that of the anionic polar base.

The anionic polar group of the polymer is neutralized, so that water solubility of the polymer can be enhanced and dispersing ability of the aggregate dispersant can be enhanced. Furthermore, since the anionic polar group of the polymer is neutralized by the alkali metal base, variation of neutralization levels of the polymer can be suppressed and the dispersing ability of the aggregate dispersant can be maintained, compared to cases of neutralization by other bases than alkali metal bases. For example, in the case where an ammonium salt has been already formed of the anionic polar group of the polymer by neutralization with ammonia, when a slurry comprising an aggregate dispersant and particles is exposed to high temperature, for example, at a step of finely granulating particles, the ammonia is evaporated as a gas and consequently the neutralization level is lowered. In order to suppress the variation of neutralization level due to such evaporation of the base, it is preferable that neutralization of the anionic polar group of the polymer is carried out by a nonvolatile base.

Furthermore, in the case of neutralization of the anionic polar group by an alkali metal base, which is nonvolatile, the aggregate dispersant can be removed more easily by water washing or the like, compared to neutralization by other bases. Accordingly, as mentioned above, owing to neutralization of the anionic polar group of the polymer by an alkali metal base, the variation of neutralization level can be suppressed and accordingly an aggregate dispersant can be attained that has a certain dispersing ability and can be easily removed.

Furthermore, as mentioned above, the neutralization level of the anionic polar group by the alkali metal base is within a range of from 80 mol % to 100 mol %. If the neutralization level of the anionic polar group by the alkali metal base is less than 80 mol %, hydrophilicity of the aggregate dispersant to the aqueous medium may possibly be lowered. Such lowering of hydrophilicity of the aggregate dispersant to the aqueous medium containing the aggregate dispersant and particles may be detrimental, for example, to sufficient granulation of the particles, because, in the case where a solid content including mainly the particles accounts for 30% or more in the aqueous medium, the aggregate dispersant cannot sufficiently offer its dispersing ability in finely granulating the particles. In other words, in the case where a neutralization level of the anionic polar group by the alkali metal base is 100 mol %, the aqueous medium's pH becomes approximately 7 to 9. If more excess alkali metal base is contained in the aggregate dispersant, namely, if the neutralization level of anionic polar group by the alkali metal base exceeds a level of 100 mol %, the aqueous medium containing the aggregate dispersant and particles leans to being alkaline, and consequently a possibility of hydrolysis of polymer contained in the aggregate dispersant is increased. In the case where the particles contain resin, a possibility of hydrolysis of the resin in the particles is also increased. As mentioned above, by employing a neutralization level of the anionic polar group by the alkali metal base within a range of from 80 mol % to 100 mol %, hydrophilicity of the aggregate dispersant to the aqueous medium can be made good and hydrolysis of polymer etc. in the aggregate dispersant can be suppressed. Accordingly it is possible to achieve an aggregate dispersant having certain dispersing and aggregating abilities.

Furthermore, in the invention, it is preferable that the polymer has a weight average molecular weight more than 4000 and less than 90000, or equal to 90000.

According to the invention, the polymer in the aggregate dispersant has a weight average molecular weight more than 4000 and less than 90000, or equal to 90000. When the polymer has a weight average molecular weight not exceeding 4000, the steric structure of the polymer is relatively simple, compared to the case of a weight average molecular weight exceeding 4000, so that the polymer is good in dispersing ability, but possibly poor in dispersing stability. In the case where particles are dispersed using an aggregate dispersant of poor dispersing stability, there is a possibility that particles which were already dispersed aggregate again. In the case where weight average molecular weight of the polymer exceeds 90000, the polymer has a complicated steric structure compared to the case of a weight average molecular weight equal to or less than 90000, so that the polymer is of good dispersing stability, but possibly of lower dispersing ability. In the case where a slurry containing an aggregate dispersant comprising a polymer having a weight average molecular weight more than 90000 and particles is prepared, viscosity of the slurry increases compared to the case of a polymer having a weight average molecular weight of 90000 or less, and accordingly the slurry is not good for a high pressure homogenizer method in which particles in the slurry are finely granulated using a high-pressure homogenizer because plugging in a tubule such as a nozzle of the high-pressure homogenizer is easily caused. As mentioned above, by employing a weight average molecular weight of the polymer more than 4000 and less than 90000, or equal to 90000, it is made possible to achieve such an aggregate dispersant preferable for a high pressure homogenizing method that is excellent in dispersing ability and dispersing stability, and can suppress increase of viscosity of a slurry.

Furthermore, the invention provides a method of manufacturing an aggregate of resin-containing particles, comprising aggregating the resin-containing particles containing binder resin and colorant by using the above-stated aggregate dispersant and a salt of divalent or higher valent metal.

According to the invention, an aggregate of resin-containing particles (which may be hereinafter referred to as "a particle aggregate") is manufactured by aggregating the resin-containing particles containing binder resin and colorant with the aid of the above-stated aggregate dispersant and salt of divalent or higher valent metal. In the method of manufacturing the particle aggregate as just described, the aggregate dispersant which exhibits the above effects is used and therefore, the resin-containing particles can be dispersed in the aqueous medium, and the dispersed resin-containing particles can be aggregated in the aqueous medium. In addition, the salt of divalent or higher valent metal is used to thereby bond a metal ion of the divalent or higher valent metal and the anionic polar group of the aggregate dispersant. By so doing, an aggregation degree of the resin-containing particles can be controlled more easily so that there can be obtained the particle aggregates which are uniform in size and shape, as compared to the case where the salt of divalent or higher valent metal is not used.

Furthermore, the aggregation of the resin-containing particles containing the binder resin and the colorant allows a decrease in amounts of components such as the colorant other than the binder resin exposed on a surface of the particle aggregate as compared to that in the particle aggregate composed of aggregated binder resin particles and colorant particles. Moreover, the variation in the content of the colorant in the particle aggregate can be smaller. The manufactured particle aggregate can be thus used favorably, for example, for a toner intended to form images.

Furthermore, in the invention, it is preferable that the method comprises:

a dispersing step for dispersing in an aqueous medium, irregular resin particles containing the binder resin and the colorant in the presence of the aggregate dispersant, to obtain a slurry of the irregular resin particles;

a finely-granulating step for finely granulating the irregular resin particles contained in the slurry to obtain a slurry of the resin-containing particles; and an aggregating step for aggregating the resin-containing particles by adding the salt of divalent or higher valent metal to the slurry of the resin-containing particles.

According to the invention, at a dispersing step, the resin-containing particles are dispersed in an aqueous medium in the presence of the aggregating dispersant of the invention, resulting in a slurry of the resin-containing particles. And at an aggregating step, the salt of divalent or higher valent metal is added to the slurry of the resin-containing particles, thereby aggregating the resin-containing particles. Through the dispersing step and the aggregating step as described above, it is possible to reduce the amounts of components such as the colorant other than the binder resin exposed on the surface of the particle aggregate. Moreover, the variation in the content of the colorant in the particle aggregate can be smaller.

Furthermore, in the invention, it is preferable that a temperature of the slurry in the finely-granulating step is less than a reference temperature (Tg ° C.+100° C.) which is an addition of a glass transition temperature Tg ° C. and 100° C.

According to the invention, a temperature of the slurry in the finely granulating step is less than a reference temperature (Tg ° C.+100° C.) which is an addition of a glass transition temperature Tg ° C. and 100° C. If a temperature of the slurry in the finely granulating step is equal to or more than the reference temperature, finely granulating irregular resin particles may be possibly carried out under the condition that the aggregate dispersant lost its dispersing ability and irregular resin particles which were dispersed at a dispersing step are possibly aggregated again with the result that resin containing particles of a desired particle diameter cannot be obtained. Furthermore, in the case where finely granulating is carried out using a high pressure homogenizer, there is a possibility of occurrence of plugging up a piping with the aggregated irregular resin particles. As mentioned above, by controlling the temperature of the slurry to be less than the reference temperature, it is made possible to maintain the dispersing ability of the aggregate dispersant and prevent the irregular resin particles from being aggregated again at the finely granulating step. Accordingly resin-containing particles having a desired particle diameter can be surely obtained. In addition, the slurry can be prevented from plugging up a piping in finely granulating irregular resin particles with a high-pressure homogenizer.

Furthermore, in the invention, it is preferable that an amount of the salt of divalent or higher valent metal added to the slurry of the resin-containing particles is such that a total valence of an anionic polar group contained in the polymer is larger than a total valence of the salt of divalent of higher valent metal.

According to the invention, an amount of the salt of divalent or higher valent metal added to the slurry of the resin-containing particles is such that a total valence of an anionic polar group contained in the polymer is larger than a total valence of the salt of divalent or higher valent metal. When the salt of divalent or higher valent metal is added in such an amount, the anionic polar group is not bonded to the metal ion of the salt of divalent or higher valent metal and thus able to exist in a state of being hydrogen-bonded to the water molecule in the aqueous medium, with the result that the resin-containing particles can be aggregated while appropriate dispersibility of the resin-containing particles is maintained. Even when the salt of divalent or higher valent metal is added, it is still possible to carry out the cleaning with water.

Furthermore, in the invention, it is preferable that a ratio of the salt of divalent or higher valent metal added to the slurry of the resin-containing particles is in a range of from 65 parts by weight to 300 parts by weight based on 100 parts by weight of the aggregate dispersant.

According to the invention, a ratio of the salt of divalent or higher valent metal added to the slurry of the resin-containing particles is in a range of from 65 parts by weight to 300 parts by weight based on 100 parts by weight of the aggregate dispersant. By adding the salt of divalent or higher valent metal in such a ratio, it is possible to prevent the resin-containing particles from being insufficiently aggregated and from being excessively aggregated.

Furthermore, in the invention, it is preferable that the salt of divalent or higher valent metal is used in form of solution.

According to the invention, the salt of divalent or higher valent metal is used in form of solution. The use of the salt of divalent or higher valent metal in form of solution allows the salt of divalent or higher valent metal to be evenly dispersed in the slurry of the resin-containing particles. Furthermore, the form of solution will enhance the operability in adding an appropriate amount of the salt of divalent or higher valent metal to the slurry of the resin-containing particles. Consequently, the aggregation degree of the resin-containing particles can be adjusted to a favorable level, and the resin-containing particles can be prevented from being insufficiently aggregated and from being excessively aggregated.

Furthermore, in the invention, it is preferable that concentration of the salt of divalent or higher valent metal in the solution of the salt of divalent or higher valent metal is 5% by weight to 30% by weight.

According to the invention, concentration of the salt of divalent or higher valent metal in the solution of the salt of divalent or higher valent metal (hereinafter referred to as "a metal salt solution") is 5% by weight to 30% by weight. By setting the concentration of the salt of divalent or higher valent metal to fall within such a range, it is further easier to add the metal salt solution, and the resin-containing particles can be prevented from being insufficiently aggregated and from being excessively aggregated. This makes it possible to control a size of the particle aggregate.

Furthermore, in the invention, it is preferable that the solution of the salt of divalent or higher valent metal drips into the slurry of the resin-containing particles at a drip rate of 0.05 mL/min to 0.20 mL/min.

According to the invention, the metal salt solution drips into the slurry of the resin-containing particles at a drip rate of 0.05 mL/min to 0.20 mL/min. By dripping the metal salt solution at such a drip rate, it is possible to manufacture in good yield the particle aggregate which is excellent in productivity and not varied in size and shape. In this case, the scale-up to an industrial level is also facilitated.

Furthermore, in the invention, it is preferable that a use ratio of the resin-containing particles is in a range of from 3 parts by weight to 50 parts by weight based on 100 parts by weight of the aqueous medium.

According to the invention, a use ratio of the resin-containing particles is within a range of from 3 parts by weight to 50 parts by weight based on 100 parts by weight of the aqueous medium. Such a use ratio of the resin-containing particles makes efficient dispersion and aggregation of the resin-containing particles in an aqueous medium possible, and makes it easier to obtain a particle aggregate of an intended size.

Furthermore, in the invention, it is preferable that a volume average particle diameter of the resin-containing particles is 0.4 μm to 2.0 μm.

According to the invention, a volume average particle diameter of the resin-containing particles is 0.4 μm to 2.0 μm. By using the resin-containing particles whose volume average particle diameter falls in such a range, for example, in the case where the particle aggregate is used as a toner, it is possible to obtain a particle aggregate whose particle diameter is favorable as a toner.

Furthermore, in the invention, it is preferable that a use ratio of the aggregate dispersant is in a range of from 5 parts by weight to 20 parts by weight based on 100 parts by weight of the resin-containing particles.

According to the invention, a use ratio of the aggregate dispersant is in a range of from 5 parts by weight to 20 parts by weight based on 100 parts by weight of the resin-containing particles. By using such an amount of the aggregate dispersant, the aggregate dispersant further prominently exerts its dispersing ability and aggregating ability, and the particle aggregate is more easily shaped into an intended size.

Furthermore, the invention provides a toner comprising an aggregate of resin-containing particles manufactured by the method of manufacturing an aggregate of resin-containing particles mentioned above.

According to the invention, a toner comprises an aggregate of resin-containing particles manufactured by the method of manufacturing an aggregate of resin-containing particles mentioned above. In a method of manufacturing an aggregate of resin-containing particles according to the invention, an aggregate of resin-containing particles is manufactured by aggregating resin-containing particles using the aggregate dispersant and a salt of divalent or higher valent metal. Dispersing ability and aggregating ability of the aggregate dispersant can be controlled by changing the temperature of the aqueous medium containing the resin-containing particles. Accordingly, compared to dispersion of resin-containing particles by using a dispersant dispersing ability of which cannot be controlled, the solid content of the resin-containing particles in the aqueous medium can be increased by controlling the temperature of the aqueous medium to be lower than an aggregation onset temperature of the aggregation dispersant. Consequently, distances between the resin-containing particles are shortened in aggregating the resin-containing particles, which allows easier aggregation. As a result, the amount of the salt of divalent or more valent metal to be added to the aqueous medium can be decreased. Accordingly, since the amount of the salt of divalent or more valent metal contained in the toner which is an aggregate of resin-containing particles can be decreased, it is possible to suppress adverse effects of the salt of metal on charging performance and achieve a toner having excellent charging performance. Furthermore, it is possible to achieve a toner having good environmental stability. As mentioned above, the capability of increasing a solid content of resin-containing particles in the aqueous medium is also preferable from an aspect of costs of manufacturing, and preferable from aspects of amount of the aqueous medium to be used and time necessary for manufacturing the toner. In other words, since it is possible to manufacture a toner with resin-containing particles having an increased solid content and it is thereby possible to decrease the amount of the aqueous medium to be used for manufacturing a toner and shorten a time necessary for manufacturing a same amount of toner, an excellent toner can be provided in reduced costs, as mentioned above.

Furthermore, in the invention, it is preferable that in the resin-containing particles are dispersed colorant particles and release agent particles in binder resin, colorant particles having a dispersion diameter of 0.01 μm to 0.5 μm occupies 70% by number or more of total colorant particles contained in the toner; and release agent particles having a dispersion diameter of 0.1 μm to 1.0 μm occupies 50% by number or more of total release agent particles contained in the toner.

According to the invention, it is possible to obtain a toner which is formed of aggregate of resin-containing particles and in which colorant particles and release agent particles dispersed in binder resin respectively have favorable dispersion diameters. To be specific, the resin-containing particles for forming the aggregate which is to be the toner are prepared by dispersing the colorant particles and the release agent particles into the binder resin, and the volume average particle diameter of the resin-containing particles is 0.4 μm to 2.0 μm. Furthermore, in the toner formed of the aggregate as just described, colorant particles having a dispersion diameter of 0.01 μm to 0.5 μm occupies 70% by number or more of total colorant particles contained in the toner while release agent particles having a dispersion diameter of 0.1 μm to 1.0 μm occupies 50% by number or more of total release agent particles contained in the toner.

Since the toner as described above is composed of the colorant particles and release agent particles dispersed in the binder resin, amounts of the colorant particles and release agent particles exposed on a surface of the aggregate can be smaller than that of a particle aggregate which is formed of aggregated binder resin particles, colorant particles, and release agent particles. This makes it possible to prevent the blocking which is caused by thermal aggregation of a toner inside an image forming apparatus so that the preservation stability of the toner can be enhanced. In this case, it is also possible to enhance the charging stability of the toner.

Furthermore, in forming an image by using a toner, the favorable dispersion diameters of the colorant particles and release agent particles contained in the toner contribute to enhancement in, for example, transfer rates of a toner image from a photoreceptor to a recording medium, from the photoreceptor to an intermediate medium, and from the intermediate medium to a recording medium, thus achieving reduction of toner consumption. Furthermore, in this case, image defects are prevented from appearing such as image fog caused by defective charging of the toner. Furthermore, the bleeding out of the release agent very hardly occurs, and it is possible to reliably prevent the toner filming onto the photoreceptor, the offset phenomenon in a high-temperature range, and the like trouble from arising. The toner as just described can be obtained by the method of manufacturing the particle aggregate of the invention.

The invention provides a developer comprising the toner mentioned above.

According to the invention, a developer comprises the toner mentioned above. The toner is excellent in charging performance and environmental stability. Accordingly it is possible to achieve a developer which is highly stable in properties and capable of stably forming an image of high quality.

Furthermore, the invention provides a developing apparatus that forms a toner image by developing a latent image formed on an image bearing member using the developer mentioned above.

According to the invention, a toner image is formed by developing a latent image formed on an image bearing member using the developer mentioned above. Accordingly a developing apparatus is achieved that is capable of stably forming a toner image of high quality on an image bearing member.

Furthermore, the invention provides an image forming apparatus comprising:

an image bearing member on which a latent image is formed;

a latent image forming member for forming a latent image on the image bearing member; and the developing apparatus mentioned above.

According to the invention, a latent image formed on the image bearing member by the latent image forming member is developed by the developing apparatus mentioned above. Since the developing apparatus develops a latent image with the developer mentioned above, it is possible to stably form a toner image of high quality on the image bearing member. Accordingly an image forming apparatus is achieved that is capable of stably forming an image of high quality.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
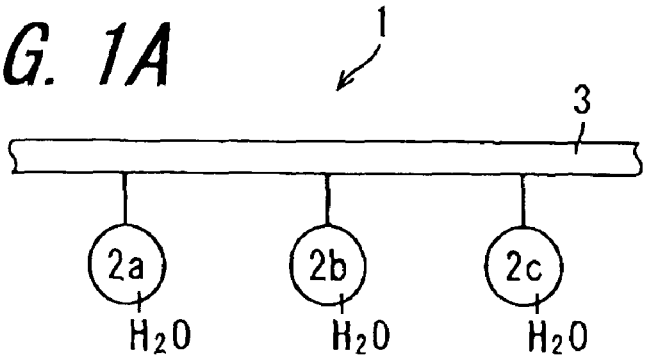
FIGS. 1A to 1C are schematic views each showing a polymer contained in an aggregate dispersant of the invention, which exists in an aqueous medium.

Now referring to the drawings, preferred embodiments of the invention are described below.

[Aggregate Dispersant]

An aggregate dispersant of the invention is characterized in containing as an active component a polymer in which an anionic polar group is bonded to a main chain. The polymer has a main chain which acts as a hydrophobic group and an anionic polar group which acts as a hydrophilic group. By changing a temperature of an aqueous medium, the aggregate dispersant of the invention exhibits dispersing ability for dispersing resin-containing particles into the aqueous medium or aggregating ability for aggregating the resin-containing particles dispersed in the aqueous medium. The temperature of the aqueous medium is determined by measuring a temperature of slurry which may be assumed to be equal to the temperature of the aqueous medium.

In the slurry whose temperature is lower than an aggregation onset temperature of the aggregate dispersant, the anionic polar group of the polymer is hydrogen-bonded to a water molecule in the aqueous medium. The resin-containing particles existing in the aqueous medium can be thus in a dispersed state, therefore resulting in a slurry which contains the resin-containing particles. A temperature of the slurry which contains the resin-containing particles is then increased to a temperature equal to or higher than the aggregation onset temperature of the aggregate dispersant, and the hydrogen bond between a part of the anionic polar group of the polymer and the water molecule is broken as a result of the temperature rise of the slurry. This causes a decrease in water solubility of the polymer, thus leading to aggregation of the resin-containing particles in the slurry.

By using the above-described aggregate dispersant which has both of the dispersing ability and the aggregating ability, it is no longer necessary to individually use an aggregating agent and dispersant. This also means that there is no need any more to consider the combination of the dispersant and the aggregating agent. Furthermore, in the case where the temperature of the aqueous medium is lower than the aggregation onset temperature of the aggregate dispersant, the anionic polar group is hydrogen-bonded to the water molecule in the aqueous medium and therefore, in isolating the particles from the aqueous medium, the aggregation dispersant can be removed from the particles by aqueous cleaning. The cleaning can be therefore carried out with ease. It is thus possible to prevent the isolated particle aggregate from containing impurities.

The anionic polar group of the polymer usable for the aggregate dispersant as described above includes a carboxyl group, a sulfonate group, and a phosphonate group, among which the carboxyl group is particularly preferable. The polymer in which the anionic polar group is bonded to the main chain is prepared, for example, by polymerizing monomers each having the anionic polar group. Alternatively, a monomer having the anionic polar group and another monomer may be polymerized through random copolymerization, block copolymerization, graft copolymerization, or the like copolymerization, thereby resulting in the polymer in which the anionic polar group is bonded to the main chain.

Among the monomers each having the anionic polar group, the monomer having the carboxyl group includes, for example, ethylene-unsaturated carboxylic acid. The ethylene-unsaturated carboxylic acid includes, for example, ethylene-unsaturated monocarboxylic acid such as acrylic acid, methacrylic acid, and crotonic acid; ethylene-unsaturated dicarboxylic acid such as maleic acid and fumaric acid; ethylene-unsaturated carboxylic acid anhydride such as maleic acid anhydride; and ethylene-unsaturated carboxylic acid alkyl ester. The ethylene-unsaturated carboxylic acid alkyl ester includes, for example, lower alkyl ester of ethylene-unsaturated monocarboxylic acid such as methyl acrylate; lower alkyl half ester of ethylene-unsaturated dicarboxylic acid such as monomethyl maleate and monoethyl fumarate; and lower alkyl ester of ethylene-unsaturated dicarboxylic acid such as diethyl maleate. Herein, "lower alkyl" means alkyl having 1 to 4 carbon atoms, and "half ester" means "monoester".

Among the monomers each having the anionic polar group, the monomer having the sulfonate group includes, for example, styrenesulfonic acid, and 2-acrylamide-2-methylpropanesulfonic acid. Among the monomers each having the anionic polar group, the monomer having the phosphonate group includes, for example, 2-acid phosphoxypropyl methacrylate, 2-acid phosphoxyethyl methacrylate, and 3-chloro-2-acid phosphoxypropyl methacrylate.

As the polymer in which the anionic polar group is bonded to the main chain, polyacrylic acid is particularly preferable. The polyacrylic acid can be prepared by polymerizing acrylic acids. The polyacrylic acid is a polymer which contains a slightly acidic carboxyl group in the main chain, and the impacts of respective polar groups can be therefore as small as possible. Moreover, the polyacrylic acid is excellent in operability and contains in the main chain the carboxyl group which is the anionic polar group. Consequently, the dispersing ability for dispersing the particles in the aqueous medium can appear in the case where the temperature of the aqueous medium is lower than the aggregation onset temperature of the aggregate dispersant while the aggregating ability for aggregating the particles dispersed in the aqueous medium can appear in the case where the temperature of the aqueous medium is equal to or higher than the aggregation onset temperature of the aggregate dispersant It is preferable that 80 mol % or more of the anionic polar group of the polymer contained in the aggregate dispersant is neutralized by a base. That is, it is preferable that the anionic polar group of the polymer contained in the aggregate dispersant is neutralized by a base and the neutralization level of the anionic polar group by the base is within a range of from 80 mol % to 100 mol %. The neutralization of the anionic polar group of the polymer results in improving water solubility of the polymer and improving dispersing ability.

If the neutralization level of the anionic polar group is less than 80 mol %, hydrophilicity of the aggregate dispersant to the aqueous medium may be possibly lowered. Such lowering of hydrophilicity of the aggregate dispersant to the aqueous medium containing the aggregate dispersant and particles may be detrimental, for example, to sufficient granulation of the particles, because, in the case where a solid content including mainly the particles in the aqueous medium, namely, the solid content centering the resin kneaded material in the slurry accounts for 30% or more, the aggregate dispersant cannot sufficiently offer its dispersing ability in finely granulating the particles.

In the case where a neutralization level of the anionic polar group by the alkali metal base is 100 mol %, the aqueous medium's pH becomes approximately 7 to 9. If more excess base is contained in the aggregate dispersant, the whole slurry leans to being alkaline, and consequently a possibility of hydrolysis of resin is increased. In other words, if the neutralization level of anionic polar group exceeds a level of 100 mol %, a possibility of hydrolysis of polymer contained in the aggregate dispersant is increased. In the case where the particles contain resin, a possibility of hydrolysis of the resin in the particles is also increased. Since additive amount of the aggregate dispersant is an insignificant amount relative to the whole slurry, for example, about 1% by weight of the whole slurry, the problem that the neutralization level of the anionic polar group excesses 100 mol % is not a significant problem, but this problem is preferably avoided as much as possible.

As mentioned above, by employing a neutralization level of the anionic polar group within a range of from 80 mol % to 100 mol %, hydrophilicity of the aggregate dispersant to the aqueous medium can be made good and hydrolysis of polymer etc. in the aggregate dispersant can be suppressed. Accordingly it is possible to achieve an aggregate dispersant having certain dispersing and aggregating abilities.

It is further preferable that the neutralization level of the anionic polar group of the aggregate dispersant is within a range of from 90 mol % to 100 mol %. By employing a neutralization level of the anionic polar group within a range of from 90 mol % to 100 mol %, hydrophilicity of the aggregate dispersant to the aqueous medium can be made better and the dispersing ability of the aggregate dispersant in the aqueous medium can be increased. Accordingly, in the case where the solid content centering the resin kneaded material in the slurry is in a range of from 30% by weight to 40% by weight, it is possible to more certainly finely granulate the particles.

It is preferable that a base neutralizing the anionic polar group is an alkali metal base. That is, and it is preferable that the polymer contained in the aggregate dispersant is neutralized by an alkali metal base and the neutralization level of the anionic polar group by the alkali metal base is within a range of from 80 mol % to 100 mol %. The anionic polar group is made an alkali metal salt by neutralization with the alkali metal base.

In the case where the anionic polar group of the polymer is made an ammonium salt by neutralization with, for example, ammonia which vaporizes at high temperature, not an alkali metal base, the obtained neutralization level is lowered by exposure to high temperature in the granulating step, and, even if the neutralization level is 80 mol % or more, it can be easily predicted that the neutralization level is below 80 mol %. In fact, when the aggregate dispersant containing, as a polymer, the polymer in which the anionic polar group is neutralized by ammonia is used, the resin-containing particles are aggregated in the granulating step, compared to the case of using the aggregate dispersant containing the polymer in which the anionic polar group is neutralized by an alkali metal base at the same neutralization level, so that lowering of dispersing ability is considered.

That is to say, in the case where the anionic polar group of the polymer is made an ammonium salt by neutralization with ammonia, when a slurry comprising an aggregate dispersant and particles is exposed to high temperature, for example, at a step of granulating particles, the ammonia is evaporated as a gas and consequently the neutralization level is lowered and the dispersing ability may be lowered. In order to suppress the variation of neutralization level due to such evaporation of the base, it is preferable that the anionic polar group of the polymer is neutralized by a nonvolatile base.

Since the alkali metal base is a nonvolatile base, the variation of the neutralization level can be suppressed by neutralization of the anionic polar group by the alkali metal base and the dispersing ability of the aggregate dispersant can be maintained, compared to the case of neutralization of the anionic polar group by a base other than the alkali metal base. Furthermore, in the case of neutralization of the anionic polar group by an alkali metal base, the aggregate dispersant can be removed more easily by water washing or the like, compared to the case of neutralization by another base. Accordingly, as mentioned above, the variation of neutralization level can be suppressed by neutralization of the anionic polar group of the polymer by the alkali metal base and an aggregate dispersant can be attained that has a certain dispersing ability and can be easily removed.

Herein, "an alkali metal base" means a base in which an alkali metal ion is released by disassociation in water. The alkali metal base includes, for example, a chloride of alkali metal, a hydroxide of alkali metal and a carbonate of alkali metal. The alkali metal includes, for example, lithium, sodium and potassium. Among them, sodium is preferable. The chloride of alkali metal includes, for example, sodium chloride and potassium chloride. The hydroxide of alkali metal includes, for example, sodium hydroxide and potassium hydroxide. The carbonate of alkali metal includes, for example, sodium carbonate and sodium hydrogen carbonate.

Among the alkali metal bases, when the carbonate and hydroxide, especially, the hydroxide is solved in a medium, the solution may exhibit basic property, and when the solution is heated, hydrolysis of resin particles may be caused. Accordingly, an alkali metal base without change in pH of a solution is preferable, namely, non-basic salt of alkali metal is preferable, and more specifically, a chloride of an alkali metal base is preferable. In addition, among basic salts of alkali metal such as the carbonates, hydroxides and the like of the above-mentioned alkali metal, a weakly-basic salt is preferable, rather than a strongly-basic salt such as hydroxide. Accordingly, among the carbonates of alkali metal, sodium hydrogen carbonate which is weakly-basic, is preferable, rather than sodium carbonate which is strongly-basic.

The polymer in the aggregate dispersant has a weight average molecular weight more than 4000 and less than 90000, or equal to 90000. When the polymer has a weight average molecular weight not exceeding 4000, the steric structure of the polymer is relatively simple, compared to the case of a weight average molecular weight exceeding 4000, so that the polymer is good in dispersing ability, but possibly poor in dispersing stability. In the case where particles are dispersed using an aggregate dispersant of poor dispersing stability, there is a possibility that particles which were already dispersed aggregate again. That is to say, when the polymer has a weight average molecular weight not exceeding 4000, dispersing stability of the resin-containing particles in the aqueous medium cannot be possibly obtained. Accordingly, the polymer preferably has a weight average molecular weight more than 4000. In particular, when a solid content including mainly resin-containing particles in the slurry excesses 30% by weight, it is difficult to obtain dispersing stability, and therefore the polymer preferably has a weight average molecular weight more than 4000, and more preferably 5000 or more.

In the case where weight average molecular weight of the polymer exceeds 90000, the polymer has a complicated steric structure compared to the case of a weight average molecular weight equal to or less than 90000, so that the polymer is of good dispersing stability, but possibly of lower dispersing ability. In the case where a slurry containing an aggregate dispersant comprising a polymer having a weight average molecular weight more than 90000 and particles is prepared, viscosity of the slurry increases compared to the case of a polymer having a weight average molecular weight of 90000 or less, and therefore the dispersion of the resin-containing particles is made difficult. In addition, the slurry is not good for a high pressure homogenizer method in which particles in the slurry are finely granulated using a high-pressure homogenizer because plugging in a tubule such as a nozzle of the high-pressure homogenizer is easily caused. That is to say, when the weight average molecular weight of the polymer excesses 90000, viscosity of the slurry increases and the dispersion of the resin-containing particles is made difficult. In particular, when a solid content including mainly resin-containing particles in the slurry excesses 30% by weight, the dispersion of the resin-containing particles tends to be made difficult, and therefore the weight average molecular weight of the polymer is preferably 90000 or less, and more preferably 70000 or less.

As mentioned above, by employing a weight average molecular weight of the polymer more than 4000 and less than 90000, or equal to 90000, it is made possible to achieve such an aggregate dispersant preferable for a high pressure homogenizing method that is excellent in dispersing ability and dispersing stability, and can suppress increase of viscosity of a slurry.

A number average molecular weight of the polymer contained in the aggregate dispersant is preferably 1,000 to 10,000 and more preferably 1,500 to 5,000. The number average molecular weight of the polymer less than 1,000 may lead to a result that the resin-containing particles fail to exhibit the dispersion stability in the aqueous medium. The number average molecular weight of the polymer over 10,000 causes an increase in viscosity of slurry, which leads to difficulty in dispersing the resin-containing particles.

The weight average molecular weight Mw and the number average molecular weight of the polymer are determined as a polystyrene equivalent of a sample by using a gel permeation chromatography (abbreviated as GPC) apparatus. More specifically, they are measured by using the GPC apparatus into which 100 mL of a 0.25-wt %-tetrahydrofuran solution of the sample at a temperature of 40° C. is introduced as a sample solution. A molecular weight calibration curve is prepared using monodisperse polystyrene.

The aggregation onset temperature of the aggregate dispersant changes depending on the type of the polymer, and can be determined by an experiment that the temperature of the aqueous medium having the polymer is increased and visually checked is whether or not the aggregation has started. For example, in the case where the polymer is polyacrylic resin having a number average molecular weight of 1,500, the aggregation onset temperature of the aggregate dispersant is 50° C. Accordingly, the resin-containing particles are dispersed at room temperature (25° C.) and aggregated at 80° C., for example.

The aggregate dispersant of the invention as described above exhibit the aggregating ability and the dispersing ability when the aggregate dispersant is used alone, but when the aggregate dispersant is used in combination with salt of divalent or higher valent metal, the aggregating ability and dispersing ability, especially the aggregating ability, appear more prominently.

Figure 1B:
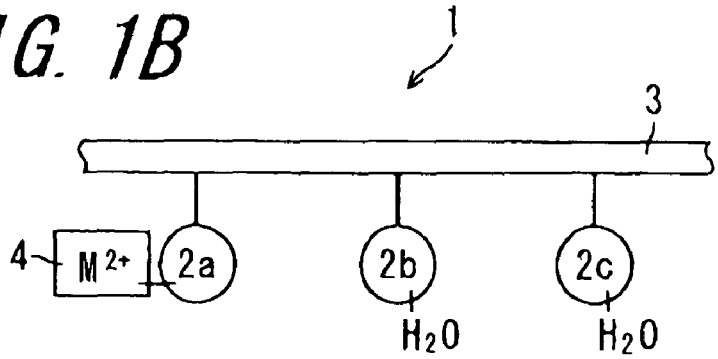
Figure 1C:
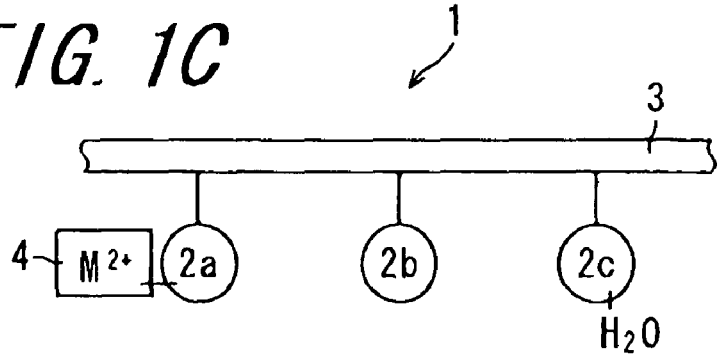

FIGS. 1A to 1C are schematic views each showing a polymer 1 contained in the aggregate dispersant of the invention, which exists in the aqueous medium. The polymer 1 contained in the aggregate dispersant of the invention has a main chain 3 to which anionic polar groups 2*a*, 2*b*, 2*c*, . . . (hereinafter referred to as "an anionic polar group 2" unless otherwise a specific anionic polar group is indicated) are bonded. FIG. 1A shows the polymer 1 in the state where the temperature of the slurry is lower than the aggregation onset temperature of the aggregate dispersant and the salt of divalent or higher valent metal has not been added to the slurry. FIG. 1B shows the polymer 1 in the state where the temperature of the slurry is lower than the aggregation onset temperature of the aggregate dispersant and the salt of divalent or higher valent metal has been added to the slurry. FIG. 1C shows the polymer 1 in the state where the temperature of the slurry is equal to or higher than the aggregation onset temperature of the aggregate dispersant and the salt of divalent or higher valent metal has been added to the slurry.

When the temperature of the slurry is lower than the aggregation onset temperature of the aggregate dispersant and the divalent or higher valent metal has not been added to the slurry, the polymer 1 has in the slurry the anionic polar group 2 hydrogen-bonded to the water molecule in the aqueous medium, as shown in FIG. 1A. This makes the polymer 1 water-soluble so that the particles in the slurry remain in a dispersed state. When the anionic polar group 2 of the polymer 1 is made an alkali metal salt by neutralization with an alkali metal base, the alkali metal salt is made the anionic polar group 2 again by disassociation in the aqueous medium, and therefore the anionic polar group 2 is hydrogen-bonded to the water molecule in the aqueous medium, and this makes the polymer water-soluble so that the particles in the slurry remain in a dispersed state.

Next, the salt of divalent or higher valent metal is added to the slurry whose temperature is lower than the aggregation onset temperature of the aggregate dispersant and in which the particles remain in the dispersed state. In this case, as shown in FIG. 1B, a metal ion 4 of the salt of divalent or higher valent metal and a part of the anionic polar group 2*a* are bonded to each other, so that the hydrogen bond between the part of the anionic polar group 2*a* and the water molecule is broken. This decreases the water solubility of the polymer 1 so that the particles in the slurry are aggregated. The above-described reaction that the metal ion 4 of the salt of divalent or higher valent metal and the anionic polar group 2 are bonded to each other is an irreversible reaction. When the anionic polar group 2 of the polymer 1 is neutralized by an alkali metal base, an alkali metal ion exists in the aqueous medium, and a bonding force between the metal ion 4 derived from the salt of divalent or higher valent metal and the anionic polar group 2 is higher than a bonding force between the alkali metal ion and the anionic polar group 2. Accordingly, addition of the salt of divalent or higher valent metal to the slurry results in the bonding between the metal ion 4 of the salt of divalent or higher valent metal and the part of the anionic polar group 2*a*.

After the addition of the salt of divalent of higher valent metal, the slurry is heated until the temperature of the slurry is equal to or higher than the aggregation onset temperature of the aggregate dispersant. The state of the polymer 1 then changes to a state as shown in FIG. 1C. That is to say, the temperature rise of the slurry leads to break of the hydrogen bond between the water molecule and the part of the anionic polar group 2*b* which is bonded to the main chain 3 of the polymer 1. As the anionic polar group 2 bonded to the main chain 3 of the polymer 1, there exist, as shown in FIG. 1C, the polar group 2*a* bonded to the metal ion 4, the polar group 2*b* bonded to neither the water molecule nor the metal ion 4, and the polar group 2*c* hydrogen-bonded to the water molecule. The polar group 2*a* bonded to the metal ion 4, and the polar group 2*b* bonded to neither the water molecule nor the metal ion 4 decrease the water solubility of the polymer 1 so that the particles are aggregated. The aggregation degree of the particles can be thus higher than that in the case where the temperature of the slurry is lower than the aggregation onset temperature of the aggregate dispersant. Further, the part of the anionic polar group 2*c* maintains the hydrogen bond to the water molecule, which exhibits the dispersing ability. Accordingly, the particles can be aggregated to an appropriate aggregation degree so that the particle aggregate is prevented from coarsening. The particle aggregate can be thus formed into favorable size and shape.

Moreover, after the particle aggregate is formed, the temperature of the slurry is brought back to a degree lower than the aggregation onset temperature of the aggregate dispersant, thus returning to the state shown in FIG. 1B so that the polar group 2*b* bonded to neither the water molecule nor the metal ion 4 is hydrogen-bonded to the water molecule. That is to say, a part of the anionic polar group 2*a* is bonded to the metal ion 4 while the rest of the anionic polar groups 2*b* and 2*c* are each hydrogen-bonded to the water molecule. The hydrogen-bonded anionic polar groups 2*b* and 2*c* do serve to disperse the particle aggregate, but dispersing ability thereof is not enough to disassemble the aggregation of the particle aggregate, with the result that the particle aggregate is maintained at a favorable dispersion level.

The size and shape of the aggregate of the particles can be controlled by adding to the slurry the salt of divalent or higher valent metal together with the aggregate dispersant of the invention. The control on the size and shape of the aggregate of the particles is carried out, for example, by adjusting an additive amount of the salt of divalent or higher valent metal, of which detail will be described later. The addition of the salt of divalent or higher valent metal also allows the particles to be aggregated in a short time, thus enhancing the productivity.

Even in the case of adding to the slurry the salt of divalent or higher valent metal together with the aggregate dispersant of the invention, the polymer 1 contained in the aggregate dispersant can be removed from the particle aggregate through aqueous cleaning upon isolating the particle aggregated from the aqueous medium since the polymer 1 is water-soluble owing to the anionic polar groups 2*b* and 2*c* which are each hydrogen-bonded to the water molecule. The salt of divalent or higher valent metal is also removed together with the polymer 1 from the particle aggregate through the aqueous cleaning since the anionic polar group 2*a* contained in the polymer 1 is bonded to the metal ion 4. The particle aggregate can be thus isolated from the aqueous medium easily without operations such as changing pH of the slurry.

What is used together with the aggregate dispersant of the invention is not salt of monovalent metal, but the salt of divalent or higher valent metal as described above. For example, in the case where the anionic polar group of the polymer is a monovalent polar group, the use of the salt of divalent or higher valent metal leads to binding between the metal ion 4 of the salt of divalent or higher valent metal and two or more monovalent anionic polar groups 2*a*, resulting in cross-linking of the polymer 1. This causes a further decrease in the water solubility of the polymer 1 so that the resin-containing particles can be aggregated more efficiently. This is why the salt of divalent or higher valent metal is used instead of the salt of monovalent metal.

The aggregate dispersant of the invention can be favorably used when the aggregated particles are manufactured by aggregating nano-order-sized fine particles in the aqueous medium. To be more specific, in the method of manufacturing the aggregate of the resin-containing particles of the invention, the use of the aggregate dispersant of the invention is particularly favorable for evenly dispersing the resin-containing particles in the aqueous medium and thereafter aggregating the dispersed resin-containing particles to thus manufacture the particle aggregate.

[Method of Manufacturing Aggregate of Resin-containing Particles]

A method of manufacturing the aggregate of the resin-containing particles of the invention is characterized in that the resin-containing particles containing the binder resin and the colorant are aggregated with the aid of the aggregate dispersant of the invention and the salt of divalent or higher valent metal. The aggregate of the resin-containing particles manufactured by the production method of the invention can be used, for example, as a toner which is intended for use in an electrophotographic image forming apparatus such as a copier, a laser beam printer, or a facsimile machine. It is also possible to use the aggregate as filler such as paint and a coating agent.

In the method of manufacturing the particle aggregate according to the present embodiment, the aggregate dispersant of the invention as described above is used. The method of manufacturing the particle aggregate according to the present embodiment includes (A) a melt-kneading step, (B) a dispersing step, (C) finely-granulating step, (D) an aggregating step, and (E) a cleaning step.

Figure 2:
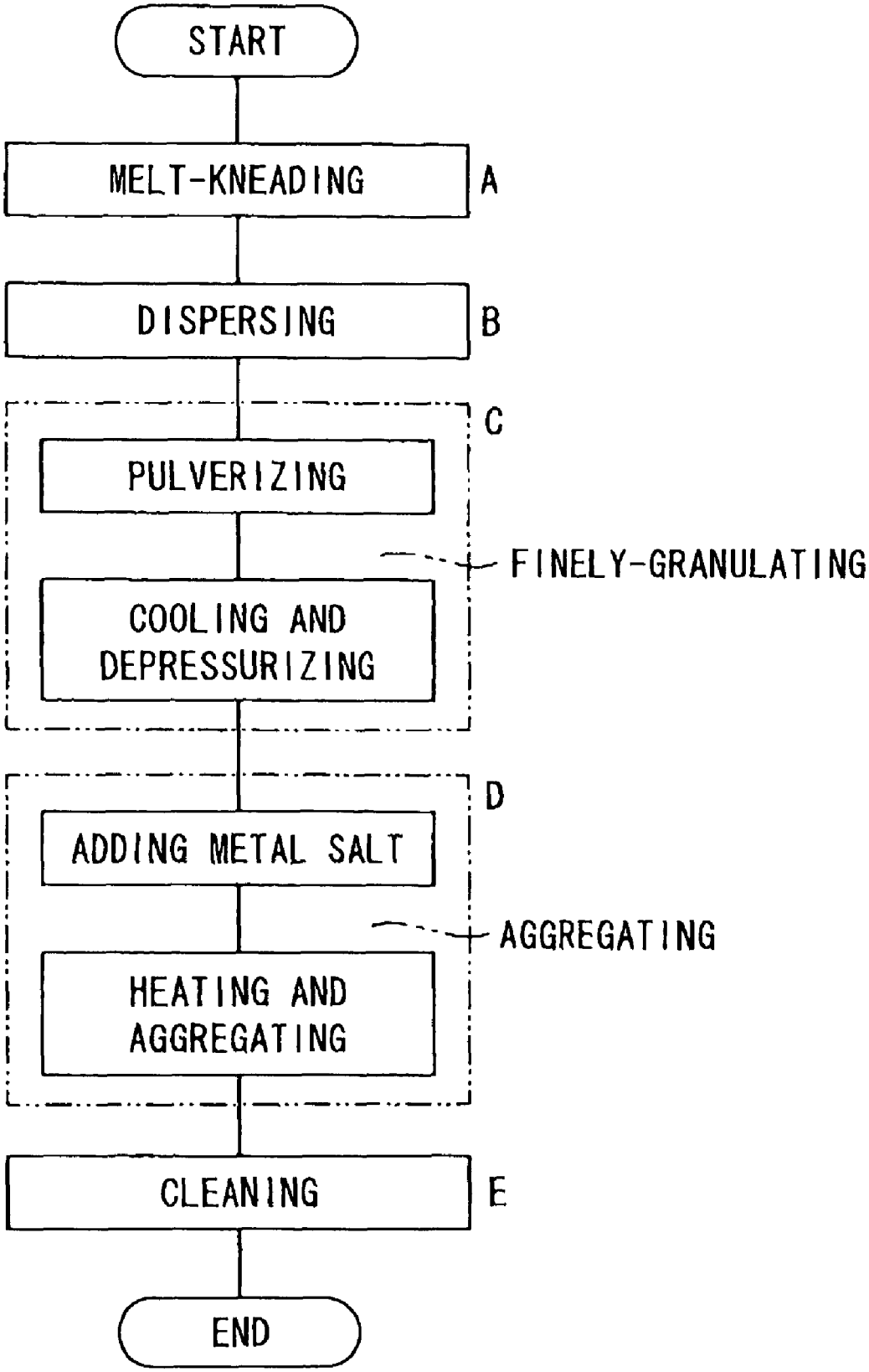
FIG. 2 is a flowchart for explaining one example of a method of manufacturing an aggregate of resin-containing particles of the invention.

FIG. 2 is a flowchart for explaining one example of the method of manufacturing the aggregate of the resin-containing particles of the invention. In the present embodiment, a toner for use in an electrophotographic image forming apparatus is manufactured in accordance with the production method represented by the flowchart which is shown in FIG. 2.

(A) Melt-kneading Step

At the melt-kneading step, a toner raw material containing the binder resin and the colorant is melt-kneaded to thereby obtain a kneaded material which is then cooled and solidified, followed by pulverization and according to need, classification, thus manufacturing the irregular resin particles which contain the binder resin and the colorant.

Examples of the binder resin include acrylic resin, polyester, polyurethane, and epoxy resin. The acrylic resin is easily dispersed at the later-described dispersing step, and a use thereof is therefore particularly favorable. As the acrylic resin, the selection of ingredients is not particularly limited, and acidic group-containing acrylic resin can be preferably used. The acidic group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer.

As the acrylic resin monomer, heretofore known ingredients can be used, including acrylic acid which may have a substituent, methacrylic acid which may have a substituent, acrylic acid ester which may have a substituent, and methacrylic acid ester which may have a substituent. Specific examples of the acrylic resin monomer include: monomers of acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; monomers of methacrylic esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; and hydroxyl group-containing monomers of (meth)acrylic esters such as hydroxyethyl acrylate and hydroxypropyl methacrylate. The acrylic resin monomers may be used each alone, or two or more of the acrylic resin monomers may be used in combination.

Moreover, as the vinylic monomer, heretofore known ingredients can be used, including styrene, α-methylstyrene, vinyl bromide, vinyl chloride, vinyl acetate, acrylonitrile, and methacrylonitrile. These vinylic monomers may be used each alone, or two or more of the vinylic monomers may be used in combination. The polymerization is effected by use of a commonly-used radical initiator in accordance with a solution polymerization method, a suspension polymerization method, an emulsification polymerization method, or the like method.

Polyester is excellent in transparency and capable of providing the obtained toner particles with favorable powder flowability, low-temperature fixing property, and secondary color reproducibility, thus being suitably used, in particular, as binder resin for a color toner. As polyester, heretofore known ingredients can be used, including a polycondensation of polybasic acid and polyhydric alcohol. As polybasic acid, those known as monomers for polyester can be used including, for example: aromatic carboxylic acids such as terephthalic acid, isophthalic acid, phthalic acid anhydride, trimellitic acid anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. These polybasic acids may be used each alone, or two or more of the polybasic acids may be used in combination.

As polyhydric alcohol, those known as monomers for polyester can also be used including, for example: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. These polyhydric alcohols may be used each alone, or two or more of the polyhydric alcohols may be used in combination.

Polycondensation reaction of polybasic acid and polyhydric alcohol can be effected in a common manner. For example, the polycondensation reaction is effected by contacting polybasic acid and polyhydric alcohol each other in the presence or absence of an organic solvent and under the presence of a polycondensation catalyst, and terminated at the instant when the acid value and the softening temperature of the resultant polyester stand at predetermined values. Polyester is thus obtained. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester. Further, polyester may be grafted with acrylic resin.

As polyurethane, heretofore known ingredients can be used, and acidic group- or basic group-containing polyurethane can be preferably used, for example. The acidic group- or basic group-containing polyurethane can be produced in accordance with a heretofore known method, for example, by addition polymerization of acidic group- or basic group-containing diol, polyol, and polyisocyanate. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone, or two or more of the components may be used in combination.

As the epoxy resin, the selection of ingredients is not particularly limited, and acidic group- or basic group-containing epoxy resin can be preferably used. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to epoxy resin which serves as a base.

Among these binder resins, taking account of facilitation of finely-granulating operation at the later-described finely-granulating step, a kneading property with the colorant and the release agent, and equalization of shape and size of toner particles, it is preferable to use binder resin having a softening temperature of 150° C. or lower, and particularly preferable to use binder resin having a softening temperature of 60° C. to 150° C. Among such binder resins, preferred is binder resin of which weight-average molecular weight falls in a range from 5,000 to 500,000. The binder resins may be used each alone, or two or more of the binder resins may be used in combination. Furthermore, it is possible to use a plurality of resins of the same type, which are different in any one or all of molecular weight, monomer composition, and other factors.

As the colorant, it is possible to use an organic dye, an organic pigment, an inorganic dye, and an inorganic pigments, which are customarily used in the electrophotographic field. Black colorant includes, for example, carbon black, copper oxide, manganese dioxide, aniline black, activated carbon, non-magnetic ferrite, magnetic ferrite, and magnetite.

Yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C. I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorant includes, for example, manganese purple, fast violet B, and methyl violet lake.

Blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue-15, C.I. pigment blue 15:2, C.I. pigment blue 15:3, C.I. pigment blue 16, and C.I. pigment blue 60.

Green colorant includes, for example, chromium green, chromium oxide, pigment green B, malachite green lake, final yellow green G, and C.I. pigment green 7. White colorant includes, for example, those compounds such as zinc white, titanium oxide, antimony white, and zinc sulfide. The colorants may be used each alone, or two or more of the colorants of different colors may be used in combination. Further, two or more of the colorants with the same color may be used in combination. A usage of the colorant is not limited to a particular amount, and a preferable usage thereof is 3 parts by weight to 10 parts by weight based on 100 parts by weight of the binder resin.

The colorant is preferably used in form of master batch. The master batch of the colorant can be manufactured, for example, by kneading synthetic resin and colorant. The usable synthetic resin is binder resin of the same sort as the binder resin used as the toner raw material, or resin which is well-compatible with the binder resin used as the toner raw material. A use ratio of the colorant to the synthetic resin is not limited to a particular ratio, and a preferable use ratio of the colorant is 30 parts to 100 parts by weight based on 100 parts by weight of the synthetic resin. Before used, the master batch has been granulated so as to have a particle diameter of around 2 mm to 3 mm, for example. In the case of using the colorant in form of the master batch, the dispersibility of the colorant into the binder resin is enhanced so that the colorant can be finely dispersed in an even manner into the resin-containing particles which are obtained at the later-described dispersing step.

Further, in the present embodiment, the toner raw material contains a release agent. When the release agent is contained in the toner raw material, a high-temperature offset phenomenon can be prevented from arising. The high-temperature offset phenomenon means a phenomenon which arises in the thermal roller fixing method that the fixing operation is conducted by heating a toner through a heating roller for fixing and which indicates removal of a part of the molten toner that is excessively molten during the fixing operation and thereby fused on the heating roller for fixing.

Examples of the release agent include wax. The wax includes, for example: natural wax such as carnauba wax and rice wax; synthetic wax such as polypropylene wax, polyethylene wax, and Fischer-Tropsch wax; coal wax such as montan wax; petroleum wax such as paraffin wax; alcohol wax; and ester wax. One of the above release agents may be used each alone, or two or more of the above release agents may be used in combination. Among the above release agents, preferable is carnauba wax which is excellent in affinity with the binder resin.

A melting temperature of the release agent is preferably 80° C. or less. The melting temperature of the release agent over 80° C. will cause the release agent to fail to be molten on an attempt to fix the toner onto a recording medium under heating through a heating roller, possibly leading to the low-temperature offset phenomenon that the toner is not fixed onto the recording medium. It is thus possible to prevent the low-temperature offset phenomenon from arising by using the release agent of which melting temperature is 80° C. or less. Further, the melting temperature of the release agent equal to 80° C. or less will result in a decrease of softening temperature of the toner as a whole, thus enhancing the low-temperature fixing property. This makes it possible to reduce the power consumption of the fixing section which is used for fixing through the heating section such as a heater.

Moreover, it is further preferred that the melting temperature of the release agent be 60° C. to 80° C. The melting temperature of the release agent less than 60° C. will cause the release agent to be molten at the melt-kneading step, thus making a larger difference between viscosity of the release agent and viscosity of the binder resin, which may cause difficulty in dispersing the release agent into the binder resin. In addition, the toner particles may be aggregated with each other inside the image forming apparatus, possibly leading to a decrease in the preservation stability. Accordingly, the use of the release agent having a melting temperature of 60° C. to 80° C. makes it possible to obtain a toner which is excellent in the preservation stability with the release agent evenly dispersed in the binder resin and which can prevent the low-temperature offset phenomenon from arising.

A content of the release agent preferably is 3 parts by weight or more and 15 parts by weight or less based on 100 parts by weight of the binder resin. The content of the release agent less then 3 parts by weight will not sufficiently bring the releasing property out, possibly causing the high-temperature offset phenomenon to appear. The content of the release agent over 15 parts by weight may cause the toner filming that the release agent forms a thin coating on a photoreceptor surface. By setting the ratio of the release agent at 3 parts by weight to 15 parts by weight based on 100 parts by weight of the binder resin, it is thus possible to prevent the toner filming and the high-temperature offset from arising. Moreover, it is further preferred that the content of the release agent be 5 parts by weight to 15 parts by weight based on 100 parts by weight of the binder resin. Such a content of the release agent will certainly prevent the toner filming and the high-temperature offset phenomenon from arising.

Further, to the toner raw material, an additive such as a charge control agent may be added. The addition of the charge control agent enables to stably control the charge amount in accordance with the change of the environment. The usable charge control agent includes a positive charge control agent and a negative charge control agent which are customarily used in the electrophotographic field. The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. One of the above charge control agents may be used each alone and according to need, two or more of the above agents may be used in combination. A usage of the charge control agent is not limited to a particular level and may be selected as appropriate from a wide range. A preferable usage of the charge control agent falls in a range from 0.5 part by weight to 3 parts by weight based on 100 parts by weight of the binder resin.

At the melt-kneading step, the toner raw material is firstly dry-mixed by a mixer. The toner raw material contains, as stated above, the binder resin, the colorant, and the release agent, and when necessary, the additive such as the charge control agent. The toner raw material is then heated to a temperature which is equal to or higher than a softening temperature of the binder resin and less than a decomposition temperature of the binder resin, thereafter being melt-kneaded. The binder resin is thereby softened so that the colorant, the release agent, and the like ingredient are dispersed into the binder resin. Although the toner raw material containing the binder resin, the colorant, and the release agent does not have to be dry-mixed before melt-kneaded, the dry-mixing operation is preferably performed before the melt-kneading operation because the melt-kneading operation followed by the dry-mixing operation will enhance the dispersibility into the binder resin, of the toner raw material such as the colorant and the release agent other than the binder resin so that properties such as the toner charging performance of a resultant toner can be homogenized.

The mixers usable for the dry-mixing operation include, for example, Henschel type mixing apparatuses such as a HENSCHEL MIXER (trade name) manufactured by Mitsui Mining Co., a SUPER MIXER (trade name) manufactured by Kawata Co., and a MECHANO MILL (trade name) manufactured by Okada Seiko Co., Ltd., ONG MILL (trade name) manufactured by Hosokawa Micron Co., HYBRIDIZATION SYSTEM (trade name) manufactured by Nara Machinery Co., Ltd., and COSMO SYSTEM (trade name) manufactured by Kawasaki Heavy Industry Co., Ltd.

For melt-kneading, it is possible to use kneading machines such as a kneader, a twin-screw extruder, a two roll mill, a three roll mill, and laboplast mill. Specific examples of such kneading machines include single or twin screw extruders such as TEM-100B (trade name) manufactured by Toshiba Kikai Co., Ltd., PCM-65/87 and PCM-30, both of which are trade names and manufactured by Ikegai Co., and open roll-type kneading machines such as KNEADICS (trade name) manufactured by Mitsui Mining Co. The melt-kneading operation may be conducted by using a plurality of the kneading machines.

At the melt-kneading step, the binder resin, the colorant, and the release agent, and the optionally-added additive are melt-kneaded, with the result that the colorant, the release agent, and the additive are evenly dispersed in the binder resin. At the melt-kneading step, the colorant and the release agent are preferably dispersed in an even manner so that particle diameters of the colorant and the release agent are sufficiently smaller than a particle diameter (0.4 μm to 2.0 μm) of the to-be-manufactured resin-containing particle. In order to evenly disperse the colorant and the additive into the binder resin, it is preferable to set the kneading temperature at the melt-kneading step to a favorable temperature. Taking an open-roll type kneading machine as an example, the favorable kneading temperature will be described hereinbelow.

Figure 3:
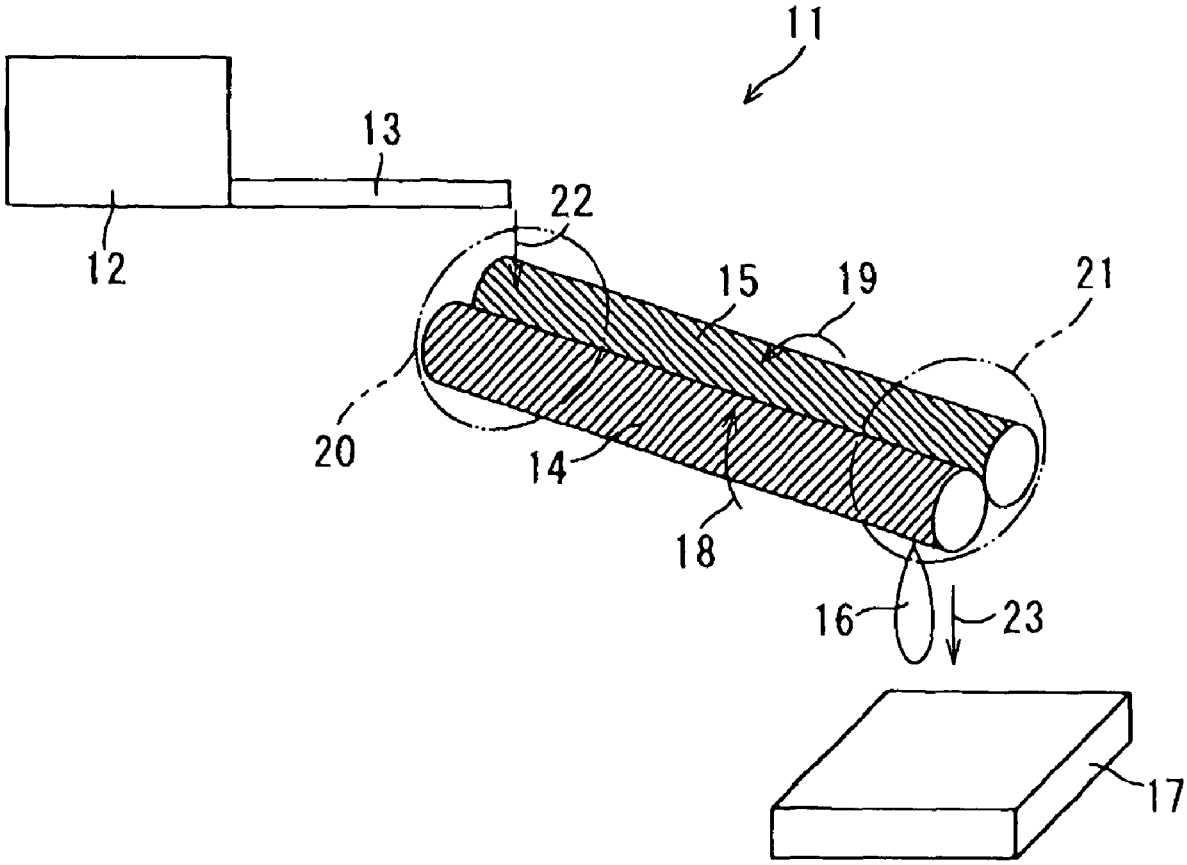
FIG. 3 is a perspective view schematically showing a configuration of chief part in an open-roll type kneading machine.

FIG. 3 is a perspective view schematically showing a configuration of chief part in an open-roll type kneading machine 11. The open-roll type kneading machine 11 is composed of a hopper portion 12, a raw material supply portion 13, a heating roll 14, a cooling roll 15, a melt-kneaded material discharge portion 16, and a collection box 17. The hopper portion 12 receives a raw material admixture quantitatively and continuously with the aid of a table feeder, etc. The raw material supply portion 13 incorporates a spiral screw. The heating roll 14 and the cooling roll 15 melt and knead the raw material admixture. The melt-kneaded material discharge portion 16 is provided under the heating roll 14 and has a circular strip cutter which scraps off from a surface of the heating roll 14 the melt-kneaded material of the raw material admixture attached to the surface of the heating roll 14. The collection box 17 receives the scraped-off material.

The heating roll 14 and the cooling roll 15 have, respectively, a heating roll shaft (not shown) and a cooling roll shaft (not shown) which are shaft center members for supporting the respective rolls. The heating roll shaft and the cooling roll shaft are rotatably supported on roll supports (not shown), respectively. The heating roll 14 and the cooling roll 15 are driven by a driving mechanism (not shown) to rotate around their own axes respectively in an arrow 18 direction and in an arrow 19 direction, which are opposite to each other. Spiral grooves are formed in the surfaces of the heating roll 14 and the cooling roll 15, but a roll having no grooves may also be used.

The heating roll shaft and the cooling roll shaft are formed into hollow shapes although not shown. A heating medium such as oil can circulate in the heating roll shaft while a cooling medium such as water can circulate in the cooling roll shaft. A temperature of the heating medium is controlled by a supply control section (not shown) in accordance with a result detected by a temperature sensor (not shown) for detecting a temperature of the heating roll 14 on a raw material admixture supply side 20, and the heating medium is then supplied to the heating roll shaft. By so doing, it is possible to adjust a heating temperature of the heating roll 14 on the raw material admixture supply side 20 and a melt-kneaded material discharge side 21. As in the case of the heating roll 14, a cooling temperature of the cooling roll 15 can be adjusted. The adjustment of the heating temperature and the cooling temperature as just described allows stabilization of a kneading temperature. In the case where the cooling roll 15 does not perform a sufficient cooling operation, a temperature of the melt-kneaded material increases to decrease viscosity thereof, causing a difficulty in applying sufficient shearing force to the melt-kneaded material. As a result, the colorant and the like ingredient are insufficiently dispersed in the binder resin, therefore leading to a decrease of productivity.

Note that the kneading temperature at the melt-kneading step indicates a temperature of the raw material admixture which has been melt-kneaded, that is, a temperature of the melt-kneaded material. The temperature of the melt-kneaded material in the open-roll type kneading machine 11 becomes substantially equal to the temperature of the heating roll 14 on the raw material admixture supply side 20.

In each of the roll supports (not shown) for supporting the heating roll 14 and the cooling roll 15 are housed, for example, a driving mechanism, a hydraulic cylinder, and a device for supplying the heating medium and/or cooling medium to a rotary shaft, respectively of the heating roll 14 and the cooling roll 15.

The raw material admixture supplied in an arrow 22 direction from the raw material supply portion 13 is delivered from the raw material admixture supply side 20 to the melt-kneaded material discharge side 21 by rotations of the heating roll 14 and the cooling roll 15. When delivered, the raw material admixture is compressed by the rolls 14 and 15 and heated to be fused by the influence of the surface temperature of the heating roll 14 and furthermore attached to the surface of the heating roll 14. In such a state, the compression force and shearing force are drastically applied to the raw material admixture between the roll 14 and the roll 15 so that the raw material admixture is homogenized and dispersed, thus forming a homogeneous melt-kneaded material. The raw material admixture and the melt-kneaded material are smoothly delivered because the raw admixture material is continuously delivered so that an amount of the raw material admixture staying between the roll 14 and the roll 15 below the raw material supply portion 13 is always larger than an amount of the raw material admixture staying in the other parts of the rolls 14 and 15. In other words, a bank amount (an amount of the staying melt-kneaded material) formed between the roll 14 and the roll 15 is the largest around the area below the raw material supply portion 13, therefore generating a difference in pressure in an axial direction, which acts as impetus for the delivering operation. Furthermore, a screw effect caused by the spiral grooves formed in the surface portions of the rolls 14 and 15 is also a part of the impetus. By so doing, the melt-kneaded material in which the colorant etc. is evenly dispersed in the binder resin, is formed as attached onto the surface of the heating roll 14 by the repetitive and continuous compression and shearing between the roll 14 and the roll 15.

The melt-kneaded material discharge portion 16 discharges the melt-kneaded material of the supplied raw material admixture in an arrow 23 direction, that is, toward the collection box 17. The collection box 17 receives the melt-kneaded material scraped off from the heating roll 14 and the cooling roll 15.

In the open-roll type kneading machine 11, the raw material admixture is firstly supplied from the raw material supply portion 13 to the area between the heating roll 14 and the cooling roll 15. The supplied raw material admixture is delivered from the raw material admixture supply side 20 to the melt-kneaded material discharge side 21 by the rotations of the heating roll 14 and the cooling roll 15. During the delivering operation, the raw material admixture experiences compression, shearing, melting, homogenization, and dispersion, thus resulting in a homogenized melt-kneaded material. The melt-kneaded material is scraped off from the surface of the heating roll 14 and discharged from the melt-kneaded material discharge portion 16 into the collection box 17.

At the melt-kneading step effected by use of the above-described open-roll type kneading machine 11, the colorant and the release agent can be finely dispersed into the binder resin by appropriately setting the temperatures of the rolls 14 and 15 on the raw material admixture supply side 20 and on the melt-kneaded material discharge side 21. The temperature for the melt-kneading operation is preferably set so that the temperature of the heating roller 14 on the raw material admixture supply side 20 is equal to or higher than the softening temperature of the binder resin and lower than the decomposition temperature of the binder resin. Further, to be specific, in the case where the polyester resin (having a glass transition temperature of 56° C. and a softening temperature of 110° C.) is used as the binder resin, for example, it is preferred that the temperature of the heating roll 14 on the raw material admixture supply side 20 be set at 140° C. to 170° C. and that the temperature of the cooling roll 15 on the raw material admixture supply side 20 be set at 40° C. to 70° C. By setting the kneading temperature to a favorable degree as mentioned above, the viscosity of the melt-kneaded material can be adjusted to a favorable level and the sufficient shearing force can be applied to the melt-kneaded material, with the result that the colorant and the additives can be evenly dispersed into the binder resin in a state where the particle diameters of the colorant and the additives are sufficiently smaller than the particle diameter (0.4 μm to 2.0 μm) of the to-be-manufactured resin-containing particle. The colorant dispersed in the resin-containing particles preferably has colorant particles, each of which dispersion diameter is 100 nm (0.01 μm) to 500 nm (0.5 μm).

The melt-kneaded material containing the binder resin, the colorant, and the release agent obtained at the melt-kneading step is cooled and solidified, followed by coarse pulverization to thus manufacture the irregular resin particles. In the embodiment, the solidified material of the melt-kneaded material has been coarsely pulverized in advance before the dispersing step, thus forming the irregular resin particle which has a favorable size. A degree how far the melt-kneaded material is coarsely pulverized depends on a type of the high-pressure homogenizer, and it is preferred that the melt-kneaded material be coarsely pulverized until the volume average particle diameter of the irregular resin particles becomes around 100 μm. An excessively large volume average particle diameter over 100 μm will increase a sedimentation rate of the irregular resin particles in the slurry, thus causing difficulty in maintaining the uniform dispersion state of the irregular resin particles. In addition, the treatment does not need to dare have the increased number of steps for attaining such an excessively small volume average particle diameter of the irregular resin particles as a size less than 100 μm. No particular limitation is imposed on a method of coarsely pulverizing the solidified material of the melt-kneaded material. The solidified material of the melt-kneaded material is coarsely pulverized by using, for example, a crusher, a hammer mill, an atomizer, a feather mill, and a jet mill. Further, it is also possible to coarsely pulverize the irregular resin particles by letting through the pressure-resistant nozzle the slurry obtained at the following dispersing step.

(B) Dispersing Step

At the dispersing step, the irregular resin particles which are obtained by coarsely pulverizing the solidified material of the melt-kneaded material obtained at the melt-kneading step and which contain the binder resin and the colorant are mixed with the aqueous medium and the above-described aggregate dispersant of the invention. For example, the irregular resin particles are dispersed into the aqueous medium in the presence of the above-described aggregate dispersant in the thermoneutral environment, thus obtaining the slurry of the irregular resin particles. As the aqueous medium, preferably used is pure water which can be obtained by a heretofore known method including, for example, an activated carbon method, an ion exchange method, a distillation method, and a reverse osmosis method.

At the dispersing step, a preferable use ratio of the irregular resin particles is 3 parts by weight to 50 parts by weight based on 100 parts by weight of the aqueous medium. Moreover, a further preferable use ratio of the irregular resin particles is 5 parts by weight to 25 parts by weight based on 100 parts by weight of the aqueous medium. Since the irregular resin particles will be finely granulated into the resin-containing particles at a finely-granulating step as described later, the use ratio of the irregular resin particles is equal to that of the resin-containing particles.

The ratio of the irregular resin particles less than 3 parts by weight will lead to low particle concentration which may make the aggregation difficult at the later-described aggregating step. Further, when the use ratio of the irregular resin particles exceeds 50 parts by weight, a mutual distance is too short among the resin-containing particles which are formed by finely granulating the irregular resin particles at the later-described finely-granulating step, which may cause difficulty in attaining the aggregation to a favorable degree. Further, in this case, the viscosity of the slurry is so high that when the slurry is made to pass through the nozzle provided in the later-described high-pressure homogenizer, the nozzle may be clogged. Accordingly, by setting the ratio of the irregular resin particles to fall within the above range, the particles can be aggregated to a favorable degree at the later-described aggregating step. It is thus possible to obtain a favorably-sized particle aggregate.

A preferable use ratio of the aggregate dispersant of the invention is 5 parts by weight to 20 parts by weight based on 100 parts by weight of the irregular resin particles. A further preferable use ratio of the aggregate dispersant of the invention is 8 parts by weight to 15 parts by weight based on 100 parts by weight of the irregular resin particles. The use ratio of the aggregate dispersant less than 5 parts by weight will lead to an excessively small amount of the aggregate dispersant relative to the irregular resin particles, thus decreasing the dispersibility of the irregular resin particles. Further, the use ratio of the aggregate dispersant over 20 parts by weight will lead to an excessively large amount of the aggregate dispersant relative to the irregular resin particles, thus resulting in the excessively high dispersibility of the irregular resin particles, which may cause difficulty in aggregating the resin-containing particles at the later-described aggregating step.

At the dispersing step, for example, the aqueous medium, the aggregate dispersant, and the irregular resin particles are put and stirred in a tank 35 of a later-described high-pressure homogenizer 31 shown in FIG. 4. A length of time for the dispersing step is not particularly limited, and preferably 5 minutes to 30 minutes. By setting the length of time for the dispersing step within the above range, the irregular resin particles can be sufficiently dispersed in the aqueous medium.

(C) Finely-granulating Step

The slurry of the irregular resin particles obtained at the dispersing step is then treated at the finely-granulating step. At the finely-granulating step, the irregular resin particles contained in the slurry are finely granulated, thereby obtaining the resin-containing particles. To be specific, the irregular resin particles containing the binder resin and the colorant are furthermore finely-granulated so that the volume average particle diameter of the irregular resin particles is 0.4 μm to 2.0 μm. The irregular resin particles which have been finely granulated until the volume average particle diameter thereof becomes 0.4 μm to 2.0 μm, will be hereinafter referred to as "resin-containing particles". In the embodiment, the finely-granulating operation of the irregular resin particles is conducted in accordance with the high-pressure homogenizer method. The finely-granulating step in accordance with the high-pressure homogenizer method includes a pulverizing stage and a cooling and depressurizing stage.

The high-pressure homogenizer method indicates a method in which a high-pressure homogenizer is used for micronizing or granulating the resin-containing particles containing synthetic resin, the release agent, and the like ingredients. The high-pressure homogenizer indicates an apparatus for pulverizing the particles under pressure. The usable high-pressure homogenizer includes those available on the market or those described in patent publications. Examples of the commercially available high-pressure homogenizer include chamber-type high-pressure homogenizers such as MICOFLUIDIZER (trade name) manufactured by Microfluidics Corporation, NANOMIZER (trade name) manufactured by Nanomizer Inc., and ULTIMIZER (trade name) manufactured by Sugino Machine Ltd., HIGH-PRESSURE HOMOGENIZER (trade name) manufactured by Rannie Inc., HIGH-PRESSURE HOMOGENIZER (trade name) manufactured by Sanmaru Machinery Co., Ltd., and HIGH-PRESSURE HOMOGENIZER (trade name) manufactured by Izumi Food Machinery Co., Ltd. Further, examples of the high-pressure homogenizer described in patent publications include a high-pressure homogenizer disclosed in WO03/059497. Among the above homogenizers, preferred is the high-pressure homogenizer disclosed in WO03/059497.

Figure 4:
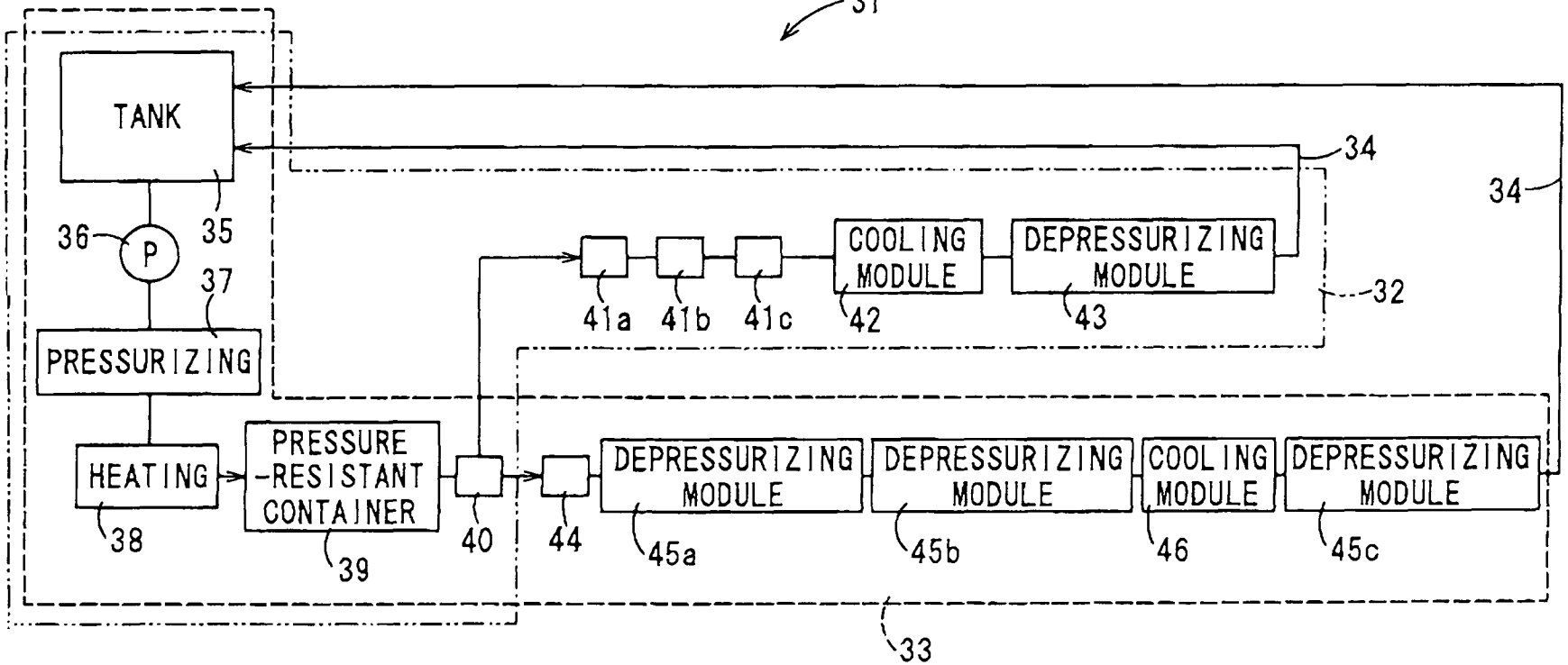
FIG. 4 is a systematic diagram schematically showing a high-pressure homogenizer which is favorably used in a method of manufacturing a toner of the invention.

FIG. 4 is a systematic diagram schematically showing the high-pressure homogenizer 31 which is favorably used in the method of manufacturing the toner of the invention. The high-pressure homogenizer 31 includes a finely-granulating unit 32, an aggregating/heating unit 33, and a piping 34.

The finely-granulating unit 32 includes a tank 35, a feeding pump 36, a pressurizing unit 37, a heating unit 38, a pressure-resistant container 39, a switching portion 40, a first pressure-resistant nozzle 41*a*, a second pressure-resistant nozzle 41*b*, a third pressure-resistant nozzle 41*c*, a cooling module 42, and a depressurizing module 43. The aggregating/heating unit 33 includes the tank 35, the feeding pump 36, the pressurizing unit 37, the heating unit 38, the pressure-resistant container 39, the switching portion 40, a pressure-resistant nozzle 44, a first depressurizing module 45*a*, a second depressurizing module 45*b*, a third depressurizing module 45*c*, and a cooling module 46.

The tank 35, the feeding pump 36, the pressurizing unit 37, the heating unit 38, the pressure-resistant container 39, and the switching portion 40 are shared in the finely-granulating unit 32 and the aggregating/heating unit 33. The piping 34 mechanically connects with each other the finely-granulating unit 32, respective component members contained in the finely-granulating unit 32, the aggregating/heating unit 33, and respective component members contained in the aggregating/heating unit 33. A direction of an arrow put on the piping 34 indicates a direction in which the slurry flows. Although the first to third pressure-resistant nozzles 41*a*, 41*b*, and 41*c* are connected with each other by way of the piping 34 in FIG. 4, the nozzles may be directly connected with each other without the piping 34 therebetween. At the finely-granulating step, the finely-granulating unit 32 of the high-pressure homogenizer 31 is used.

The finely-granulating unit 32 is composed of the tank 35, the feeding pump 36, the pressurizing unit 37, the heating unit 38, the pressure-resistant container 39, the switching portion 40, the first pressure-resistant nozzle 41*a*, the second pressure-resistant nozzle 41*b*, the third pressure-resistant nozzle 41*c*, the cooling module 42, and the depressurizing module 43 which are disposed in sequence according to the order that the slurry flows.

At the finely-granulating step, the tank 35 included in the finely-granulating unit 32 contains the slurry of the resin-containing particles obtained at the dispersing step. Inside the tank 35 is provided a stirring device for stirring the slurry.

The pressurizing unit 37 is composed of, for example, a plunger pump having a plunger and a pump part which is driven for charging and discharging through the plunger. The heating unit 38 is composed of, for example, a heating furnace having a heating section such as a coil for heating the piping 34 through which the slurry flows. Conditions for pressurizing and heating will be described in detail hereinbelow.

The pressure-resistant container 39 is an airtight container which is resistant to pressure. It is preferred that the pressure-resistant container 39 have a stirring device for stirring the slurry contained in the pressure-resistant container 39. The switching portion 40 switches where to feed the slurry between the first pressure-resistant nozzle 41*a* of the finely-granulating unit 32 and the pressure-resistant nozzle 44 of the aggregating/heating unit 33 depending on which step is performed between the finely-granulating step and the aggregating step. At the finely-granulating step, the switching portion 40 conducts a switching operation such that the slurry is fed to the first pressure-resistant nozzle 41*a*.

As the first to third pressure-resistant nozzles 41*a*, 41*b*, and 41*c* (which will be simply referred to as "a pressure-resistant nozzle 41" unless otherwise a particular pressure-resistant nozzle is specified), it is possible to preferably use, for example, a multiple nozzle which has a plurality of liquid flowing passages. The liquid flowing passages of the multiple nozzle may be arranged in form of a concentric circle of which center is a shaft of the multiple nozzle. Alternatively, the liquid flowing passages may be arranged in substantially parallel with a longitudinal direction of the multiple nozzle. One example of the multiple nozzle being used in the manufacturing method of the invention is a nozzle having one or a plurality of liquid flowing passages, preferably having around one or two liquid passages, each of which is around 0.05 mm to 0.35 mm in inlet diameter and outlet diameter and 0.5 cm to 5 cm in length. Further, an example of the pressure-resistant nozzle is shown in FIG. 5.

Figure 5:
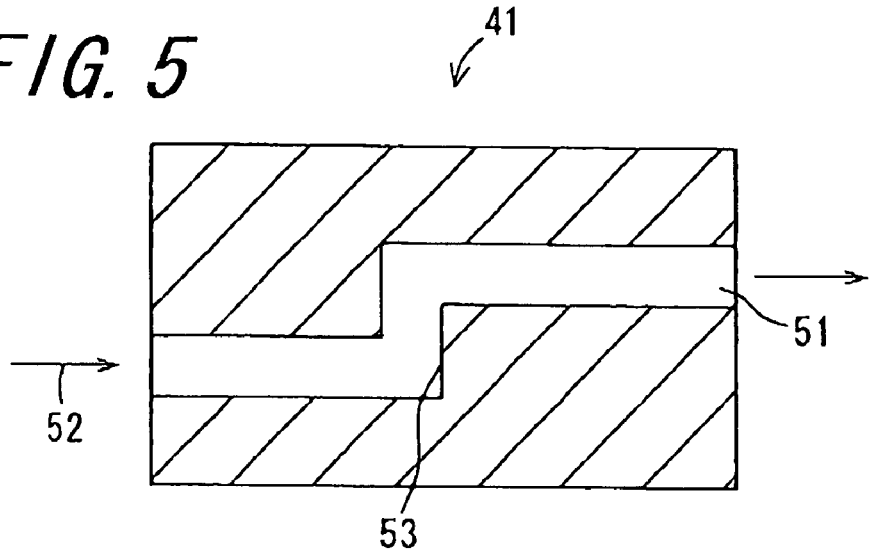
FIG. 5 is a sectional view schematically showing a configuration of a pressure-resistant nozzle.

FIG. 5 is a sectional view schematically showing a configuration of the pressure-resistant nozzle 41. The pressure-resistant nozzle 41 has a liquid flowing passage 51 therein. The liquid flowing passage 51 is bent to thus form a hook shape and therefore provided with at least one collision wall 53 against which the slurry of particles flows in an arrow 52 direction into the liquid flowing passage 51. The slurry containing the particles collides against the collision wall 53 at a substantially right angle, whereby the particles are pulverized into smaller particles which are then discharged from the pressure-resistant nozzle 41. The use of the pressure-resistant nozzle 41 having the liquid flowing passage 51 as described above allows the particles to be stably made smaller in diameter and moreover makes it possible to prevent the diameter-reduced particles from coming into contact with each other so as not to be aggregated and coarsened. Although an inlet and an outlet of the pressure-resistant nozzle 41 are formed into the same size in the present embodiment, no limitation is imposed on the configuration which may be therefore formed so that the outlet is smaller than the inlet in diameter. In addition, although three pressure-resistant nozzles 41 are coupled on each other in the present embodiment, the configuration is not limited to the above and there may be one pressure-resistant nozzle 41 or two or more pressure-resistant, nozzles 41 which are coupled on each other.

The cooling module 42 is a commonly-used liquid cooling machine which has a pressure-resistant structure. The usable cooling module 42 is, for example, a cooling machine for water-cooling the piping 34 through which the slurry flows. Preferably used as the cooling module 42 is a cooling machine which has a large cooling area, such as a corrugated tube-type cooling machine. Further, the cooling machine is preferably configured so that a cooling gradient is smaller (or cooling ability is lowered) from an inlet to an outlet of the cooling machine. This is because such a configuration contributes to more effective achievements of reduction in diameter of the resin-containing particles. Further, by so doing, the resin-containing particles obtained by finely granulating the irregular resin particles can be prevented from being reattached to each other, thus causing no coarsening of the resin-containing particles to thereby enhance the yield of the diameter-reduced resin-containing particles. The slurry of the diameter-reduced resin-containing particles discharged from the pressure-resistant nozzle 41 is introduced into the cooling module 42 and cooled down therein which has a cooling gradient, followed by being discharged from the cooling module 42. The slurry is then introduced into the depressurizing module 43. The number of the cooling module 42 being disposed may be one or plural.

As the depressurizing module 43, it is preferable to use a multistage depressurization apparatus disclosed in WO03/059497. The multistage depressurization apparatus is composed of an inlet passage for leading pressurized slurry containing resin-containing particles into the multistage depressurization apparatus, an outlet passage in communication with the inlet passage, for discharging the depressurized slurry containing resin-containing particles to outside of the multistage depressurization apparatus, and a multistage depressurization section disposed between the inlet passage and the outlet passage, on which two or more depressurizing members are coupled via coupling members. The depressurizing member used for the multistage depressurization section in the multistage depressurization apparatus includes a pipe-shaped member, for example. The coupling member includes a ring-shaped seal, for example. The multistage depressurization section is configured by coupling a plurality of the pipe-shaped members having different inner diameters on each other by the ring-shaped seals. For example, two to four pipe-shaped members having the same inner diameters are coupled on each other from the inlet passage toward the outlet passage. On these pipe-shaped members is then coupled one pipe-shaped member having an inner diameter which is about twice as large as the inner diameter of these pipe-shaped members. Furthermore, on those pipe-shaped members are coupled about one to three pipe-shaped members each having an inner diameter which is about 5% to 20% smaller than the inner diameter of the one pipe-shaped member. By so doing, the slurry containing resin-containing particles, which flows inside the pipe-shaped members is gradually depressurized to a final pressure level at which no bubbling is caused, preferably to a level of atmosphere pressure. A heat exchanging section using a cooling medium or heating medium may be disposed around the multistage depressurization section so that cooling or heating is conducted in accordance with a level of pressure imparted to the slurry containing resin-containing particles. There may be one multistage depressurization apparatus or a plurality of the multistage depressurization apparatuses which may be disposed in series or in parallel. Further, an example of the depressurizing member of the depressurizing module 43 is shown in FIG. 6.

Figure 6:
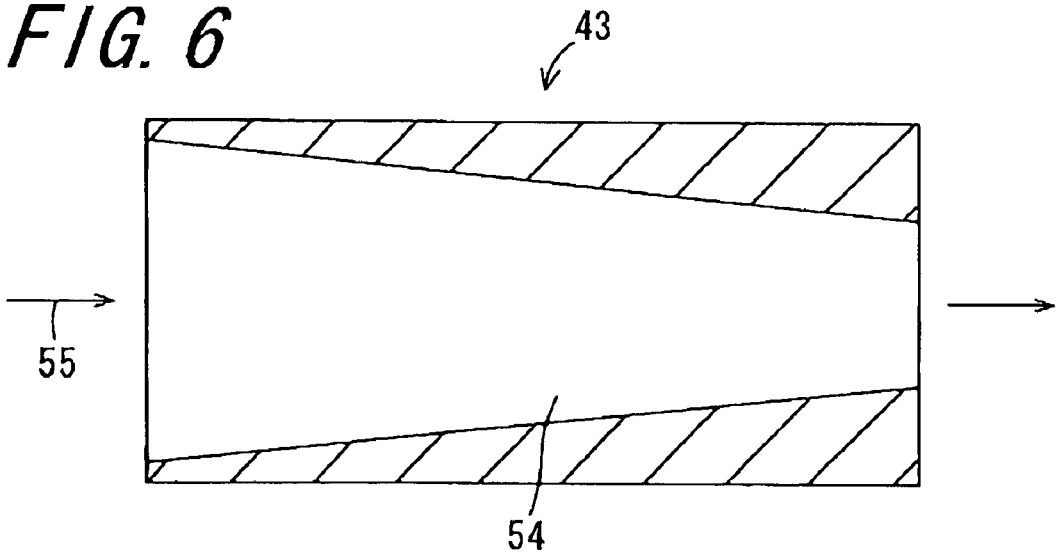
FIG. 6 is a sectional view schematically showing a configuration of a depressurizing member of a depressurizing module.

FIG. 6 is a sectional view schematically showing a configuration of the depressurizing member of the depressurizing module 43. The depressurizing member of the depressurization module 43 has a liquid flowing passage 54 therein. The liquid flowing passage 54 is formed such that an outlet diameter thereof is shorter than an inlet diameter thereof. Furthermore, in the embodiment, a section of the liquid flowing passage 54 seen in a direction perpendicular to an arrow 55 direction in which the slurry flows, becomes gradually smaller from the inlet toward the outlet, and centers of the respective sections perpendicular to the arrow 55 direction exist on one axial line parallel to the direction in which the slurry flows. In the depressurizing module 43, the slurry flowing in the arrow 55 direction into the liquid flowing passage 54 is depressurized while flowing inside the liquid flowing passage 54.

At the finely-granulating step, the finely-granulating unit 32 of the high-pressure homogenizer 31 as described above is used for the pulverizing stage and the cooling and depressurizing stage. At the finely-granulating step, the irregular resin particles in a state of being dispersed in the aqueous medium at the dispersing step is finely granulated until the irregular resin particles are formed into the resin-containing particles each having a desirable particle size, for example, such that a volume average particle diameter thereof is 0.4 μm or more and 2.0 μm or less.

At the pulverizing stage, the slurry of the resin-containing particles obtained at the dispersing step is made to pass through the pressure-resistant nozzle 41 under heat and pressure. By so doing, there is obtained a slurry which contains the resin-containing particles obtained by pulverizing the irregular resin particles and has been heated and pressurized.

The irregular resin particles are dispersed in the aqueous medium at the dispersing step and, as in a state of slurry, contained in the tank 35. The slurry which comprises irregular resin particles and is contained in the tank 35 (hereinafter, referred to as "the slurry of the irregular resin particles") is delivered by the feeding pump 36, thereafter being pressurized by the pressurizing unit 37 and heated by the heating unit 38.

Conditions imposed on the pressurizing unit 37 and the heating unit 38 for pressurizing and heating the slurry of the irregular resin particles are not limited to particular conditions. The slurry is preferably pressurized at 50 MPa to 250 MPa and heated to be 50° C. or more, and more preferably pressurized at 50 MPa to 250 MPa and heated to be equal to or higher than a softening temperature of the irregular resin particles, and furthermore preferably pressurized at 50 MPa to 250 MPa and heated to be a temperature between the softening temperature of the irregular resin particles and a temperature which is 25° C.-higher than the softening temperature of the irregular resin particles. The softening temperature of the irregular resin particles represents a half of the softening temperature measured by a flow tester. More specifically, the softening temperature of the irregular resin particles is determined as a temperature in a case where, using a flow-characteristics evaluation apparatus (trade name: FLOW TESTER CFT-100C, manufactured by Shimadzu corporation), 1 g of a sample is heated at a rate of temperature rise of 6° C. per minute while a load of 10 kgf/cm$^2$ ($9.8\times10^5$ Pa) is applied to the sample so that the sample is extruded from a die (nozzle), and a half of the sample is flowed out from the die. The die having a bore diameter of 1 mm and a length 1 mm is used.

When pressure applied to the slurry of the irregular resin particles by the pressurizing unit 37 is below 50 MPa, the shearing energy becomes small, which may lead to insufficient reduction of the particle diameter. In addition, the irregular resin particles may be possibly aggregated. When pressure applied to the slurry of the irregular resin particles by the pressurizing unit 37 is above 250 MPa, a degree of risk in an actual production line will be excessively increased, thus being unrealistic. The slurry of the irregular resin particles is introduced at a pressure and temperature falling in the above-stated ranges, from the inlet of the pressure-resistant nozzle into the pressure-resistant nozzle. In the present embodiment, the slurry of the irregular resin particles is pressurized at 210 MPa and heated to 120° C.

As described above, when the slurry of the irregular resin particles is heated by the heating unit 38, there is a case where the slurry of the irregular resin particles is heated by the heating unit 38 up to the aggregation onset temperature of the aggregate dispersant or more. However, since the slurry has been pressurized to 50 MPa or more by the pressurizing unit 37, even if the temperature of the slurry of the irregular resin particles becomes the aggregation onset temperature of the aggregate dispersant or more, the dispersing ability of the aggregate dispersant does not decreases. Accordingly, a state of the slurry which has been pressurized by the pressurizing unit 37 and heated by the heating unit 38 is a state where the irregular resin particles are dispersed in the aqueous medium.

In the case where a glass transition temperature (Tg) exists in the aggregate dispersant, that is, in the case where a glass transition temperature (Tg) exists in the polymer contained in the aggregate dispersant, the slurry of the irregular resin particles should not be heated by the heating unit 38 to a temperature very different from the glass transition temperature (Tg) of the polymer contained in the aggregate dispersant. There is no problem with respect to instantaneous exposure of the aggregate dispersant to high temperature and pressure. However, as mentioned later, since the cooling and depressurizing stage is carried out in a stepwise fashion, i.e., gradually, when the maximum reached temperature of the slurry of the irregular resin particles is too high, a state where the temperature of the slurry of the irregular resin particles excesses the glass transition temperature (Tg) of the polymer is kept for a long time until the slurry is finally made a state of ordinary temperature and ordinary pressure. When such a state where the temperature of the slurry of the irregular resin particles excesses the glass transition temperature (Tg) of the polymer is kept for a long time, the aggregation in the piping occurs by decomposition or deactivation of the polymer in the aggregate dispersant, and preparation of the slurry becomes difficult.

As a guide, a difference between the maximum reached temperature of the slurry and the glass transition temperature (Tg) of the polymer in the aggregate dispersant is less than 100° C. When the difference between the maximum reached temperature of the slurry and the glass transition temperature (Tg) of the polymer in the aggregate dispersant is less than 100° C., even if the solid content in the slurry is 30% by weight, a plugging of the piping due to this problem will be avoidable. In fact, a heated temperature of the slurry of the irregular resin particles by the heating unit 38 should be set based on the softening temperature of the irregular resin particles as mentioned above. Accordingly, it is preferable that the aggregate dispersant is selected in consideration of the softening temperature of the irregular resin particles. More specifically, it is preferable that the aggregate dispersant is selected having such a glass transition temperature (Tg) that a difference between the maximum reached temperature of the slurry of the irregular resin particles and the glass transition temperature of the polymer in the aggregate dispersant is less than 100° C. when the heated temperature of the slurry of the irregular resin particles by the heating unit 38 falls within the above-mentioned range, that is, a range of from the softening temperature of the irregular resin particles to the temperature which is 25° C.-higher than the softening temperature of the irregular resin particles.

It is preferable that a temperature of the slurry of the irregular resin particles in the finely granulating step is less than a reference temperature (Tg ° C.+100° C.) which is an addition of a glass transition temperature Tg ° C. and 100° C. If a temperature of the slurry in the finely granulating step is equal to or more than the reference temperature, finely granulating irregular resin particles may be possibly carried out under the condition that the aggregate dispersant lost its dispersing ability and irregular resin particles which were dispersed at a dispersing step are possibly aggregated again with the result that resin containing particles of a desired particle diameter cannot be obtained. Furthermore, in the case where finely granulating is carried out using a high pressure homogenizer, there is a possibility of occurrence of plugging up a piping with the aggregated irregular resin particles. As mentioned above, by controlling the temperature of the slurry to be less than the reference temperature, it is made possible to maintain the dispersing ability of the aggregate dispersant and prevent the irregular resin particles from being aggregated again at the finely granulating step. Accordingly resin-containing particles having a desired particle diameter can be surely obtained. In addition, the slurry can be prevented from plugging up a piping in finely granulating irregular resin particles with a high-pressure homogenizer.

The slurry which has been pressurized by the pressurizing unit 37 and heated by the heating unit 38 is fed to the pressure-resistant container 39. The slurry fed to the pressure-resistant container 39 is promptly introduced into the pressure-resistant nozzle 41 and then discharged therefrom.

The slurry introduced into the pressure-resistant nozzle 41 passes through the pressure resistant nozzle 41 where the irregular resin particles contained in the slurry are pulverized to be reduced in diameter. Although there are three pressure-resistant nozzles 41 in the present embodiment, the number of the pressure-resistant nozzle 41 may be one or plural besides three. After completion of the pulverizing stage that the irregular resin particles flow through the pressure-resistant nozzle 41, the process proceeds to the cooling and depressurizing stage.

At the cooling and depressurizing stage, the slurry obtained at the pulverizing stage is cooled and gradually depressurized to a level at which no bubbling is caused. In the present embodiment, the slurry is firstly cooled down by the cooling module 42 and then gradually depressurized by the depressurizing module 43 to a level at which no bubbling is caused. It is preferred that the depressurization be gradually carried out in a stepwise manner. No limitation is imposed on selection of the cooling temperature and the pressure. In the present embodiment, the slurry is cooled down by the cooling module 42 to a temperature equal to 40° C. or lower, and then depressurized by the depressurizing module 43 to the atmosphere pressure. As described above, the slurry is cooled down by the cooling module 42 immediately after the pulverizing stage, and subsequently depressurized by the depressurizing module 43 to a level at which no generation of bubbles (bubbling) is found, thereby preventing the bubbling form arising in the slurry and moreover preventing the coarsening which is caused by reaggregation of the resin-containing particles. The slurry which has been cooled by the cooling module 42 and depressurized by the depressurizing module 43 is discharged to outside of the depressurizing module 43 and brought through the piping 34 to the tank 35 into which the slurry is to return.

The finely-granulating step including the pulverizing stage and the cooling and depressurizing stage as described above may be repeatedly carried out plural times according to need. The finely-granulating step is carried out until the volume average particle diameter of the irregular resin particles in the slurry becomes 0.4 μm to 2.0 μm. The volume average particle diameter of the resin-containing particles less than 0.4 μm indicates that the resin-containing particles are too small, which may cause the colorant and the release agent to be unevenly dispersed in the binder resin of the resin-containing particles. The volume average particle diameter of the resin-containing particles over 2.0 μm may cause difficulty in forming a small toner of which diameter is 4 μm to 8 μm, for example. In order to form the diameter-reduced toner as just described, it is further preferred that a volume average particle diameter of the resin-containing particles be 0.4 μm to 1.0 μm.

The resin-containing particles are thus finely-granulated until the volume average particle diameter of the resin-containing particles becomes 0.4 μm to 2.0 μm, and the slurry containing the resin-containing particles of which volume average particle diameter is 0.4 μm to 2.0 μm is brought to the tank 35. The process then proceeds to the aggregating step.

(D) Aggregating Step

At the aggregating step, the salt of divalent or higher valent metal is added to the slurry of the resin-containing particles so that the resin-containing particles are aggregated. The aggregating step in the present embodiment includes a metal salt-adding stage and a heating and aggregating stage. At the aggregating step, the aggregating/heating unit 33 of the high-pressure homogenizer 31 is used.

The aggregating/heating unit 33 is composed of the tank 35, the feeding pump 36, the pressurizing unit 37, the heating unit 38, the pressure-resistant container 39, the switching portion 40, the pressure-resistant nozzle 44, the first depressurizing module 45*a*, the second depressurizing module 45*b*, the cooling module 46, and the third depressurizing module 45*c* which are disposed in sequence according to the order that the slurry flows. The tank 35, the feeding pump 36, the pressurizing unit 37, the heating unit 38, the pressure-resistant container 39, and the switching portion 40 are shared with the finely-granulating unit 32 and therefore descriptions of these components will be omitted. Further, in the description of the present step, the first to third depressurizing modules 45*a*, 45*b*, and 45*c* will be referred to as "a depressurizing module 45" unless otherwise a particular depressurizing module is specified.

For the pressure-resistant nozzle 44 of the aggregating/heating unit 33, it is possible to employ, for example, a nozzle of the same sort as the pressure-resistant nozzle 41 shown in FIG. 5. The pressure-resistant nozzle 44 of the aggregating/heating unit 33 pulverizes the particles in the slurry which has been aggregated with the aid of the later-described aggregating agent, to thereby prevent the particles from being excessively aggregated. As the cooling module 46 of the aggregating/heating unit 33, it is possible to employ a module of the same sort as the cooling module 42 of the finely-granulating unit 32. Examples of the depressurizing module 45 of the aggregating/heating unit 33 include a depressurizing module which has a depressurizing member shown in FIGS. 7A to 7C.

Figure 7A:
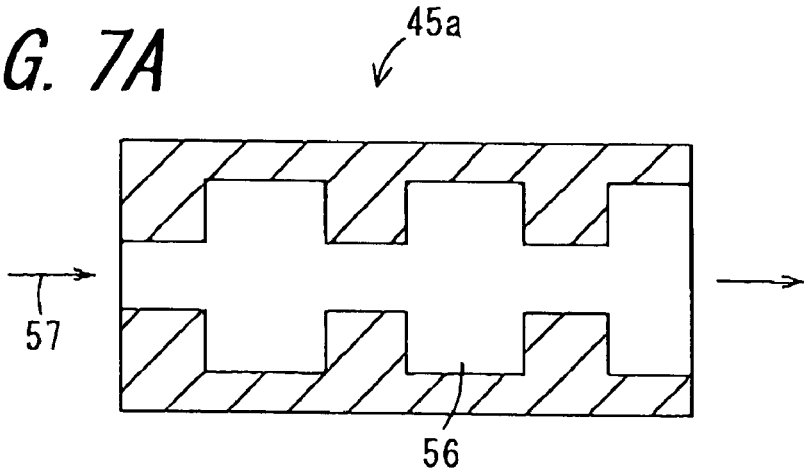
FIGS. 7A to 7C are schematic sectional views each showing a configuration of a depressurizing member of a depressurizing module of an aggregating/heating unit.
Figure 7B:
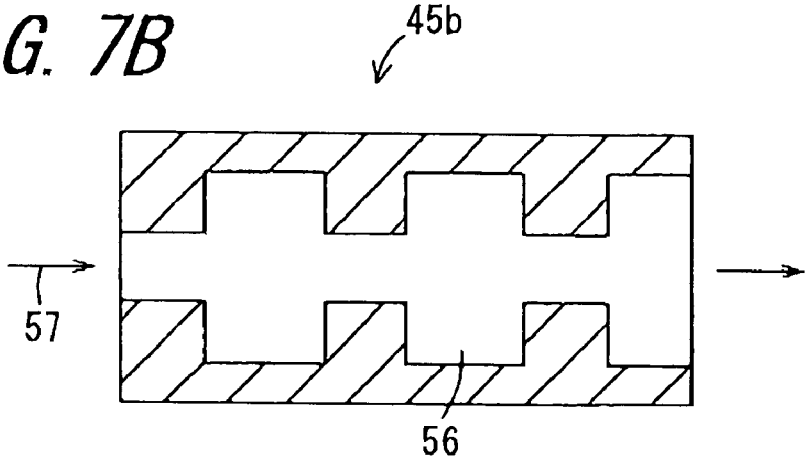
Figure 7C:
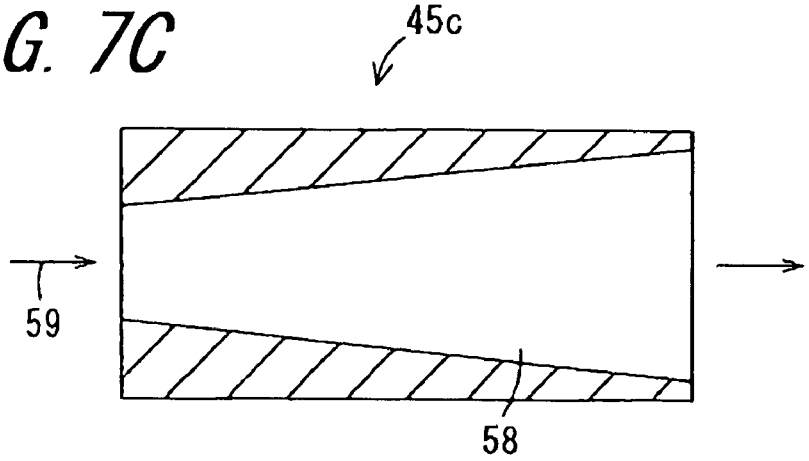

FIGS. 7A to 7C are schematic sectional views each showing a configuration of the depressurizing member of the depressurizing module 45 of the aggregating/heating unit 33. FIG. 7A is a sectional view schematically showing the depressurizing member of the first depressurizing module 45*a* contained in the aggregating/heating unit 33. FIG. 7B is a sectional view schematically showing the depressurizing member of the second depressurizing module 45*b* contained in the aggregating/heating unit 33. FIG. 7C is a sectional view schematically showing the depressurizing member of the third depressurizing module 45*c* contained in the aggregating/heating unit 33.

The first to third depressurizing modules 45 have the same configuration as that of the above-described depressurizing module 45 except the difference in an internal shape of the depressurizing member. Detailed description of the first to third depressurizing modules 45 will be therefore omitted. The depressurizing member of the first depressurizing module 45*a* has a liquid flowing passage 56 therein as shown in FIG. 7A. The liquid flowing passage 56 is composed of alternately formed two types of parts, one of which has a small section and the other of which has a large section when seen in a direction perpendicular to an arrow 57 direction that the slurry flows. In the embodiment, the liquid flowing passage 56 is formed such that an outlet diameter thereof is larger than an inlet diameter thereof, and the centers of the sections perpendicular to the arrow 57 direction in which the slurry flows, exist on one axial line parallel to the direction in which the slurry flows. In the first depressurizing module 45*a*, the slurry flowing in the arrow 57 direction into the liquid flowing passage 56 is depressurized while flowing inside the liquid flowing passage 56. The depressurizing member of the second depressurizing module 45*b* has the same configuration as that of the first depressurizing module 45*a* as shown in FIG. 7B, and descriptions of the depressurizing member of the second depressurizing module 45*b* will be therefore omitted. The depressurizing member of the third depressurizing module 45*c* has a liquid flowing passage 58 therein as shown in FIG. 7C. The liquid flowing passage 58 is formed such that an outlet diameter thereof is larger than an inlet diameter thereof. Furthermore, in the embodiment, a section of the liquid flowing passage 58 seen in a direction perpendicular to an arrow 59 direction in which the slurry flows, becomes gradually larger from the inlet toward the outlet, and centers of the respective sections perpendicular to the arrow 59 direction exist on one axial line parallel to the direction in which the slurry flows. In the third depressurizing module 45*c*, the slurry flowing in the arrow 59 direction into the liquid flowing passage 58 is depressurized while flowing inside the liquid flowing passage 58.

At the aggregating step, the above-described aggregating/heating unit 33 of the high-pressure homogenizer 31 is used to aggregate the resin-containing particles having the volume average particle diameter of 0.4 μm to 2.0 μm obtained at the finely-granulating step.

The slurry which is obtained at the finely-granulating step and contains the resin-containing particles having the volume average particle diameter of 0.4 μm to 2.0 μm, is contained in the tank 35 in the thermoneutral environment. The polymer obtained at the completion of the finely-granulating step exhibits water solubility, as described above, by the hydrogen-bonding in the slurry between the anionic polar group and the water molecule contained in the aqueous medium as shown in FIG. 1A, with the result that the resin-containing particles in the slurry are maintained in the dispersed state.

At the metal salt-adding stage, the salt of divalent or higher valent metal is added to the slurry of the resin-containing particles inside the tank 35, thus obtaining a slurry which contains an aggregate of the resin-containing particles.

As the salt of divalent or higher valent metal, preferable is water-soluble metal salt including, for example, nitrate salt, acetate salt, hydrosulfate, and chloride of barium, magnesium, calcium, copper, nickel, cobalt, and aluminum. The salt of divalent or higher valent metals may be used each alone, or two or more of the salt of divalent or higher valent metals may be used in combination. A preferable salt of divalent or higher valent metal is magnesium chloride which is chloride of magnesium.

By adding the salt of divalent or higher valent metal as cited above to the slurry, a metal ion of the salt of divalent or higher valent metal and a part of the anionic polar group are bonded to each other so that the hydrogen bond between the part of the anionic polar group and the water molecule is broken, as shown in FIG. 1B. This decreases the water solubility of the polymer so that the particles in the slurry are aggregated.

An additive amount of the salt of divalent or higher valent metal is preferably such that a total valence of the anionic polar group contained in the polymer is larger than a total valence of the metal ion of the salt of divalent or higher valent metal. It is further preferred that the total valence of the metal ion of the salt of divalent or higher valent metal be 20% to 60% of the total valence of the anionic polar group contained in the polymer. When the salt of divalent or higher valent metal is added in such an amount, the anionic polar group not bonded to the metal ion may exit, and the resin-containing particles can be aggregated while appropriate dispersibility of the resin-containing particles is maintained. In addition, when the salt of divalent or higher valent metal is added in the amount as stated above, the polymer can be easily removed from the particle aggregate at the cleaning step following the aggregating step.

A ratio of the salt of divalent or higher valent metal added to the slurry of the resin-containing particles is preferably 65 parts by weight to 300 parts by weight and more preferably 100 parts by weight to 260 parts by weight based on 100 parts by weight of the aggregate dispersant. The salt of divalent or higher valent metal less than 65 parts by weight will lead to excessively small force for aggregating the resin-containing particles in the slurry, which may cause difficulty in aggregating the resin-containing particles. The salt of divalent or higher valent metal over 300 parts by weight will lead to excessively large force for aggregating the resin-containing particles in the slurry, which may cause aggregate particles to be coarsened. Accordingly, by setting the use ratio of the salt of divalent or higher valent metal at 65 parts by weight or more and 300 parts by weight or less based on 100 parts by weight of the aggregate dispersant, it is possible to prevent the resin-containing particles from being insufficiently aggregated and from being excessively aggregated, thus allowing the aggregation degree of the particle aggregate to be adjusted to a favorable level.

As described above, a reaction that the metal ion of the salt of divalent or higher valent metal and the anionic polar group are bonded to each other, is an irreversible reaction. Accordingly, in order to control the size and shape of the aggregate of the resin-containing particles, the metal ion and the anionic polar group need to react with each other as mildly as possible. The mild reaction between the metal ion and the anionic polar group however makes a length of processing time long, thus decreasing the productivity. Consequently, the salt of divalent of higher valent metal is added desirably so that the length of processing time can be shortened while the metal ion and the anionic polar group can be prevented from rapidly reacting with each other.

In order to shorten the length of processing time while preventing the metal ion and the anionic polar group from rapidly reacting with each other, the salt of divalent or higher valent metal is preferably used in form of a solution in which the aqueous medium acts as a solvent. This enhances the operability and thus allows the addition of an appropriate amount of the salt of divalent or higher valent metal to the slurry and therefore, an appropriate amount of the metal ion can be bonded to the anionic polar group so that the resin-containing particles can be prevented from being insufficiently aggregated and excessively aggregated.

The solution of the salt of divalent or higher valent metal preferably has concentration of the salt of divalent or higher valent metal of 5% by weight to 30% by weight. The concentration less than 5% by weight will increase an amount of the solution being used and prolongs the length of processing time for adding the favorable amount of the salt of divalent or higher valent metal, which may thus cause a decrease in the productivity. When the concentration exceeds 30% by weight, the aggregation degree must be controlled with a small amount of the solution, thus leading to deterioration of the operability such as excessive aggregation of the resin-containing particles. This may cause the particle aggregate to be coarsened. Accordingly, by setting the concentration of solution within the above range, it is possible to enhance the operability and prevent the resin-containing particles from being insufficiently aggregated and excessively aggregated. By so doing, the aggregation degree of the particle aggregate can be adjusted to be favorable so that a favorably-sized particle aggregate can be obtained.

Further, the solution of the salt of divalent or higher valent metal having the concentration within the above range preferably drips into the slurry of the resin-containing particles at a drip rate of 0.05 mL/min to 0.20 mL/min. Furthermore, the drip rate is more preferably 0.08 mL/min to 0.15 mL/min. The drip rate less than 0.05 mL/min will prolong the length of processing time for adding the favorable amount of the salt of divalent or higher valent metal, thus decreasing the productivity. The drip rate over 0.20 mL/min will cause the salt of divalent or higher valent metal and the anionic polar group to rapidly react with each other, thus aggregating the resin-containing particles rapidly and generating variation in the aggregation degree among the particle aggregates.

The temperature of the slurry at the metal salt-adding stage is preferably 10° C. to 50° C. When the salt of divalent or higher valent metal is added to the slurry having a high temperature, for example, a temperature over 50° C., the reaction proceeds drastically that the salt of divalent or higher valent metal and the anionic polar group are bonded to each other, which may result in variation in the slurry in how far the reaction proceeds that the salt of divalent or higher valent metal and the anionic polar group are bonded to each other. Further, the temperature of the slurry less than 10° C. may decrease the flowability of the slurry and thus cause the metal salt to be unevenly mixed in the slurry. It is therefore preferred that the temperature of the slurry at the metal salt-adding stage be set at 10° C. to 50° C. to make the reaction proceed evenly in the slurry between the salt of divalent or higher valent metal and the anionic polar group. Moreover, the slurry does not have to be stirred but preferably stirred when the salt of divalent or higher valent metal is added to the slurry.

As described above, when the aggregate dispersant of the invention is used, the dispersing ability and the aggregating ability can be exerted by only the aggregate dispersant and it is therefore no longer necessary to use an aggregating agent and dispersant individually while the size and shape of the aggregate of the resin-containing particles can be controlled by adding to the slurry the salt of divalent or higher valent metal together with the aggregate dispersant of the invention. By adjusting the additive amount of the salt of divalent or higher valent metal and the like element, the resin-containing particles can be aggregated in a short time, thus enhancing the productivity.

After the addition of the salt of divalent or higher valent metal to the slurry containing the resin-containing particles at the metal salt-adding stage, the process proceeds to the heating and aggregating stage for heating the slurry to furthermore aggregate the resin-containing particles.

At the heating and aggregating stage, the slurry is heated to which the salt of divalent or higher valent metal has been added and which contains the resin-containing particles. The heating operation further enhances the aggregation degree of the resin-containing particles. Moreover, the resin-containing particles are softened through the heating operation so that the resin-containing particles are fused to each other.

The tank 35 contains the slurry to which the salt of divalent or higher valent metal has been added. The slurry contained in the tank 35 is delivered by the feeding pump 36, thereafter being pressurized by the pressurizing unit 37 and heated by the heating unit 38. The heating temperature at the time is not limited to a particular degree, and it is a temperature equal to or higher than the aggregation onset temperature of the aggregate dispersant and preferably is around the glass transition temperature of the binder resin. In the present embodiment, the slurry of aggregate of the resin-containing particles is pressurized by the pressurizing unit 37 and heated by the heating unit 38. In the embodiment, the slurry of aggregate of the resin-containing particles is pressurized at 40 MPa and heated to 70° C.

The slurry which has been pressurized by the pressurizing unit 37 and heated by the heating unit 38 is fed to the pressure-resistant container 39. Inside the pressure-resistant container 39, the temperature of the slurry is retained around the glass transition temperature of the binder resin. Such a retention time (which may be hereinafter referred to as "a heating time") is not particularly limited and is preferably 5 minutes or longer. The heating time shorter than 5 minutes may cause the resin-containing particles to fail to be softened and thus fail to increase the mutual adhesion of the resin-containing particles. Further, the particle diameter of the to-be-obtained toner particle can be adjusted by appropriately adjusting the heating temperature and the heating time. The heating time is preferably 30 minutes or shorter. When the heating time exceeds 30 minutes, the pulverization and fusion of the resin-containing particles are repeated and an increase in frequency thereof may cause the colorant and release agent dispersed in the binder resin at the melt-kneading step to be released from the binder resin, possibly decreasing the dispersibility of the colorant and release agent into the binder resin.

The slurry whose temperature is maintained around the glass transition temperature of the binder resin inside the pressure-resistant container 39 is preferably stirred by the stirring device. In the embodiment, the slurry is stirred by the stirring device at 2,000 rpm (2,000 rotations per minute). The heated slurry is stirred and thus maintained, with the result that the size and shape of the aggregate of the resin-containing particles can be made substantially uniform. Further, it is possible to prevent the aggregates of the resin-containing particles from being unnecessarily fused to each other and thus prevent the aggregate of the resin-containing particles from coarsening.

When the slurry is pressurized by the pressurizing unit 37 and the heated by the heating unit 38, the polymer contained in the aggregate dispersant in the slurry is in the above-described state as shown in FIG. 1C. That is to say, the polar group bonded to the metal ion and the polar group bonded to neither the water molecule nor the metal ion decrease the water solubility of the polymer so that the resin-containing particles are aggregated. Further, a part of the anionic polar group maintains the hydrogen bond to the water molecule, which exhibits the dispersing ability. Accordingly, the resin-containing particles can be aggregated to an appropriate aggregation degree so that the particle aggregate is prevented from coarsening. The particle aggregate can be thus formed into favorable size and shape.

Furthermore, the temperature of the slurry is maintained, for example, around the glass transition temperature of the binder resin, thereby allowing the resin-containing particles contained in the slurry to be fused so that the mutual adhesion of the resin-containing particles can be enhanced. Further, the heating operation of the particle aggregate can make the particle aggregate, that is, the toner, have a substantially spherical shape, thus further enhancing the charging stability in the case where the particle aggregate is used as a toner.

The slurry is then blown out of the pressure-resistant nozzle 44 of the aggregating/heating unit 33, thereby pulverizing the coarsened particle aggregate in the slurry, which has been formed by excessive aggregation of the resin-containing particles when aggregated through addition of the aggregate dispersant and salt of divalent metal. The slurry is then led through the first depressurizing module 45*a* and the second depressurizing module 45*b* so that the slurry is depressurized at plural stages. In the embodiment, the slurry pressurized to 160 MPa before the pressure-resistant nozzle 44 is depressurized to about 30 MPa when passing through the nozzle, and further depressurized by the first depressurizing nozzle 45*a* to, for example, 10 MPa and furthermore depressurized by the second depressurizing nozzle 45*b* to, for example, 3 MPa. The slurry depressurized by the first depressurizing module 45*a* and the second depressurizing module 45*b* is cooled down by the cooling module 46 of the aggregating/heating unit 33 to a temperature around an ordinary temperature (25° C.). The slurry cooled down by the cooling module 46 of the aggregating/heating unit 3 is depressurized by the third depressurizing module 45*c* to a level around atmosphere pressure ($1.013\times10^5$ Pa).

Through the aggregating step including the metal salt-adding stage and the heating and aggregating stage as described above, the particle aggregate, i.e., the toner particles are formed. In the aggregating step, the heating and aggregating stage may be carried out plural times according to need. It is preferred that the heating and aggregating stage be carried out until the volume average particle diameter of aggregate of the resin-containing particles in the slurry becomes 4 μm to 8 μm. Through the aggregating step, the aggregate of the resin-containing particles will have a preferable size, for example, such a size that the volume average particle diameter of aggregate of the resin-containing particles becomes 4 μm to 8 μm, and the process then proceeds to the cleaning step.

(E) Cleaning Step

At the cleaning step, the particle aggregate is isolated from the slurry containing the particle aggregate obtained through the aggregating step, and subjected to cleaning by use of pure water. The particle aggregate is then dried, thus resulting in the toner. For isolating the particle aggregate from the slurry, a commonly-used separating device is used such as a filtration device and a centrifuge. An electric conductivity of the pure water used for the cleaning is preferably 20 μS/cm or less. The pure water thus described can be obtained by a heretofore known method including an activated carbon method, an ion exchange method, a distillation method, and a reverse osmosis method. Further, a water temperature of the pure water is preferably around 10° C. to 80° C. The cleaning may be carried out until the electric conductivity of wash liquid (water used for the cleaning of the particle aggregate) reaches 50 μS/cm or less. After completion of the cleaning, the particle aggregate is isolated from the wash liquid, and then dried whereby the toner is obtained.

At a stage after the aggregating step and before the cleaning step, the polymer is in the state as shown in FIG. 1B as described above, that is, the polymer is water-soluble owing to the presence of the anionic polar group which is hydrogen-bonded to the water molecule, therefore allowing the polymer contained in the aggregate dispersant to be easily removed from the particle aggregate through the aqueous cleaning upon isolating the particle aggregate from the aqueous medium. Further, the salt of divalent or higher valent metal is removed together with the polymer from the particle aggregate through the aqueous cleaning since the anionic polar group contained in the polymer is bonded to the metal ion.

Accordingly, the use of the aggregate dispersant of the invention allows the particle aggregate to be easily isolated from the aqueous medium without operations such as changing pH of the slurry. It is thus possible to prevent various problems from arising which are attributable to the change of pH of the slurry during the cleaning, including, for example, a problem of decrease in degree of transparency due to cross-linking of the binder resin in the particle aggregate used as a toner and a problem of deterioration of property of the binder resin due to hydrolysis of the binder resin or the like cause.

The method of manufacturing the particle aggregate as described above is not limited to the above configuration and may be modified variously. For example, the dispersing step and the heating and aggregating stage of the aggregating step may be carried out by using a commonly-used mixing apparatus such as a batch-type emulsifying machine and a dispersing machine. The emulsifying machine and the dispersing machine may be provided with a heating section, a stirring section and/or a rotating section which can give shearing force to the toner raw material admixture, a mixing tank having a heat-retaining section, and the like component. Specific examples of the emulsifying machine and the dispersing machine include: a batch-type emulsifying machine such as ULTRA TURRAX (trade name) manufactured by IKA Japan K.K., POLYTRON HOMOGENIZER (trade name) manufactured by Kinematica Co., and T.K. AUTOHOMOMIXER (trade name) manufactured by Tokushu Kika Kogyo K.K.; a continuous-type emulsifying machine such as EBARA MILDER (trade name) manufactured by Ebara Corporation, T.K. PIPELINE HOMOMIXER (trade name) manufactured by Tokushu Kika Kogyo K.K., T.K. HOMOMIC LINE FLOW (trade name) manufactured by Tokushu Kika Kogyo K.K., FILMICS (trade name) manufactured by Tokushu Kika Kogyo K.K., COLLOID MILL (trade name) manufactured by Shinko Pantec Co., Ltd., SLUSHER (trade name) manufactured by Mitsui Miike Kakoki Co., Ltd., TRIGONAL WET GRINDER (trade name) manufactured by Mitsui Miike Kakoki Co., Ltd., CAVITRON (trade name) manufactured by Eurotec, Ltd., and FINE FLOW MILL (trade name) manufactured by Taiheiyo Kiko Co., Ltd.; CLEARMIX (trade name) manufactured by M Technique Co., Ltd.; and FILMICS (trade name) manufactured by Tokushu Kika Kogyo K.K.

In the method of manufacturing the particle aggregate according to the embodiment, the irregular resin particles are dispersed with the aid of the aggregate dispersant containing the polymer in which the anionic polar group is bonded to the main chain, whereby the irregular resin particles are formed into such a size that a volume average particle diameter thereof is 0.4 μm o 2.0 μm. Subsequently, thus-sized irregular resin particles, i.e., resin-containing particles are aggregated by adding the salt of divalent or higher valent metal to the slurry having an ordinary temperature, for example. Furthermore, the slurry to which the salt of divalent or higher valent metal has been added, is heated to further aggregate the resin-containing particles and at the same time, the heat softens the components such as the binder resin in the resin-containing particles, thus resulting in enhancement in the mutual adhesion of the resin-containing particles contained in the particle aggregate. The particle aggregate is then isolated from the slurry and dried to thereby obtain the toner.

In the embodiment, not only the aggregate dispersant is heated but also the salt of divalent or higher valent metal is added, thus increasing a aggregating rate and controlling the aggregation degree. The aggregation degree is controlled by adjusting, for example, concentration, drip rate, drip amount, etc. of the metal salt solution, as described above. Further, in the embodiment, the resin-containing particles are aggregated by heating the aggregate dispersant as well as adding the salt of divalent or higher valent metal. As a result, the usage of the salt of divalent or higher valent metal is decreased and moreover, the cleaning can be carried out with use of water, allowing impurities to be removed from the particle aggregate which is to be used as a toner so that the property of the particle aggregate can be prevented from changing.

The toner according to the invention is manufactured by the method of manufacturing an aggregate of resin-containing particles mentioned above according to the invention. In the method of manufacturing the aggregate of resin-containing particles according to the invention, an aggregate of resin-containing particles is manufactured by aggregating resin-containing particles using the aggregate dispersant and a salt of divalent or higher valent metal. Dispersing ability and aggregating ability of the aggregate dispersant can be controlled by changing the temperature of the aqueous medium containing the resin-containing particles. Accordingly, compared to dispersion of resin-containing particles by using a dispersant dispersing ability of which cannot be controlled, the solid content of the resin-containing particles in the aqueous medium can be increased by controlling the temperature of the aqueous medium to be lower than an aggregation onset temperature of the aggregation dispersant. Consequently, distances between the resin-containing particles are shortened in aggregating the resin-containing particles, which allows easier aggregation. As a result, the amount of the salt of divalent or more valent metal to be added to the aqueous medium can be decreased. Accordingly, since the amount of the salt of divalent or more valent metal contained in the toner which is an aggregate of resin-containing particles can be decreased, it is possible to suppress adverse effects of the salt of metal on charging performance and achieve a toner having excellent charging performance. Furthermore, it is possible to achieve a toner having good environmental stability. As mentioned above, the capability of increasing a solid content of resin-containing particles in the aqueous medium is also preferable from an aspect of costs of manufacturing, and preferable from aspects of amount of the aqueous medium to be used and time necessary for manufacturing the toner. In other words, since it is possible to manufacture a toner with resin-containing particles having an increased solid content and it is thereby possible to decrease the amount of the aqueous medium to be used for manufacturing a toner and shorten a time necessary for manufacturing a same amount of toner, an excellent toner can be provided in reduced costs, as mentioned above.

Further, when the method of manufacturing the particle aggregate as described above is employed to manufacture a toner, it is possible to obtain the toner which is formed of aggregate of resin-containing particles and in which the colorant particles and release agent particles respectively having favorable dispersion diameters are dispersed in the binder resin. To be specific, the resin-containing particles for forming the aggregate, i.e., the toner, are prepared by dispersing the colorant particles and the release agent particles into the binder resin, and the volume average particle diameter of the resin-containing particles is 0.4 μm to 2.0 μm. Further, in the toner formed of the aggregate as just described, the colorant particles having a dispersion diameter of 0.01 μm to 0.5 μm occupies 70% by number or more of the total colorant particles contained in the toner while the release agent particles having a dispersion diameter of 0.1 μm to 1.0 μm occupies 50% by number or more of the total release agent particles contained in the toner.

Since the toner as described above is composed of the colorant particles and release agent particles dispersed in the binder resin, the amounts of the colorant particles and release agent particles exposed on the surface of the aggregate can be smaller than that of a particle aggregate which is formed of the aggregated binder resin particles, colorant particles, and release agent particles. This makes it possible to prevent the blocking which is caused by thermal aggregation of the toner inside the image forming apparatus so that the preservation stability of the toner can be enhanced. In this case, it is also possible to enhance the charging stability of the toner.

Further, the volume average particle diameter of the resin-containing particles of 0.4 μm to 2.0 μm allows, for example, the aggregate of the resin-containing particles in the slurry to be easily formed to have a volume average particle diameter of 4 μm to 8 μm. As a result, a toner is obtained whose volume average particle diameter is around 4 μm to 8 μm. That is to say, by setting the volume average particle diameter of resin-containing particles to 0.4 μm to 2.0 μm, it is possible to make small a size of toner which is an aggregate of resin-containing particles, for example, the volume average particle diameter of about 4 μm to 8 μm.

With use of the toner having the volume average particle diameter of 4 μm to 8 μm, it is possible to stably form high-resolution images over a long period of time. When the volume average particle diameter of the toner is less than 4 μm, there may arise higher electrification and lower fluidization. When the higher electrification and lower fluidization arise, the toner is no longer allowed to be stably supplied to the photoreceptor, which may result in generation of background fog and decrease of the image density. The toner having the volume average particle diameter over 8 μm may be unable to form high-resolution images. Further, the larger particle diameter of the toner leads to a decrease in a specific surface area of the toner, resulting in a decrease in the charge amount of the toner. The smaller charge amount of the toner leads to a failure of the stable supply of the toner to the photoreceptor, which may cause contamination inside the apparatus due to scattering of the toner therein.

Further, in the toner of the invention, the colorant particles which are dispersed in the binder resin at such a favorable dispersion diameter as 0.01 μm to 0.5 μm, occupies 70% by number or more of the total colorant particles contained in the toner, with the result that the level of easiness to be charged is uniform among the toner particles, thus obtaining excellent charging stability. This enhances, for example, transfer rates of a toner image from a photoreceptor to a recording medium, from the photoreceptor to an intermediate medium, and from the intermediate medium to a recording medium, thus achieving reduction of toner consumption. Further, in the case, image defects are prevented from appearing such as image fog caused by defective charging of the toner. Furthermore, it is possible to reduce the variation of the content of the colorant particles in the toner particles, thus leading to enhancement in the color reproducibility.

Further, in the toner of the invention, the release agent particles which are dispersed in the binder resin at such a favorable dispersion diameter as 0.1 μm to 1.0 μm, occupies 50% by number or more of the total release agent particles contained in the toner, and it is thus possible to reliably prevent the toner filming onto the photoreceptor, the offset phenomenon in a high-temperature range, and the like trouble from arising. Moreover, when the release agent particles are evenly dispersed in the binder resin at such a favorable dispersion diameter as 0.1 μm to 1.0 μm, it is very hard for the release agent particles to be detached from the toner, so that the preservation stability can be enhanced.

Further, in the toner of the invention, the aggregate of the resin-containing particles is formed by heat so that the mutual adhesion of the resin-containing particles is enhanced. Accordingly, the resin-containing particles aggregated inside the image forming apparatus are prevented from being disaggregated so that no fine particles of the toner are generated. Further, by heating the aggregate of the resin-containing particles, the toner can be formed into a substantially spherical shape, thus leading to enhancement in the charging stability of the toner.

The toner of the invention may be subjected to surface modification by adding an external additive thereto. As the external additive, heretofore known ingredients can be used, including silica, titanium oxide, silicone resin, and silica and titanium oxide which are surface-treated with a silane coupling agent. Furthermore, a preferable usage of the external additive is 1 part by weight to 10 parts by weight based on 100 parts by weight of the toner.

The toner of the invention can be used in form of either one-component developer and two-component developer. Since the toner of the invention is excellent in charging performance and environmental stability, the developers comprising the toner of the invention, that is, one-component developer and two-component developer comprising the toner of the invention have a high stable characteristics and can form a high quality image stably. In addition, since the toner of the invention has excellent light transmitting property, the developer of the invention comprising color toner as the toner of the invention has excellent color reproducibility. Further, the toner of the invention has excellent releasing property, by using the developer comprising the toner of the invention, it is possible to prevent an offset phenomenon in high temperature range or the like and stably form a high quality image. By using such a developer of the invention, it is possible to form a high quality image of high definition and high resolution.

The toner of the invention is preferably used as toner for developing an electrostatic image which develops an electrostatic image formed on the image bearing member as a latent image, and more specifically, as toner for developing an electrostatic image which develops an electrostatic image formed in image formation according to electrophotography. The toner of the invention is not limited to development of the electrostatic image, and may be used for development of another latent image such as a magnetic latent image.

In a case where the toner of the invention is used in form of one-component developer, only the toner is used without use of carriers while a blade and a fur brush are used to effect the fictional electrification at a developing sleeve so that the toner is attached onto the sleeve, thereby conveying the toner to perform image formation.

Further, the toner of the invention in a case of being used in form of two-component developer, is used together with a carrier. As the carrier, heretofore known ingredients can be used including, for example, single or complex ferrite composed of iron, copper, zinc, nickel, cobalt, manganese, and chromium, a resin-covered carrier having carrier core particles composed of the above-mentioned single or complex ferrite and a covering substance with which surfaces of the carrier core particles are covered, and a resin-dispersion carrier in which magnetic particles are dispersed in a resin. As the covering substance in the resin-covered carrier, heretofore known ingredients can be used including polytetrafluoroethylene, a monochloro-trifluoroethylene polymer, polyvinylidene-fluoride, silicone resin, polyester resin, a metal compound of di-tert-butylsalicylic acid, styrene resin, acrylic resin, polyacid, polyvinyl butyral, nigrosine, aminoacrylate resin, basic dyes or lakes thereof, fine silica powder, and fine alumina powder. In addition, the resin used for the resin-dispersion carrier is not limited to a particular resin, and the examples thereof include styrene-acryl resin, polyester resin, fluorine resin and phenol resin. Either the covering substance in the resin-covered carrier and the resin used for the resin-dispersion carrier are preferably selected according to the toner components. Further, one of the above covering substances may be used each alone, or two or more of the above substances may be used in combination.

A shape of the carrier is preferably a spherical shape or flattened shape. A particle diameter of the carrier is not limited to a particular diameter, and in consideration of high quality image, a volume average particle diameter of the carrier is preferably 10 μm to 100 μm, and more preferably 20 μm to 50 μm. Further, the resistivity of the carrier is preferably $10^8$ Ω·cm or more, and more preferably $10^{12}$ Ω·cm or more. The resistivity of the carrier is a value obtained by reading a current value in a case where a voltage which generates an electric field of 1000 V/cm between a weight and a bottom electrode of a container which has a cross section of 0.50 $cm^2$. The carrier particles are charged into the container and tapped, and thereafter a load of 1 $kg/cm^2$ is applied to particles charged into the container by the weight. When the resistivity of the carrier is low, more specifically, less than $10^8$ Ω·cm, electric charge is injected in the carrier in a case where a voltage is applied to a developing sleeve which is a developer bearing member, and carrier particles are liable to be attached to a photoreceptor which is an image bearing member. In addition, break down of a bias voltage is liable to occur.

A maximum magnetization indicating strength of magnetization of carrier is preferably 10 emu/g to 60 emu/g, and more preferably 15 emu/g to 40 emu/g. Although the maximum magnetization of the carrier depends on magnetic flux density of a developing roller, when the maximum magnetization of the carrier is less than 10 emu/g under the condition of an ordinary magnetic flux density of the developing roller, magnetic binding force does not work, which may cause toner scattering. In addition, when the maximum magnetization thereof excesses 60 emu/g, a brush of carrier particles is too large, and therefore, in the case of non-contact developing, it is difficult to keep the brush in a non-contact state with the image bearing member. In the case of contact developing, sweep streaks may be liable to appear on a toner image.

A use ratio of toner to a carrier in the two-component developer is not limited to a particular ratio, and the use ratio is appropriately selected according to a type of toner and carrier. In the case of the resin-covered carrier in which the resin density therein is 5 $g/cm^3$ to 8 $g/cm^3$, based on the total amount of the developer, 2% by weight to 30% by weight of toner is preferably included in the developer, and more preferably 2% by weight to 20% by weight.

In the two-component developer, a coverage of a carrier by toner is preferably 40% to 80%. The coverage of the carrier by the toner indicates a percentage of a ratio $S_1/S$ which is a ratio of a surface area $S_1$ of a toner-covered portion of the carrier to a total surface area S, namely, a sum of a surface area of a toner-covered portion which is covered with toner, of a carrier surface, and a surface area of a non-covered portion which is not covered with toner.

The coverage of the carrier by the toner is indirectly measured by the following method. From a developer tank, the carrier is sampled, and by means of a scanning electron microscope (abbreviated as SEM, trade name: S-5500, manufactured by Hitachi, Ltd.), SEM pictures of surfaces of arbitrary some carrier particles are taken. The obtained SEM picture images are binary-processed so that the toner-covered portion becomes black and the toner-non-covered portion becomes while. Next, a total pixel number of the carrier corresponding to the total surface area S of the carrier (i.e., a sum of a black pixel number and a white pixel number) and a pixel number of the toner-covered portion corresponding to the surface area $S_1$ of the toner-covered portion (i.e., the black pixel number) are counted. Next, an average of ratios $S_1/S$ of the pixel number S1 of the toner-covered portion to the total pixel number S of the carriers is determined. A percentage of the determined value is defined as the coverage of the carrier by the toner. In the above method, a half spherical portion of one carrier, that is, only a half of the total surface area is measured. Since the average of the ratios S1/S of a plurality of carrier particles is determined, the obtained result is equivalent to a calculation result in the case of measuring a surface area of the entire carrier particle.

Figure 8:
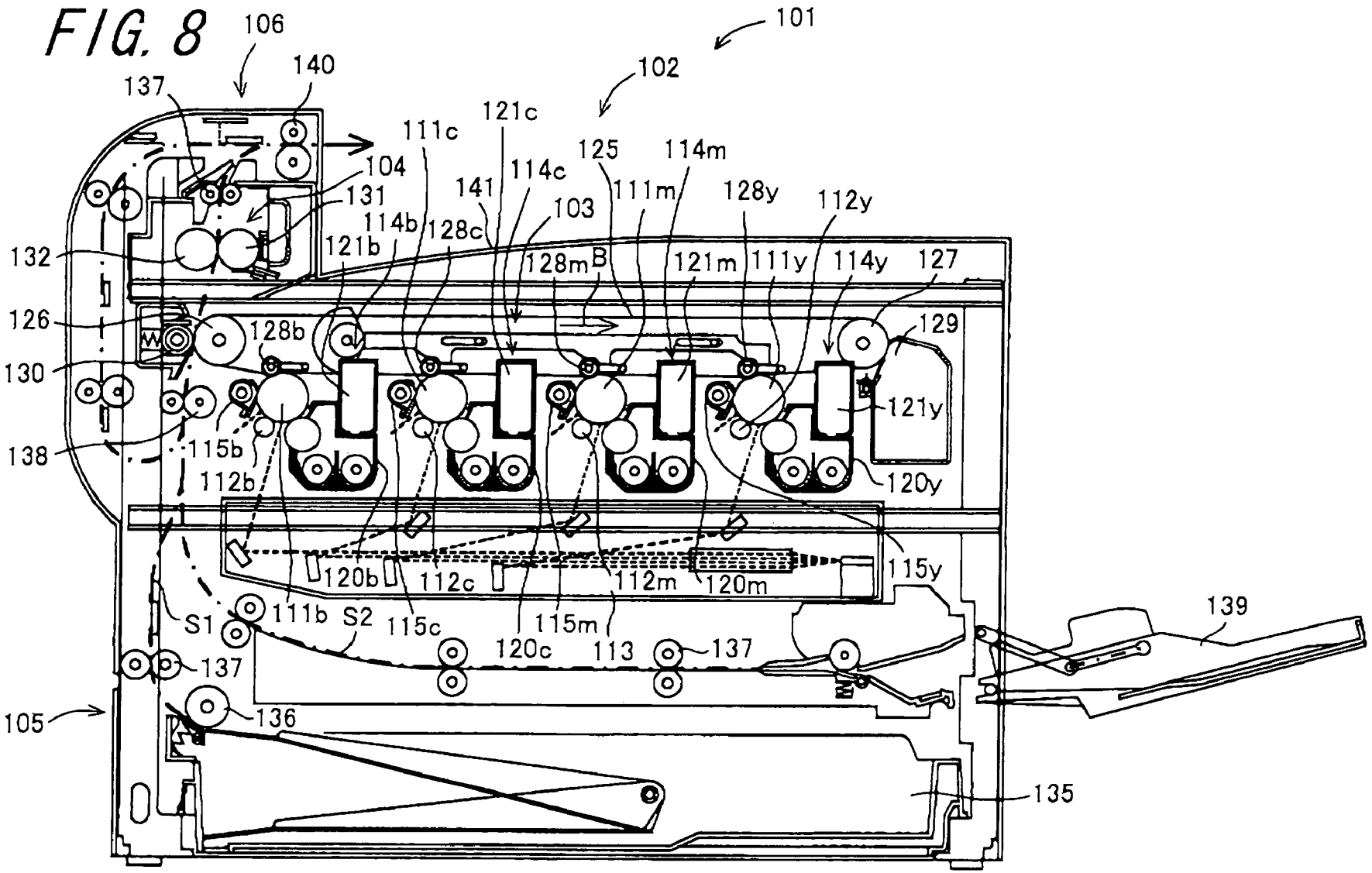
FIG. 8 is a sight-through side view showing a configuration of an image forming apparatus having a developing device according to one embodiment of the invention.
Figure 9:
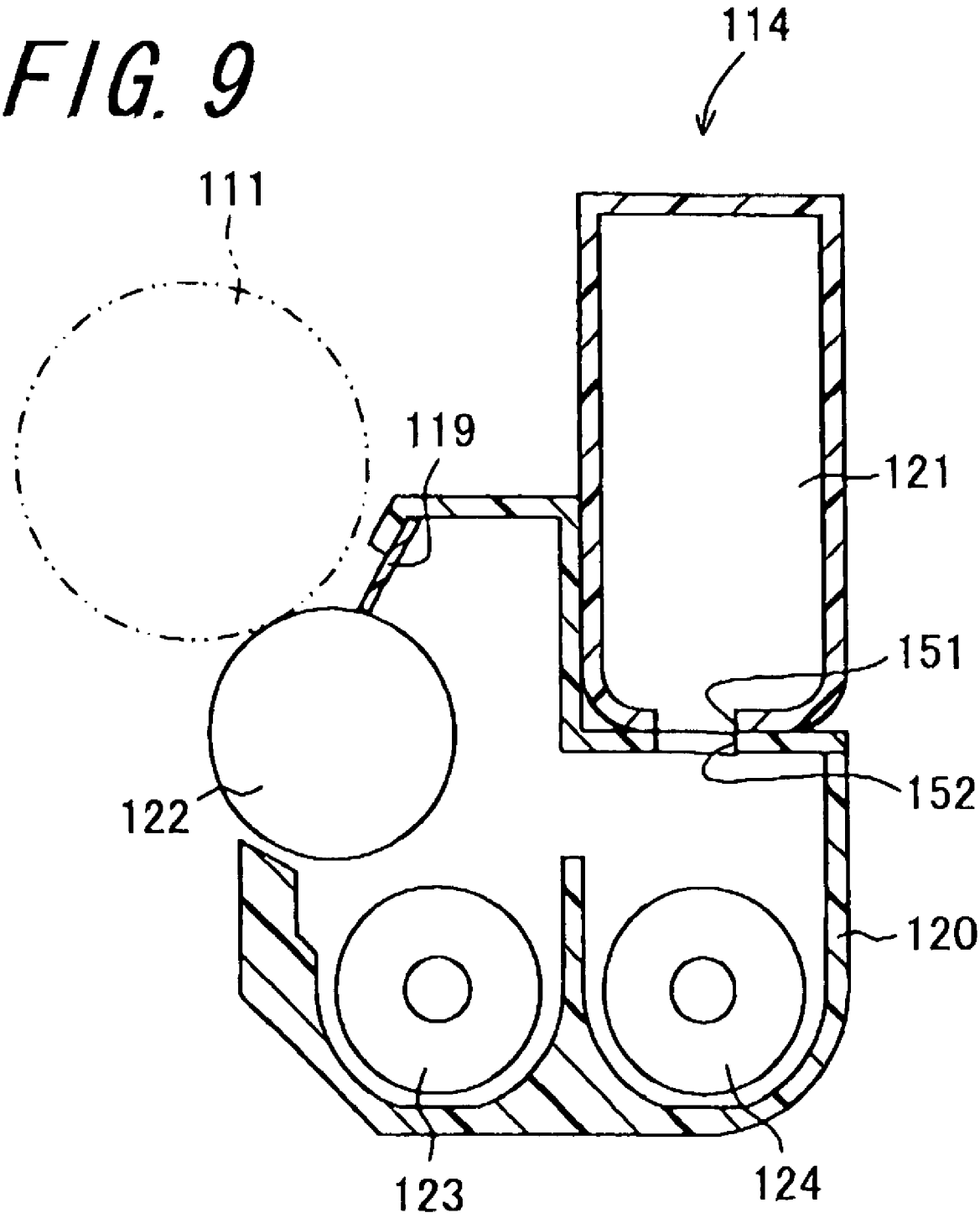
FIG. 9 is a sectional view showing a configuration of the developing device according to one embodiment of the invention.

FIG. 8 is a sight-through side view showing a configuration of an image forming apparatus 101 having a developing device 114 according to one embodiment of the invention. FIG. 9 is a sectional view showing a configuration of the developing device 114 according to one embodiment of the invention. The image forming apparatus 101 according to the present embodiment is an electrophotographic image forming apparatus. An image forming apparatus 101 is a multifunctional machine having a copier function, a printer function, and a facsimile function together, and according to image information being conveyed to the image forming apparatus 101, a full-color or monochrome image is formed on a recording medium. That is, the image forming apparatus 101 has three types of printer mode, i.e., a copier mode, a printer mode and a FAX mode, and the printer mode is selected by a control unit (not shown) depending on, for example, the operation input from an operation portion (not shown) and reception of the printing job from an external equipment such as a personal computer, a mobile device, an information recording storage medium, and a memory device. The image forming apparatus 101 includes a toner image forming section 102, a transfer section 103, a fixing section 104, a recording medium supply section 105, and a discharge section 106.

The image forming apparatus 101 according to the embodiment is capable of forming a multicolor image in which a plurality of different color images are combined with each other. To be more specific, the image forming apparatus 101 according to the invention is capable of forming a multicolor image which is composed of combined toner images of two or more colors selected from four colors of black (b), cyan (c), magenta (m), and yellow (y). In accordance with image information of respective colors of black (b), cyan (c), magenta (m), and yellow (y) which are contained in color image information, there are provided respectively four sets of the components constituting the toner image forming section 102 and a part of the components contained in the transfer section 103. The four sets of respective components provided for the respective colors are distinguished herein by giving alphabets indicating the respective colors to the end of the reference numerals, and in the case where the sets are collectively referred to, only the reference numerals are shown.

The toner image forming section 102 comprises a photoreceptor drum 111 serving as an image bearing member, a charging section 112, an exposure unit 113, a developing device 114, and a cleaning unit 115. The charging section 112 and the exposure unit 113 each function as a latent image forming section. The charging section 112, the developing device 114, and the cleaning unit 115 are disposed in this order around the photoreceptor drum 111. The charging section 112 is disposed vertically below the developing device 114 and the cleaning unit 115.

The photoreceptor drum 111 is rotatably supported around an axis thereof by a driving mechanism (not shown), and includes a conductive substrate and a photosensitive layer formed on a surface of the conductive substrate although not shown. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film obtained by forming a conductive layer containing one or two or more of aluminum, aluminum alloy, tin oxide, gold, indium oxide, etc. on a film-like substrate such as of synthetic resin film, metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. Provision of the undercoat layer offers advantages such as covering the flaws and irregularities present on the surface of the conductive substrate to thereby smooth the surface of the photosensitive layer, preventing degradation of the chargeability of the photosensitive layer during repetitive use, and enhancing the charging property of the photosensitive layer under a low temperature and/or low humidity circumstance. Further, the photosensitive layer may be a laminated photoreceptor having a highly-durable three-layer structure in which a photoreceptor surface-protecting layer is provided on the top layer. In the embodiment, the charge generating layer and the charge transporting layer are laminated in this order on the conductive substrate.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generation ability and are suitable for obtaining a photosensitive layer at high sensitivity. The charge generating substances can be used each alone, or two or more of the charge generating substances can be used in combination. The content of the charge generating substance is not particularly limited, and preferably from 5 to 500 parts by weight and more preferably from 10 to 200 parts by weight based on 100 parts by weight of binder resin in the charge generating layer.

Also as the binder resin for charge generating layer, materials used customarily in the relevant field can be used including, for example, melamine resin, epoxy resin, silicone resin, polyurethane, acryl resin, vinyl chloride-vinyl acetate copolymer resin, polycarbonate, phenoxy resin, polyvinyl butyral, polyallylate, polyamide, and polyester. The binder resins can be used each alone or, optionally, two or more of the resins can be used in combination.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 to 5 μm and more preferably from 0.1 μm to 2.5 μm.

The charge transporting layer stacked over the charge generating layer contains as an essential ingredient a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiopnene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, promanyl, chloranyl, and benzoquinone. The charge transporting substances can be used each alone, or two or more of the charge transporting substances can be used in combination. The content of the charge transporting substance is not particularly limited, and preferably from 10 to 300 parts by weight and more preferably from 30 to 150 parts by weight based on 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resins thereof. Among those materials, in view of the film forming property, and the wear resistance, electrical characteristics etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins can be used each alone, or two or more of the binder resins can be used in combination.

The charge transporting layer preferably contains an antioxidant together with the charge transporting substance and the binder resin for charge transporting layer. Also for the antioxidant, materials used customarily in the relevant field can be used including, for example, vitamin E, hydroquinone, hindered amine, hindered phenol, paraphenylene diamine, arylalkane and derivatives thereof, an organic sulfur compound, and an organic phosphorus compound. The antioxidants can be used each alone, or two or more of the antioxidants can be used in combination. The content of the antioxidant is not particularly limited, and is 0.01% by weight to 10% by weight and preferably 0.05% by weight to 5% by weight based on the total amount of the ingredients constituting the charge transporting layer.

The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, as described above, there is used a photoreceptor drum which has an organic photosensitive layer using the charge generating substance and the charge transporting substance. It is, however, also possible to use, instead of the above photoreceptor drum, a photoreceptor drum which has an inorganic photosensitive layer using silicon or the like. Although the charge generating layer and the charge transporting layer are layered in this order on the conductive substrate in the embodiment, it is also possible to stack on the conductive substrate the charge transporting layer and the charge generating layer in this order.

The charging section 112 faces the photoreceptor drum 111 and is disposed away from the surface of the photoreceptor drum 111 along a longitudinal direction thereof so that a gap is formed between the charging section 112 and the photoreceptor drum 111. The charging section 112 charges the surface of the photoreceptor drum 111 so that the surface of the photoreceptor drum 111 has predetermined polarity and potential. As the charging section 112, it is possible to use a charging brush type charger, a charger type charger, a saw tooth type charger, an ion-generating device, etc. Although the charging section 112 is disposed away from the surface of the photoreceptor drum 111 in the embodiment, the configuration is not limited thereto. For example, a charging roller may be used as the charging section 112, and the charging roller may be disposed in contact-pressure with the photoreceptor drum 111. It is also possible use a contact-charging type charger such as a charging brush or a magnetic brush.

The exposure unit 113 is disposed so that light corresponding to respective color information emitted from the exposure unit 113 passes between the charging section 112 and the developing device 114 to reach the surface of the photoreceptor drum 111. In the exposure unit 113, the image information is examined to thereby form branched light corresponding to respective color information of black (b), cyan (c), magenta (m), and yellow (y) in each unit, and the surface of the photoreceptor drum 111 which has been evenly charged by the charging section 112, is exposed to the light corresponding to the respective color information to thereby form an electrostatic latent image on the surface of the photoreceptor drum 111. As the exposure unit 113, it is possible to use a laser scanning unit having a laser-emitting portion and a plurality of reflecting mirrors. The other usable examples of the exposure unit 113 may include an LED array and a unit in which a liquid-crystal shutter and a light source are appropriately combined with each other.

The developing device 114 includes, as shown in FIG. 9, a developer-regulating blade 119, a developer tank 120, a toner hopper 121, a developing roller 122, a supplying roller 123, and a stirring roller 124. The developer tank 120 is a container-shaped member, and disposed so as to face the surface of the photoreceptor drum 111. The developer tank 120 contains in an internal space thereof the developer of the invention and the developing roller 122, supplying roller 123, and stirring roller 124 which are rotatably supported by the developer tank 120. The developer tank 120 has an opening in a side face thereof opposed to the photoreceptor drum 111. The developing roller 122 is rotatably provided at a position where the developer tank 120 faces the photoreceptor drum 111 through the opening just stated.

The developing roller 122 is a developer-conveying member for carrying and thus conveying the developer. The developing roller 122 is a so-called magnet roller in which a fixed magnet body is contained. Magnetic force of the fixed magnet body causes the carrier in the developer to be magnetically stuck to the developing roller 122 whereby the developer is carried on the developing roller 122. The developing roller 122 is a roller-shaped member, and supplies a toner to the electrostatic latent image on the surface of the photoreceptor 111 at a pressure-contact portion or most-adjacent portion between the developing roller 122 and the photoreceptor drum 111. When the toner is supplied, to a surface of the developing roller 122 is applied a potential whose polarity is opposite to a polarity of the potential of the charged toner, which serves as a development bias voltage (hereinafter referred to simply as "development bias"). By so doing, the toner on the surface of the developing roller 122 is smoothly supplied to the electrostatic latent image. Furthermore, an amount of the toner being supplied to the electrostatic latent image (a toner-attached amount) can be controlled by changing a value of the development bias. An amount of the developer carried on the surface of the developing roller 122 is regulated by the developer-regulating blade 119. The developing device 114 performs the developing operation by using the developing roller 122 to supply the toner to the electrostatic latent image formed on the surface of the photoreceptor drum 111, thereby forming a toner image which is a visualized image.

The supplying roller 123 is a roller-shaped member, and rotatably disposed opposite to the developing roller 122. The supplying roller 123 supplies the toner to the vicinity of the developing roller 122. The stirring roller 124 is a roller-shaped member, and rotatably disposed opposite to the supplying roller 123. The stirring roller 124 stirs the toner which is newly supplied from the toner hopper 121 into the developer tank 120, and the toner stored inside the developer tank 120, and then feeds the toner to the vicinity of the supplying roller 123. The supplying roller 23 functions as a supply section for supplying the toner to the developing roller 122 while the stirring roller 124 is a stirring and supplying section for stirring the toner inside the developer tank 120 and supplying the toner to the supplying roller 123. Although the supply section and the stirring and supplying section are roller-shaped members, they are not limited to the roller shape and may each have a screw shape.

The toner hopper 121 is disposed so as to communicate a toner replenishment port 151 formed in a lower part of vertical direction of the toner hopper 121, with a toner reception port 152 formed in an upper part of vertical direction of the developer tank 120. The toner hopper 121 replenishes the developer tank 120 with the toner according to toner consumption. Further, it may be possible to replenish the toner directly from a toner cartridge of each color without using the toner hopper 121.

Referring back to FIG. 8, the cleaning unit 115 removes the toner which remains on the surface of the photoreceptor drum 111 after the toner image has been transferred to the recording medium, and cleans the surface of the photoreceptor drum 111. In the cleaning unit 115 is used a platy member such as a cleaning blade. In the image forming apparatus 101 according to the embodiment, an organic photoreceptor drum is used as the photoreceptor drum 111. Since a surface of the organic photoreceptor drum contains a resin component as a main ingredient, a chemical action of ozone caused by corona discharging through the charging device promotes the deterioration of the surface of the organic photoreceptor drum. The degraded surface part is, however, worn away by abrasion through the cleaning unit 115 and reliably, though gradually, removed. Accordingly, the problem of the surface degradation caused by the ozone is actually solved, and it is thus possible to stably maintain the potential of charges given by the charging operation over a long period of time. Although the cleaning unit 115 is provided in the embodiment, no limitation is imposed on the configuration, and there may be no cleaning unit 115.

In the toner image forming section 102, signal light corresponding to the image information is emitted from the exposure unit 113 to the surface of the photoreceptor drum 111 which has been evenly charged by the charging section 112, thereby forming an electrostatic latent image; the toner is then supplied from the developing device 114 to the electrostatic latent image, thereby forming a toner image; the toner image is transferred to an intermediate transfer belt 125; and the toner which remains on the surface of the photoreceptor drum 111 is removed by the cleaning unit 115. A series of a toner image forming operation just described is repeatedly carried out.

The transfer section 103 is disposed above in a vertical direction of the photoreceptor drum 111, and includes the intermediate transfer belt 125, a driving roller 126, a driven roller 127, an intermediate transferring roller 128 (*b, c, m, y*), a transfer belt cleaning unit 129, and a transfer roller 130.

The intermediate transfer belt 125 is an endless belt stretched out by the driving roller 126 and the driven roller 127, thereby forming a loop-shaped travel path. The intermediate transfer belt 125 rotates in an arrow B direction. When the intermediate transfer belt 125 passes by the photoreceptor drum 111 in contact therewith, the transfer bias whose polarity is opposite to the polarity of the charged toner on the surface of the photoreceptor drum 111 is applied from the intermediate transferring roller 128 which is disposed opposite to the photoreceptor drum 111 via the intermediate transfer belt 125, with the result that the toner image formed on the surface of the photoreceptor drum 111 is transferred onto the intermediate transfer belt 125. In the case of a multicolor image, the toner images of respective colors formed by the respective photoreceptor drums 111 are sequentially transferred onto the intermediate transfer belt 125 and combined thereon, thus forming a multicolor image.

The driving roller 126 can rotate around an axis thereof with the aid of a driving mechanism (not shown), and the rotation of the driving roller 126 drives the intermediate transfer belt 125 to rotate in the arrow B direction. The driven roller 127 can be driven to rotate by the rotation of the driving roller 126, and imparts constant tension to the intermediate transfer belt 125 so that the intermediate transfer belt 125 does not go slack. The intermediate transfer roller 128 is disposed in pressure-contact with the photoreceptor drum 111 via the intermediate transfer belt 125, and capable of rotating around its own axis by a driving mechanism (not shown). The intermediate transfer belt 128 is connected to a power source (not shown) for applying the transfer bias as described above, and has a function of transferring the toner image formed on the surface of the photoreceptor drum 111 to the intermediate transfer belt 125.

The transfer belt cleaning unit 129 is disposed opposite to the driven roller 127 via the intermediate transfer belt 125 so as to come into contact with an outer circumferential surface of the intermediate transfer belt 125. The toner which is attached to the intermediate transfer belt 125 by contact with the photoreceptor drum 111 may cause contamination on a reverse side of a recording medium. The transfer belt cleaning unit 129 thus removes and collects the toner on the surface of the intermediate transfer belt 125.

The transfer roller 130 is disposed in pressure-contact with the driving roller 126 via the intermediate transfer belt 125, and capable of rotating around its own axis by a driving mechanism (not shown). At a pressure-contact portion (a transfer nip portion) between the transfer roller 130 and the driving roller 126, a toner image which has been carried by the intermediate transfer belt 125 and thereby conveyed to the pressure-contact portion is transferred onto a recording medium fed from the later-described recording medium supply section 105. In the case of forming the multicolor images on the intermediate transfer belt 125, the formed multicolor images are collectively transferred onto the recording medium by the transfer roller 130. The recording medium onto which the toner image has been transferred is fed to the fixing section 104.

In the transfer section 103, the toner image is transferred from the photoreceptor drum 111 onto the intermediate transfer belt 125 at the pressure-contact portion between the photoreceptor drum 111 and the intermediate transfer roller 128, and by the intermediate transfer belt 125 rotating in the arrow B direction, the transferred toner image is conveyed to the transfer nip portion where the toner image is transferred onto the recording medium.

The fixing section 104 is provided downstream of the transfer section 103 along a conveyance direction of the recording medium, and contains a fixing roller 131 and a pressurizing roller 132. The fixing roller 131 can rotate by a driving mechanism (not shown), and heats the toner constituting an unfixed toner image carried on the recording medium so that the toner is fused to be fixed on the recording medium. Inside the fixing roller 131 is provided a heating portion (not shown). The heating portion heats the heating roller 131 so that a surface of the heating roller 131 has a predetermined temperature (heating temperature). For the heating portion, a heater, a halogen lamp, and the like device can be used. The heating portion is controlled by the later-described fixing condition control unit. In the vicinity of the surface of the fixing roller 131 is provided a temperature detecting sensor which detects a surface temperature of the fixing roller 131. A result detected by the temperature detecting sensor is written to a memory portion of the later-described control unit.

The pressurizing roller 132 is disposed in pressure-contact with the fixing roller 131, and supported so as to be rotatably driven by the rotation of the pressurizing roller 132. The pressurizing roller 132 helps the toner image to be fixed onto the recording medium by pressing the toner and the recording medium when the toner is fused to be fixed on the recording medium by the fixing roller 131. A pressure-contact portion between the fixing roller 131 and the pressurizing roller 132 is a fixing nip portion. In the fixing section 104, the recording medium onto which the toner image has been transferred in the transfer section 103 is nipped by the fixing roller 131 and the pressurizing roller 132 so that when the recording medium passes through the fixing nip portion, the toner mage is pressed and thereby fixed on the recording medium under heat, whereby an image is formed.

The recording medium supply section 105 includes an automatic paper feed tray 135, a pickup roller 136, a conveying roller 137, a registration roller 138, and a manual paper feed tray 139. The automatic paper feed tray 135 is disposed in a lower part in a vertical direction of the image forming apparatus 101 and in form of a container-shaped member for storing the recording mediums. Examples of the recording medium include, for example, plain paper, color copy paper, sheets for over head projector, and post cards. The pickup roller 136 takes out sheet by sheet the recording mediums stored in the automatic paper feed tray 135, and feeds the recording mediums to a paper conveyance path S1.

The conveying roller 137 is a pair of roller members disposed in pressure-contact with each other, and conveys the recording medium to the registration roller 138. The registration roller 138 is a pair of roller members disposed in pressure-contact with each other, and feeds to the transfer nip portion the recording medium fed from the conveying roller 137 in synchronization with the conveyance of the toner image carried on the intermediate transfer belt 125 to the transfer nip portion.

The manual paper feed tray 139 is a device for taking the recording medium into the image forming apparatus 101 by manual performance. The recording medium taken in from the manual paper feed tray 139 passes through a paper conveyance path S2 by use of the conveying roller 137, thereby being fed to the registration roller 138. In the recording medium supply section 105, the recording medium supplied sheet by sheet from the automatic paper feed tray 135 or the manual paper feed tray 139 is fed to the transfer nip portion in synchronization with the conveyance of the toner image carried on the intermediate transfer belt 125 to the transfer nip portion.

The discharge section 106 includes the conveying roller 137, a discharging roller 140, and a catch tray 141. The conveying roller 137 is disposed downstream of the fixing nip portion along the paper conveyance direction, and conveys toward the discharging roller 140 the recording medium onto which the image has been fixed by the fixing section 104. The discharging roller 140 discharges the recording medium onto which the image has been fixed, to the catch tray 141 disposed on a vertical direction-wise upper surface of the image forming apparatus 101. The catch tray 141 stores the recording medium onto which the image has been fixed.

The image forming apparatus 101 includes a control unit (not shown). The control unit is disposed, for example, in an upper part of an internal space of the image forming apparatus 101, and contains a memory portion, a computing portion, and a control portion. To the memory portion of the control unit are input, for example, various set values obtained by way of an operation panel (not shown) disposed on the upper surface of the image forming apparatus 101, results detected from a sensor (not shown) etc. disposed in various portions inside the image forming apparatus 101, and image information obtained from an external equipment. Further, programs for operating various sections are written. Examples of the various sections include a recording medium determining section, an attached amount control section, and a fixing condition control section.

For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 101. Examples of the external equipment include a computer, a digital camera, a television, a video recorder, a DVD recorder, an HDDVD (High-Definition Digital Versatile Disc), a blu-ray disc recorder, a facsimile machine, and a mobile device.

The computing portion takes out the various data (such as an image formation order, the detected result, and the image information) written in the memory portion and the programs for various means, and then makes various determinations. The control portion sends to a relevant device a control signal in accordance the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 101.

According to the embodiment described above, the developing device 114 develops the electrostatic latent image formed on the photoreceptor drum 111 by using the developer of the invention, thereby forming the toner image. Since the developer of the invention comprises the toner of the invention having excellent charging performance and environmental stability, the developer has a high stable characteristics and it is possible to form a high quality image stably. In addition, since the developer of the invention comprises the toner of the invention having excellent light transmitting property and releasing property, the developer has excellent color reproducibility and it is possible to prevent an offset phenomenon in high temperature range or the like. Since the electrostatic latent image is developed in the developing device 114 by using such a developer of the invention, the developing device 114 can be realized which is capable of stably forming a high quality toner image on the photoreceptor drum 111 and is capable of forming a high quality image of high definition and high resolution.

Since, in this embodiment, the development is carried out by means of such a developing device 114, the image forming apparatus 101 can be realized which is capable of stably forming a high quality image and forming a high quality image of high definition and high resolution.

The image forming apparatus 101 of the embodiment is not limited to the multifunctional machine having the copier function, the printer function, and the facsimile function together, and can be used as, for example, a copier, a printer or a facsimile apparatus.

EXAMPLES

Hereinafter, the invention will be described more in detail with reference to Examples. In the following descriptions, "part" indicates "part by weight", and "%" indicates "% by weight", unless otherwise specified.

[Volume Average Particle Diameter and Variation Coefficient]

The volume average particle diameter of the toner particles was obtained by calculation on the basis of measurement of COULTER MULTISIZER III (trade name) manufactured by Coulter K.K. The number of particles for measurement was set at 50,000 counts, and an aperture diameter was set at 100 μm. The variation coefficient was figured out in accordance with the following formula (1) on the basis of the volume average particle diameter obtained from the measured particle diameters and a standard deviation of the volume average particle diameter.

$$\text{Variation coefficient}=\text{Standard deviation}/\text{Volume average particle diameter}\times 100[\%] \quad (1)$$

Further, the volume average particle diameter of the resin-containing particles was obtained in the same manner as above by using a laser diffraction/scattering particle size distribution analyzer LA-920 (trade name) manufactured by Horiba, Ltd. The variation coefficient of the resin-containing particles was determined also by the above formula (1).

[Softening Temperature of Binder Resin]

The softening temperature of the binder resin was measured as follows. Using a device for evaluating flow characteristics: FLOW TESTER CFT-100C (trade name) manufactured by Shimadzu Corporation, 1 g of specimen was heated at a temperature of which increase rate was 6° C./min, under load of 10 kgf/cm$^2$ ($9.8\times10^5$ Pa) so that the specimen was pushed out of a die (nozzle). A temperature of the specimen at the time when a half of the specimen had flowed out of the die was determined as the softening temperature of the binder resin. Note that the die was 1 mm in opening diameter and 1 mm in length.

[Glass Transition Temperature (Tg) of Binder Resin]

The glass transition temperature (Tg) of the binder resin was measured as follows. Using a differential scanning calorimeter: DSC220 (trade name) manufactured by Seiko electronics Inc., 1 g pf specimen was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg).

[Dispersion Diameters of Colorant and Release Agent]

As the dispersion diameter of the colorant, the maximum length of the colorant particles dispersed in the binder resin was obtained. To be specific, the particle aggregate was embedded in the epoxy resin and then cut into an about 100 μm-sized pieces. The particle aggregate was observed through the transmission electron microscope (abbreviated as TEM) at 10,000-fold magnification and photographed. Images of twenty photographs (twenty particle aggregates) thus obtained were evaluated to thereby determine the dispersion diameter of the colorant and obtain a number average dispersion diameter. The dispersion diameter of the release agent was obtained in the same manner as in the case of obtaining the dispersion diameter of the colorant. The release agent is stained with ruthenium tetroxide and then observed through the transmission electron microscope.

[Preparation of Irregular Resin Particles]

(Preparation of Irregular Resin Particles "a")

Using a HENSCHEL MIXER, mixed were 2580 parts of polyester resin (having a glass transition temperature of 57° C.), 240 parts of copper phthalocyanine (C.I. pigment blue 15:3), 150 parts of polyethylene wax: HNP-10 (trade name) manufactured by Nihon Seiro Co., Ltd., and 30 parts of a charge control agent: N4P-SFG (trade name) manufactured by Clariant Japan K.K. A toner raw material was thus obtained. The toner raw material was then melt-kneaded by using an open roll machine, that is, KNEADICS (trade name) manufactured by Mitsui Mining Co. corresponding to an open roll-type kneading machine shown in FIG. 3, and a thus-obtained melt-kneaded material was then cooled down to a room temperature, thereafter being coarsely pulverized by an atomizer. The irregular resin particles "a" were thus prepared. The dispersion diameter of the colorant in the irregular resin particles "a" was 352 nm. The melt-kneading conditions on the open roll-type kneading machine were as follows.

<Melt-kneading Conditions>

The temperature of the heating roll on the raw material admixture supply side was set at 150° C. while the temperature of the cooling roll on the raw material admixture supply side was set at 50° C. Moreover, during the melt-kneading operation, the temperature of the heating roll on the melt-kneaded material discharge side was 90° C. while the temperature of the cooling roll on the melt-kneaded material discharge side was 50° C.

(Preparation of Irregular Resin Particles "b")

The irregular resin particles "b" were prepared in the same manner as the irregular resin particles "a" except that the melt-kneading conditions were modified to a condition indicated in Table 1. The dispersion diameter of the colorant in the irregular resin particles "b" was 567 nm.

(Preparation of Irregular Resin Particles "c")

The irregular resin particles "c" were prepared in the same manner as the irregular resin particles "a" except that the melt-kneading conditions were modified to the condition indicated in Table 1. The dispersion diameter of the colorant in the irregular resin particles "c" was 784 nm.

(Preparation of Irregular Resin Particles "d")

The irregular resin particles "d" were prepared in the same manner as the irregular resin particles "a" except that the melt-kneading conditions were modified to the condition indicated in Table 1. The dispersion diameter of the colorant in the irregular resin particles "d" was 1027 nm.

Table 1 shows both of the melt-kneading conditions for the preparation of the irregular resin particles "a" to "d" and the dispersion diameter of the colorant in the irregular resin particles "a" to "d".

TABLE 1

| | Melt-kneading conditions (° C.) | | | | |
|---|---|---|---|---|---|
| | Raw material admixture supply side | | Melt-kneaded material discharge side | | Dispersion diameter of |
| | Heating roll | Cooling roll | Heating roll | Cooling roll | colorant (nm) |
| Irregular resin particles "a" | 150 | 50 | 90 | 50 | 352 |
| Irregular resin particles "b" | 160 | 50 | 90 | 55 | 567 |
| Irregular resin particles "c" | 165 | 55 | 100 | 55 | 784 |
| Irregular resin particles "d" | 170 | 60 | 100 | 60 | 1027 |

[Preparation of Slurry of Resin-containing Particles]

(Preparation of Slurry A)

The dispersing step and the finely-granulating step were carried out with use of 300 parts of the irregular resin particles "a", 30 parts of polyacrylic acid that is an aggregate dispersant: DISROL H14-N (trade name) manufactured by Nippon Nyukazai Co., Ltd. (hereinafter referred to as "polyacrylic acid (1)"), and 2670 parts of ion-exchanged water (having a conductivity of 0.5 μS/cm). At the finely-granulating step, there was used a fine particle-manufacturing apparatus: NANO 3000 (trade name) manufactured by Beryu Co., Ltd. corresponding to the high-pressure homogenizer shown in FIG. 4. Further, at the finely-granulating step, the slurry was pressurized by the pressurizing unit to 150 MPa and heated by the heating unit to 70° C. Through the dispersing step and finely-granulating step as described above, the slurry A was obtained which contains resin-containing particles A of 10%. The polyacrylic acid (1) is a neutralized substance obtained by neutralizing a carboxyl group as an anionic polar group by sodium hydroxide (NaOH), and the neutralization level of carboxyl group by sodium hydroxide is 70 mol %.

(Preparation of Slurry B)

Slurry B which contains resin-containing particles B of 10% was obtained in the same manner as the slurry A except that the irregular resin particles "a" was modified to the irregular resin particles "b".

(Preparation of Slurry C)

Slurry C which contains resin-containing particles C of 10% was obtained in the same manner as the slurry A except that the irregular resin particles "a" was modified to the irregular resin particles "c".

(Preparation of Slurry D)

Slurry D which contains resin-containing particles D of 10% was obtained in the same manner as the slurry A except that the irregular resin particles "a" was modified to the irregular resin particles "d". The resin-containing particles D of the slurry D contained the binder resin particles and the colorant particles.

(Preparation of Slurry E)

Slurry E which contains resin-containing particles A of 10% was obtained in the same manner as the slurry A except that 30 parts of polyacrylic acid (1) was modified to 30 parts of dodecylbenzenesulfonic acid. Dodecylbenzenesulfonic acid is used by neutralizing a sulfonic acid group by sodium hydroxide (NaOH) so that its neutralization level becomes 70 mol %.

(Preparation of Slurry F)

Slurry F which contains the resin-containing particles A of 20% was obtained in the same manner as the slurry A except that an amount of the irregular resin particles "a" was modified to 600 parts and an amount of the ion-exchanged water was modified to 2370 parts.

(Preparation of Slurry G)

Preparation of slurry G which contains the resin-containing particles A of 30% was tried in the same manner as the slurry A except that an amount of the irregular resin particles "a" was modified to 900 parts and an amount of the ion-exchanged water was modified to 2070 parts, but the finely-granulating operation could not be carried out because a piping of the fine particle-manufacturing apparatus was plugged up. Accordingly, the slurry G could not be obtained.

(Preparation of Slurry H)

Preparation of slurry H which contains the resin-containing particles A of 30% was tried in the same manner as the slurry G except that the polyacrylic acid (1) was replaced with polyacrylic acid (2a) described below, but the finely-granulating operation could not be carried out because a piping of the fine particle-manufacturing apparatus was plugged up. Accordingly, the slurry H could not be obtained.

The polyacrylic acid (2a) is a neutralized substance of polyacrylic acid (dispersant: JURYMER AC-10L (trade name) manufactured by Nihon Junyaku; hereinafter referred to as "polyacrylic acid (2)"). Since the polyacrylic acid (2) is non-neutralized substance in which a carboxyl group is not neutralized, when the polyacrylic acid (2) is used as a dispersant without modification, efficacy thereof cannot be fully achieved because the polyacrylic acid is of too poor hydrophilicity. Accordingly, the polyacrylic acid (2) is neutralized to a desired neutralization level by mixing with a 10N-sodium hydroxide solution (10 mol %-NaOH solution), and a neutralized substance was used as the polyacrylic acid (2a). The neutralization level of the carboxyl group of the polyacrylic acid (2a) by sodium hydroxide is 80 mol %.

(Preparation of Slurry I)

Slurry I which contains the resin-containing particles A of 30% was obtained in the same manner as the slurry G except that 30 parts of the polyacrylic acid (1) was replaced with 45 parts of the polyacrylic acid (2a) and an amount of the ion-exchanged water was modified to 2055 parts.

(Preparation of Slurry J)

Slurry J which contains the resin-containing particles A of 30% was obtained in the same manner as the slurry G except that the polyacrylic acid (1) was replaced with polyacrylic acid (2b) described below.

The polyacrylic acid (2b) is a neutralized substance of the polyacrylic acid (2) and is prepared in the same manner as the polyacrylic acid (2a). The neutralization level of the carboxyl group of the polyacrylic acid (2b) by sodium hydroxide is 90 mol %.

(Preparation of Slurry K)

Slurry K which contains the resin-containing particles A of 30% was obtained in the same manner as the slurry G except that the polyacrylic acid (1) was replaced with polyacrylic acid (2c) described below. The polyacrylic acid (2c) is a neutralized substance of the polyacrylic acid (2) and is prepared in the same manner as the polyacrylic acid (2a). The neutralization level of the carboxyl group of the polyacrylic acid (2c) by sodium hydroxide is 95 mol %.

(Preparation of Slurry L)

Preparation of slurry L which contains the resin-containing particles A of 30% was tried in the same manner as the slurry G except that the polyacrylic acid (1) was replaced with polyacrylic acid (dispersant: AC-107 (trade name) manufactured by Nihon Junyaku; hereinafter referred to as "polyacrylic acid (3)"), but the slurry L could not be obtained because the dispersion stability could not be maintained at the finely-granulating operation and a piping of the fine particle-manufacturing apparatus was plugged up. It is considered that this is because the molecular weight of the polyacrylic acid (3) is too small, such as 4000, as indicated in Table 2 mentioned later. The polyacrylic acid (3) is a neutralized substance obtained by neutralizing the carboxyl group by sodium hydroxide, and its neutralization level of the carboxyl group by sodium hydroxide is 95 mol %.

(Preparation of Slurry M)

Slurry M which contains the resin-containing particles A of 30% was obtained in the same manner as the slurry G except that the polyacrylic acid (1) was replaced with polyacrylic acid (4) described below. The polyacrylic acid (4) is a neutralized substance obtained by neutralizing polyacrylic acid (dispersant: AC-20L (trade name) manufactured by Nihon Junyaku) by a 10N—NaOH solution and having its neutralization level of 95 mol %.

(Preparation of Slurry N)

Preparation of slurry N which contains the resin-containing particles A of 30% was tried in the same manner as the slurry G except that the polyacrylic acid (1) was replaced with polyacrylic acid (dispersant: AT-613 (trade name) manufactured by Nihon Junyaku; hereinafter referred to as "polyacrylic acid (5)"), but the slurry N could not be obtained because the dispersion stability could not be maintained at the finely-granulating operation and a piping of the fine particle-manufacturing apparatus was plugged up. It is considered that this is because a neutralization salt of the carboxyl group of the polyacrylic acid (5) is an ammonium salt, as indicated in Table 2 mentioned later, and therefore ammonia evaporates during the finely-granulating step and the neutralization level is lowered. The polyacrylic acid (5) is a neutralized substance obtained by neutralizing the carboxyl group by ammonium chloride, and its neutralization level of the carboxyl group by ammonium chloride is 90 mol %.

(Preparation of Slurry O)

Preparation of slurry O which contains the resin-containing particles A of 30% was tried in the same manner as the slurry G except that the polyacrylic acid (1) was replaced with polyacrylic acid (dispersant: AC-20H (trade name) manufactured by Nihon Junyaku; hereinafter referred to as "polyacrylic acid (6)"), but the slurry O could not be obtained because the viscosity of the slurry is too high at the finely-granulating operation and a piping of the fine particle-manufacturing apparatus was plugged up. It is considered that this is because the number average molecular weight of the polyacrylic acid (6) is too large, such as 100,000. The polyacrylic acid (6) is a neutralized substance obtained by neutralizing the carboxyl group by sodium hydroxide, and its neutralization level of the carboxyl group by sodium hydroxide is 95 mol %.

(Preparation of Slurry P)

Slurry P which contains the resin-containing particles A of 30% was obtained in the same manner as the slurry G except that the polyacrylic acid (1) was replaced with polyacrylic acid (7) described below. The polyacrylic acid (7) is a neutralized substance obtained by neutralizing polyacrylic acid (dispersant: AC-203 (trade name) manufactured by Nihon Junyaku) by a 10N—NaOH solution and having its neutralization level of 95 mol %.

(Preparation of Slurry Q)

Slurry Q which contains the resin-containing particles A of 30% was obtained in the same manner as the slurry G except that the polyacrylic acid (1) was replaced with polyacrylic acid (8) described below. The polyacrylic acid (8) is a neutralized substance obtained by neutralizing polyacrylic acid (dispersant: AC-10N (trade name) manufactured by Nihon Junyaku) by a 10N-NaOH solution and having its neutralization level of 95 mol %.

(Preparation of Slurry R)

Slurry R which contains the resin-containing particles A of 30% was obtained in the same manner as the slurry G except that the polyacrylic acid (1) was replaced with polyitaconic acid (dispersant: AC-70N (trade name) manufactured by Nihon Junyaku). The polyitaconic acid AC-70N is a neutralized substance obtained by neutralizing the carboxyl group by sodium hydroxide (NaOH) and its neutralization level of the carboxyl group by sodium hydroxide is 95 mol %.

Table 2 shows a type, concentration in the slurry, the volume average particle diameter and variation coefficient of the resin-containing particles A to D as well as a type and concentration in the slurry of the aggregate dispersant respectively contained in the slurry A to R. Table 2 further describes the weight average molecular weight (Mw), the glass transition temperature (Tg), the neutralization level of the carboxyl group, and the counter cation in the neutralization salt of the carboxyl group with respect to the polymer in the aggregate dispersant, namely, polyacrylic acid (1) to polyacrylic acid (8) and polyitaconic acid. In Table 2, the weight average molecular weight is indicated by "Mw" and the glass transition temperature is indicated by "Tg".

TABLE 2

| | Dispersant | | | | | | Resin-containing particles | | | |
|---|---|---|---|---|---|---|---|---|---|---|
| Slurry | Type | Concentration in slurry (%) | Mw | Tg (° C.) | Neutralization level (mol %) | Neutralization salt-counter cation | Type | Concentration in slurry (%) | Volume average particle diameter (μm) | Variation coefficient |
| A | Polyacrylic acid (1) | 1 | 6000 | 106 | 70 | $Na^+$ | A | 10 | 0.97 | 32 |
| B | Polyacrylic acid (1) | 1 | 6000 | 106 | 70 | $Na^+$ | B | 10 | 1.23 | 31 |
| C | Polyacrylic acid (1) | 1 | 6000 | 106 | 70 | $Na^+$ | C | 10 | 1.57 | 33 |
| D | Polyacrylic acid (1) | 1 | 6000 | 106 | 70 | $Na^+$ | D | 10 | 2.56 | 35 |
| E | Dodecylbenzenesulfonic acid | 1 | — | — | 70 | $Na^+$ | A | 10 | 0.95 | 29 |
| F | Polyacrylic acid (1) | 1 | 6000 | 106 | 70 | $Na^+$ | A | 20 | 1.25 | 34 |
| G | Polyacrylic acid (1) | 1 | 6000 | 106 | 70 | $Na^+$ | A | 30 | — | — |
| H | Polyacrylic acid (2a) | 1 | 6000 | 106 | 80 | $Na^+$ | A | 30 | — | — |
| I | Polyacrylic acid (2a) | 1.5 | 6000 | 106 | 80 | $Na^+$ | A | 30 | 1.27 | 34 |
| J | Polyacrylic acid (2b) | 1 | 6000 | 106 | 90 | $Na^+$ | A | 30 | 1.09 | 28 |
| K | Polyacrylic acid (2c) | 1 | 6000 | 106 | 95 | $Na^+$ | A | 30 | 0.91 | 30 |
| L | Polyacrylic acid (3) | 1 | 4000 | 106 | 95 | $Na^+$ | A | 30 | — | — |
| M | Polyacrylic acid (4) | 1 | 80000 | 136 | 95 | $Na^+$ | A | 30 | 1.68 | 34 |
| N | Polyacrylic acid (5) | 1 | 20000 | 106 | 90 | $NH_4^+$ | A | 30 | — | — |
| O | Polyacrylic acid (6) | 1 | 100000 | 136 | 95 | $Na^+$ | A | 30 | — | — |
| P | Polyacrylic acid (7) | 1 | 10000 | 106 | 95 | $Na^+$ | A | 30 | 0.98 | 30 |
| Q | Polyacrylic acid (8) | 1 | 40000 | 106 | 95 | $Na^+$ | A | 30 | 1.01 | 30 |
| R | Polyitaconic acid | 1 | 20000 | — | 95 | $Na^+$ | A | 30 | 1.03 | 34 |

Example 1

In a 5-liter separable flask, 2940 parts of the slurry A and 60 parts of magnesium chloride were put and mixed with each other. A thus-obtained admixture, i.e., the slurry A to which magnesium chloride had been added, was stirred by a propeller blade for one hour and in the meantime, a temperature of the slurry A was increased from a room temperature (25° C.) to 70° C. Magnesium chloride was added in form of drops of a solution having a concentration of 20% which was prepared by using ion-exchanged water as a solvent. The drip rate was 30 mL/min.

Subsequently, the temperature of the slurry A was maintained at 70° C. for 30 minutes and then, icy water was put in the flask, and the flaks itself was dipped in icy water, thereby cooling the slurry A down to 50° C. and bringing the aggregation of the resin-containing particles A to a halt. The slurry which contained the particle aggregate formed of aggregated resin-containing particles A was sufficiently cleaned with the ion-exchanged water so that the particle aggregate was isolated, and the particle aggregate was dried. A toner of Example 1 was thus prepared.

Example 2

A toner of Example 2 was prepared in the same manner as Example 1 except that an amount of the slurry A was modified to 2970 parts and an amount of magnesium chloride was modified to 30 parts.

Example 3

A toner of Example 3 was prepared in the same manner as Example 1 except that the amount of the slurry A was modified to 2925 parts and the amount of magnesium chloride was modified to 75 parts.

Example 4

A toner of Example 4 was prepared in the same manner as Example 1 except that the slurry A was modified to the slurry B.

Example 5

A toner of Example 5 was prepared in the same manner as Example 1 except that the slurry A was modified to the slurry C.

Example 6

A toner of Example 6 was prepared in the same manner as Example 1 except that magnesium chloride was modified to calcium chloride.

Example 7

A toner of Example 7 was prepared in the same manner as Example 1 except that the amount of the slurry A was modified to 2985 parts and the amount of magnesium chloride was modified to 15 parts.

Example 8

A toner of Example 8 was prepared in the same manner as Example 1 except that the amount of the slurry A was modified to 2910 parts and the amount of magnesium chloride was modified to 90 parts.

Example 9

A toner of Example 9 was prepared in the same manner as Example 1 except that 2940 parts of the slurry A was replaced with 2955 parts of the slurry F and the blending amount of magnesium chloride was modified to 45 parts.

Example 10

A toner of Example 10 was prepared in the same manner as Example 1 except that 2940 parts of the slurry A was replaced with 2970 parts of the slurry I and the blending amount of magnesium chloride was modified to 30 parts.

Example 11

A toner of Example 11 was prepared in the same manner as Example 1 except that 2940 parts of the slurry A was replaced with 2963 parts of the slurry J and the blending amount of magnesium chloride was modified to 37 parts.

Example 12

A toner of Example 12 was prepared in the same manner as Example 1 except that 2940 parts of the slurry A was replaced with 2955 parts of the slurry K and the blending amount of magnesium chloride was modified to 45 parts.

Example 13

A toner of Example 13 was prepared in the same manner as Example 1 except that 2940 parts of the slurry A was replaced with 2970 parts of the slurry M and the blending amount of magnesium chloride was modified to 30 parts.

Example 14

A toner of Example 14 was prepared in the same manner as Example 1 except that 2940 parts of the slurry A was replaced with 2970 parts of the slurry P and the blending amount of magnesium chloride was modified to 30 parts.

Example 15

A toner of Example 15 was prepared in the same manner as Example 1 except that 2940 parts of the slurry A was replaced with 2955 parts of the slurry Q and the blending amount of magnesium chloride was modified to 45 parts.

Example 16

A toner of Example 16 was prepared in the same manner as Example 1 except that 2940 parts of the slurry A was replaced with 2955 parts of the slurry R and the blending amount of magnesium chloride was modified to 45 parts.

Comparative Example 1

A toner of Comparative example 1 was prepared in the same manner as Example 1 except that magnesium chloride was modified to sodium chloride.

Comparative Example 2

A toner of Comparative example 2 was prepared in the same manner as Example 1 except that the slurry A was modified to the slurry D.

Comparative Example 3

A toner of Comparative example 3 was prepared in the same manner as Example 1 except that the slurry A was modified to the slurry E.

Table 3 shows property values of the toners of Examples and Comparative examples obtained as described above, and conditions for manufacturing the toners of Examples and Comparative examples. An additive amount of the metal salt shown in Table 3 indicates a ratio (part by weight) of the metal salt to 100 parts by weight of polyacrylic acid or dodecylbenzenesulfonic acid. In addition, the characteristics of the toner according to Examples and Comparative examples are evaluated in the following manner, and the evaluation results are also shown in Table 3. The environmental stability and long period running property among the characteristics of the toner were evaluated by using a developer prepared by mixing ferrite particles (manufactured by Powdertech Kabushiki Kaisha, volume average particle diameter of 60 μm) as a carrier and a toner at a weight rate of 95:5.

[Environmental Stability]

The obtained developers were stirred for 30 minutes under (a) a normal temperature/high humidity (NH) environment of ambient temperature of 20° C. and humidity of 80% and (b) a low temperature/lower humidity environment of ambient temperature of 10° C. and humidity of 20%, respectively, and thereafter charging amounts of the toner were measured. A rate (NH/LL) of the charging amount of the toner under (a) the normal temperature/high humidity (NH) environment to the charging amount of the toner under (b) the low temperature/low humidity (LL) environment was determined as a rate of change in charging, which was defined as an evaluation index of environmental stability. In the environmental stability, the evaluation "Very good" was given to a case where the rate of change in charging was 0.85 or higher, the evaluation "Good" was given to a case where the rate of change in charging was 0.80 or higher and lower than 0.85, the evaluation "Available" was given to a case where the rate of change in charging was 0.70 or higher and lower than 0.80, and the evaluation "Poor" was given to a case where the rate of change in charging was lower than 0.70. When the rate of change in charging was 0.70 or higher, it was judged that there is no problem in practical use. In Table 3, the rate of change in charging is indicated by "NH/LL".

[Long Period Running Property]

The obtained developers were charged into a developer tank of a commercially available digital full-color multifunc tional machine (MX-200F (trade name) manufactured by Sharp Kabushiki Kaisha), and 10,000-sheet printing in blank image of A4 size was carried out by the above-mentioned digital full-color multifunctional machine under a normal temperature/normal humidity (NN) environment of temperature of 20° C. and humidity of 50%, and a presence of a fog in a blank portion of the 10,000th-formed blank image and the degree of the fog were judged by visual observation. On the basis of the result of visual observation, a long period running property of the toner was evaluated. In the long period running property of the toner, the evaluation "Good" was given to a case where no fog was observed or a fog was not substantially observed, the evaluation "Available" was given to a case where a little fog was observed, and the evaluation "Poor" was given to a case where a fog was easily observed.

| | |
|---|---|
| Very good | 3 points |
| Good | 2 points |
| Available | 1 point |
| Poor | 0 point |

The evaluation criteria of the comprehensive evaluation were as follows:

A: Very good. The total score of the respective items was 7 to 9 points;

B: Good. The total score of the respective items was 5 to 6 points;

C: Available. The total score of the respective items was 3 to 4 points; and

D: Poor. The total score of the respective items was 0 to 2 points.

TABLE 3

| | | Metal salt | | Volume average particle | Variation | | Environmental | | Long period | Comprehensive evaluation | |
|---|---|---|---|---|---|---|---|---|---|---|---|
| | | Metal | Additive | diameter | coefficient | | stability | | running | Total | |
| Toner | Slurry | ion | amount | (μm) | Value | Evaluation | NH/LL | Evaluation | property | score | Evaluation |
| Ex. 1 | A | $Mg^{2+}$ | 204 | 5.51 | 23 | Very good | 0.75 | Available | Available | 5 | B |
| Ex. 2 | A | $Mg^{2+}$ | 101 | 4.92 | 28 | Good | 0.78 | Available | Available | 4 | C |
| Ex. 3 | A | $Mg^{2+}$ | 256 | 6.17 | 25 | Very good | 0.73 | Available | Available | 5 | B |
| Ex. 4 | B | $Mg^{2+}$ | 204 | 5.87 | 27 | Good | 0.73 | Available | Available | 4 | C |
| Ex. 5 | C | $Mg^{2+}$ | 204 | 5.91 | 27 | Good | 0.71 | Available | Available | 4 | C |
| Ex. 6 | A | $Ca^{2+}$ | 204 | 5.67 | 28 | Good | 0.77 | Available | Available | 4 | C |
| Ex. 7 | A | $Mg^{2+}$ | 50 | 3.47 | 35 | Available | 0.72 | Available | Available | 3 | C |
| Ex. 8 | A | $Mg^{2+}$ | 309 | 10.07 | 21 | Very good | 0.75 | Available | Available | 5 | B |
| Ex. 9 | F | $Mg^{2+}$ | 152 | 5.49 | 21 | Very good | 0.82 | Good | Available | 6 | B |
| Ex. 10 | I | $Mg^{2+}$ | 67 | 5.67 | 25 | Very good | 0.86 | Very good | Good | 8 | A |
| Ex. 11 | J | $Mg^{2+}$ | 84 | 5.41 | 21 | Very good | 0.85 | Very good | Good | 8 | A |
| Ex. 12 | K | $Mg^{2+}$ | 102 | 5.24 | 24 | Very good | 0.83 | Good | Good | 7 | A |
| Ex. 13 | M | $Mg^{2+}$ | 67 | 6.17 | 32 | Available | 0.84 | Good | Good | 5 | B |
| Ex. 14 | P | $Mg^{2+}$ | 67 | 5.27 | 24 | Very good | 0.86 | Very good | Good | 8 | A |
| Ex. 15 | Q | $Mg^{2+}$ | 102 | 5.65 | 28 | Good | 0.79 | Available | Good | 5 | B |
| Ex. 16 | R | $Mg^{2+}$ | 102 | 5.31 | 25 | Very good | 0.76 | Available | Available | 5 | B |
| Comp. Ex. 1 | A | $Na^{+}$ | 204 | 2.41 | 41 | Poor | 0.74 | Available | Poor | 1 | D |
| Comp. Ex. 2 | D | $Mg^{2+}$ | 204 | 7.86 | 46 | Poor | 0.67 | Poor | Poor | 0 | D |
| Comp. Ex. 3 | E | $Mg^{2+}$ | 204 | 2.36 | 51 | Poor | 0.65 | Poor | Poor | 0 | D |

[Variation Coefficient]

The variation coefficient of volume particle size distribution of the toner obtained by measurement using the above-mentioned COULTER MULTISIZER III (aperture diameter of 100 μm) manufactured by Coulter K.K., was evaluated according to the following criteria:

Very good: The variation coefficient was 25% or lower;

Good: The variation coefficient was higher than 25% and 30% or lower;

Available: The variation coefficient was higher than 30% and 40% or lower; and

Poor: The variation coefficient was higher than 40%.

[Comprehensive Evaluation]

On the basis of the evaluation results of the environmental stability, long period running property and variation coefficient of the toner, the comprehensive evaluation of the characteristics of the toner was carried out. In the comprehensive evaluation, scores were given to the respective evaluation results for evaluation items according to the following criteria, a total score of the respective items was calculated. The comprehensive evaluation was carried out by using the total score as evaluation index:

As shown in Table 3, the toners of Examples 1 to 8 exhibit such small variation coefficients as 35 or less and have the uniform size. The toners of Examples 1 to 16 were each obtained by aggregating the resin-containing particles which contained the binder resin and the colorant, with the aid of the aggregate dispersant of the invention which contained the polymer having the anionic polar group bonded to the main chain, and the salt of divalent or higher valent metal. Further, in the cases of Examples 1 to 6 and 9 to 16, the additive amount of the salt of divalent or higher valent metal fell in a range from 65 parts by weight to 300 parts by weight, which range was favorable, with the result that the particle aggregate was able to be obtained whose volume average particle size fell in a range from 4 μm to 8 μm, thus allowing the toner to have a favorable particle diameter for image formation.

The toner of Comparative example 1 was obtained by using salt of monovalent metal instead of the salt of divalent or higher valent metal. In the toner of Comparative example 1, the size of the particle aggregate was various, and the aggregation degree of the resin-containing particles effected by addition of the metal salt was low, resulting in the smaller particle aggregate which was thus inappropriate to be used as the toner. The toner of Comparative example 2 was obtained by using the resin-containing particles D which contained the binder resin particles and the colorant particles having a large dispersion diameter. In the toner of Comparative example 2, the variation coefficient was large so that the particle aggregates were not allowed to have the uniform particle size. The toner of Comparative example 3 was obtained by using as the dispersant dodecylbenzenesulfonic acid having a molecule in which a sulfone group was contained. In the toner of Comparative example 3, the size of the particles aggregate was various, and even using the salt of divalent or higher valent metal, the aggregation degree of the resin-containing particles was low, resulting in the smaller particle aggregate which was thus inappropriate to be used as the toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing an aggregate of resin-containing particles, comprising: aggregating the resin-containing particles containing binder resin and colorant by using an aggregate dispersant and a salt of divalent or higher valent metal in an aqueous medium, comprising:

a dispersing step for dispersing in an aqueous medium, irregular resin particles containing the binder resin and the colorant in the presence of the aggregate dispersant, to obtain a slurry of the irregular resin particles;

a finely-granulating step for finely granulating the irregular resin particles contained in the slurry to obtain a slurry of the resin-containing particles; and an aggregating step for aggregating the resin-containing particles by adding the salt of divalent or higher valent metal to the slurry of the resin-containing particles;

wherein the aggregate dispersant comprises a polymer in which an anionic polar group is bonded to a main chain, and an amount of the salt of divalent or higher valent metal added to the slurry of the resin-containing particles is such that a total valence of an anionic polar group contained in the polymer is larger than a total valence of the salt of divalent or higher valent metal.

2. The method of claim 1, wherein a ratio of the salt of divalent or higher valent metal added to the slurry of the resin-containing particles is 65 parts by weight to 300 parts by weight based on 100 parts by weight of the aggregate dispersant.

3. The method of claim 1, wherein a use ratio of the resin-containing particles is in a range of from 3 parts by weight to 50 parts by weight based on 100 parts by weight of the aqueous medium.

4. The method of claim 1, wherein a volume average particle diameter of the resin-containing particles is in a range of from 0.4 μm to 2.0 μm.

5. The method of claim 1, wherein a use ratio of the aggregate dispersant is in a range of from 5 parts by weight to 20 parts by weight based on 100 parts by weight of the resin-containing particles.

6. The method of claim 1, wherein the polymer is polyacrylic acid.

7. The method of claim 1, wherein the anionic polar group of the polymer is neutralized by an alkali metal base, and a neutralization level of the anionic polar group by the alkali metal base is within a range of from 80 mol % to 100 mol %.

8. The method of claim 1, wherein the polymer has a weight average molecular weight more than 4000 and less than or equal to 9000.

9. The method of claim 1, wherein a temperature of the slurry in the finely-granulating step is less than a reference temperature (Tg ° C.+100° C.) which is an addition of a glass transition temperature Tg ° C. of the aggregate dispersant polymer and 100° C.

10. A method of manufacturing an aggregate of resin-containing particles, comprising: aggregating the resin-containing particles containing binder resin and colorant by using an aggregate dispersant and a salt of divalent or higher valent metal in an aqueous medium, comprising a dispersing step for dispersing in an aqueous medium, irregular resin particles containing the binder resin and the colorant in the presence of the aggregate dispersant, to obtain a slurry of the irregular resin particles;

a finely-granulating step for finely granulating the irregular resin particles contained in the slurry to obtain a slurry of the resin-containing particles; and an aggregating step for aggregating the resin-containing particles by adding the salt of divalent or higher valent metal to the slurry of the resin-containing particles;

wherein the aggregate dispersant comprises a polymer in which an anionic polar group is bonded to a main chain, the salt of divalent or higher valent metal being used in the form of a solution, and wherein concentration of the salt of divalent or higher valent metal in the solution of the salt of divalent or higher valent metal is 5% by weight to 30% by weight.

11. The method of claim 10, wherein the solution of the salt of divalent or higher valent metal drips into the slurry of the resin-containing particles at a drip rate of 0.05 mL/min to 0.20 mL/min.

* * * * *